US007155776B2

(12) United States Patent
Park

(10) Patent No.: US 7,155,776 B2
(45) Date of Patent: Jan. 2, 2007

(54) MULTIPURPOSE HINGE APPARATUS HAVING AUTOMATIC RETURN FUNCTION

(75) Inventor: Bong Mook Park, Kyungki-do (KR)

(73) Assignee: I-One Innotech Co., Ltd., Gyeonggi-Do (KR)

( * ) Notice: Subject to any disclaimer, the term of this patent is extended or adjusted under 35 U.S.C. 154(b) by 180 days.

(21) Appl. No.: 10/822,827

(22) Filed: Apr. 13, 2004

(65) Prior Publication Data

US 2004/0250377 A1 Dec. 16, 2004

(30) Foreign Application Priority Data

Jun. 10, 2003 (KR) ..... 10-2003-0037203
Jun. 10, 2003 (KR) ..... 10-2003-0037204
Dec. 8, 2003 (KR) ..... 10-2003-0088643

(51) Int. Cl.
*E05F 3/20* (2006.01)

(52) U.S. Cl. ..... 16/50; 16/54; 16/312

(58) Field of Classification Search ..... 16/50, 16/54, 316, 312, 317, 319, 352, 303, 330
See application file for complete search history.

(56) References Cited

U.S. PATENT DOCUMENTS 2,456,537 A * 12/1948 Seaman et al. ..... 16/54
4,068,344 A * 1/1978 Okabe ..... 16/54
4,485,522 A * 12/1984 Chen ..... 16/54
4,756,051 A * 7/1988 Shy ..... 16/50
4,788,746 A * 12/1988 Idler ..... 16/297
5,572,768 A * 11/1996 Daul ..... 16/49
6,205,619 B1 * 3/2001 Jang ..... 16/352

* cited by examiner

*Primary Examiner*—Chuck Y. Mah
*Assistant Examiner*—Michael J. Kyle
(74) *Attorney, Agent, or Firm*—Rosenberg, Klein & Lee

(57) ABSTRACT

A multipurpose hinge apparatus having an automatic return function is provided in which the apparatus is installed between the door and a main body. The apparatus includes a driving mechanism for ascending and descending a piston rod according to opening and closing of the door which is installed in the upper portion of a cylindrical housing. A piston is connected with the piston rod, in which a one-direction check valve is installed in the piston. The piston partitions an upper chamber and a lower chamber and ascends and descends in association with the piston rod. A first oil path communicates with the upper and lower chambers via the lower portion of the piston rod in the central portion of the piston. A compression spring which makes the piston ascend is inserted into the lower chamber. Oil is filled in the chamber. Thus, the hinge apparatus is automatically returned to the initial position with return speed in multiple steps by controlling an amount of oil flowing from upper chamber to lower chamber in multiple steps when a door is closed.

18 Claims, 34 Drawing Sheets

MULTIPURPOSE HINGE APPARATUS HAVING AUTOMATIC RETURN FUNCTION

BACKGROUND OF THE INVENTION

1. Field of the Invention

The present invention relates to a multipurpose hinge apparatus having an automatic return function, and more particularly, to a multipurpose hinge apparatus having a stable and reliable mechanism of setting multi-step automatic return speed which can be applied in any hinge apparatus whose rotational axis is same or different from that of a door such as a left/right rotating door hinge apparatus, or an up/down rotational hinge apparatus.

2. Description of the Related Art

A hinge apparatus is an apparatus which makes two members spaced from each other or folded one over another according to necessity. A representative example of the hinge apparatus is a left/right rotational hinge apparatus including a horizontal actuator which is used between a door and window frame, or an up/down rotational hinge apparatus including a vertical actuator which is used for a refrigerator, a mobile phone, or a notebook computer.

A conventional hinge apparatus having an automatic return function is disclosed in Korean Laid-open Patent Publication No. 2001-0027832.

The conventional hinge apparatus includes a fixed hinge plate which is fixed to a door frame, and a movable hinge plate which is fixed on the door and moved together with the door as the door is opened and closed. Also, a plurality of cylindrical hinge knuckles are formed in the respective ends of the fixed hinge plate and the movable hinge plate, for binding the two hinge plates mutually. An upper cap is threadedly coupled with the fixed hinge knuckle, and a compression spring is installed in the lower portion of the upper cap, in order to provide a rotational force of the door.

In this case, when a door is opened, a conversion head is rotated together with the movable hinge knuckle and moves up and down according to repulsive power of the compression spring. The moving distance of the conversion head is limited by a guide pin which moves according to guidance of a guide elongate hole.

In the case of the conventional hinge apparatus, the conversion head is raised up according to rotation of the movable hinge plate when a door is opened, and the conversion head falls down by an elastic restoring force of the compression spring when the door is closed. Also, the hinge apparatus adjusts door closing speed by adjusting an amount of pressure oil flowing a return oil path, and first and second speed adjusting oil paths, and thus varying ascending and descending speed of the conversion head.

However, in the case of the hinge apparatus, the conversion head which ascends and descends according to rotation of the door are guided by a pair of guide pins. The guide pins are fixed to hinge knuckles. Also, a cylinder and the conversion head are incorporated in the knuckles of four or so. Accordingly, when the movable hinge knuckles receive big load and rotate for a long time, durability of the hinge apparatus is lowered and the structure is complicated. As a result, an assembly productivity deteriorates.

Also, since the compression spring for performing an automatic return of the door is arranged in the upper side of the conversion head, and a hydraulic circuit for adjusting return speed of the door is arranged in the lower side of the conversion head, it is difficult to reduce the total length of the hinge apparatus. Further, since lengthy space of arranging the compression spring is limited only in the upper side of the conversion head, a large restoring force cannot be provided for automatic return of the door. Accordingly, it is difficult to apply the compression spring to a large-scale door.

Also, the inner portion of the hinge apparatus and a mechanism of connecting the fixed portion and the movable portion of the hinge apparatus are applied only in the hinge apparatus. As a result, it is not possible to apply the hinge apparatus to a structure that the center of a door differs from that of the hinge apparatus.

Also, a fixing unit for temporarily fixing the door so that the door is not made to rotate at the state where the door is opened at a predetermined angle is not installed in the hinge apparatus. Accordingly, it is inconvenient for users to use the hinge apparatus.

Meanwhile, Korean Utility Model Registration No. 0271646 discloses a hinge door opening and closing apparatus in which a hydraulic door closer and a spring door closer are separately configured and the former and the latter are combined with each other.

Since the door opening and closing apparatus uses two combined door closers, it is difficult to make it compact. In this case, since a fixing unit for temporarily fixing the door so that the door is not made to rotate at the state where the door is opened at a predetermined angle is not also installed in the hinge apparatus, it is inconvenient for users to use the hinge door opening and closing apparatus. As a result, when a large external force such as a strong wind is applied to a door, it cannot prevent the door from being closed or opened at excessive speed.

Also, Korea Laid-open Patent Publication No. 2001-77142 discloses a door hinge apparatus which includes an upper hinge and a lower hinge adopting no hydraulic circuit to realize an automatic return function. Similarly to the above-described Korean Laid-open Patent Publication No. 2001-0027832, Korea Laid-open Patent Publication No. 2001-77142 does not have any excessive speed prevention function. Accordingly, it is impossible to adjust return speed according to necessity, since the return speed is determined by a cam diagram angle of only a predetermined return groove and speed set by a restoring force of a spring.

Meanwhile, Korean Utility Model Registration No. 238712 discloses a door hinge apparatus having a structure of ascending and descending a slider according to rotation of a stem in which the stem and the slider where the stem penetrates through a spiral elongate hole perforated on a main wall of the slider are combined through a bearing with both ends of a fixed pin, and a hydraulic control structure that an elastic spring is compressed according to descending of the slider and simultaneously oil is compressed where the compressed oil moves upwards through two oil paths and a check valve which are installed in a base and an oil tube.

However, in the case of the above-described hinge apparatus, the shapes and structures of the oil paths are very complicated, and thus workability is very bad. Also, when the door is opened, it is temporarily stopped and when a large external force such as a strong wind is applied to the door, excessive speed of the door cannot be prevented. Also, an oil containing space is deficient generally. Accordingly, when the door is opened and closed, each component of the hinge apparatus undergoes an overload or users should use a large force relatively.

Meanwhile, the conventional art has not provided an optimized structure of an up/down rotational door hinge apparatus which is applied in a Kimchi refrigerator for use in a storage device for storing a fermentation food such as Kimchi which is one of Korean traditional foods.

SUMMARY OF THE INVENTION

To solve the above problems, it is an object of the present invention to provide a multipurpose hinge apparatus which can be applied in any hinge apparatus whose rotational axis is same or different from that of a door in a left/right rotating door hinge apparatus or an up/down rotational hinge apparatus which is applied in a Kimchi refrigerator for use in a storage device for storing a fermentation food such as Kimchi which is one of Korean traditional foods.

It is another object of the present invention to provide a multipurpose hinge apparatus having an automatic return function which can control automatic return speed and a return force of a door by changing a cam diagram angle of an ascending and descending guide hole which guides ascending of a piston, as well as which can control a restoring force of a return spring and an oil path of a hydraulic circuit during an automatic return of the door.

It is still another object of the present invention to provide a hinge apparatus which can be completely returned to an initial position of a door although a torsion spring is not used but a compression spring is used as a return spring during an automatic return of the door, by establishing a cam diagram angle of an ascending and descending guide hole at a door opening angle region between 0° and 15° to be relatively larger than that at a door opening angle region between 15° and 90°.

It is yet another object of the present invention to provide a multipurpose hinge apparatus which can be automatically closed so that a door is adjusted at fast speed until the door gets close to an initial position and at slow speed after the door has got to the initial position, by establishing return speed as first speed which is the fastest speed at a door opening angle between 90° and 30°, as second speed which is the slowest speed at the door opening angle between 30° and 15°, and as third speed which is slower than the first speed and faster than the second speed at the door opening angle between 15° and 0° with a cam diagram angle of an ascending and descending guide hole which guides ascending of a piston during an automatic return of a door and a hydraulic circuit mechanism.

It is yet still another object of the present invention to provide a multipurpose hinge apparatus which prevents a door from being automatically returned by a return spring, maintains the door to be opened at an opened angle, and can establish an opening angle as desired, by establishing a cam diagram angle of an ascending and descending guide hole which guides ascending of a piston to be zero when an opening angle of the door ranges between 90° and 130°.

It is a further object of the present invention to provide a multipurpose hinge apparatus having an excessive speed return prevention function which prevents a door from being returned at excessive speed by a strong force such as a strong wind and prevents a safety accident.

It is a still further object of the present invention to provide a multipurpose hinge apparatus which enables a user to freely and easily establish an amount of oil flow which determines return speed during an automatic return of a door, at the outer portion of the hinge apparatus.

It is a yet still further object of the present invention to provide a multipurpose hinge apparatus having a high operational reliability and an excellent assembly workability in which a return speed controlling mechanism and a return speed establishment mechanism of a door is simple and stable.

It is a yet object of the present invention to provide a multipurpose hinge apparatus which enables a user to make a large-scale door to be returned with a small force in which a lengthwise space structure capable of accommodating a return spring at maximum with respect to the total length of the hinge apparatus is provided to thereby provide a large restoring force during an automatic return of a door.

It is a still yet object of the present invention to provide a multipurpose hinge apparatus which employs a bearing mechanism in order to minimize a friction between a stationery portion and a rotating axis and adopts a roller in a guide pin, to thereby suppress noise generation and partial wear due to the friction at minimum.

It is a further yet object of the present invention to provide a multipurpose hinge apparatus having an optimized structure and a compact size.

It is a still further yet object of the present invention to provide a connection mechanism for a burial type or non-burial type multipurpose hinge apparatus whose appearance is elegant.

To accomplish the above object of the present invention, according to an aspect of the present invention, there is provided a hinge apparatus for a door comprising: a tubular housing; a housing upper sealing packing at the center of which a throughhole is formed and which is combined with the upper end of the housing in order to seal the upper portion of the housing; a cam shaft including a cylindrical body having first and second ascending and descending guide holes penetratively formed into a spiral shape of a mutually movable symmetrical structure along the outer circumferential surface, respectively, and a shaft of protruding out of the housing through the throughhole of the upper packing from the upper end of the cylindrical body, the cam shaft rotating by an external force relative to the housing when a door rotates; a cylindrical guide tube which is fixedly installed in the inner circumferential portion of the housing, in which first and second vertical guide holes are formed up and down at positions opposing each other, and the cylindrical body of the cam shaft is rotatably installed in the inner circumferential portion of the housing; a guide pin both ends of which are combined with the first and second vertical guide holes through the first and second ascending and descending guide holes, respectively; a piston rod on the upper end of which the central portion of the guide pin is penetratively combined and which ascends and descends along the inner circumferential surface of the cylindrical body of the cam shaft in a sliding method via the first and second vertical guide holes according to rotation of the cam shaft, in which a recessed groove communicating with the outer circumferential portion is formed in the lower portion of the piston rod; a piston which ascends and descends according to movement of the piston rod, and whose outer circumferential portion is slidably coupled with the inner circumferential portion of the housing to partition the inner space of the housing into an upper chamber and a lower chamber, in which the lower end of the piston rod is coupled with the central throughhole formed in the central portion thereof, and a first oil path communicating the upper chamber and the lower chamber with each other via the piston rod and the central throughhole is formed; at least one check valve which is installed in the piston and is opened during the time when the piston descends, and is closed during the time when the piston ascends, to thereby selectively form a second oil path communicating the upper chamber and the lower chamber with each other; an elastic member which is installed in the lower chamber to elastically support the piston, and provides an elastic force for making the piston ascend during return of the piston after descending of the piston according to opening of the door; a speed adjustment unit for adjusting an amount of oil flowing from the upper chamber to the lower chamber via the first oil path according to escalated height of the piston rod when the piston rod ascends along the inner circumferential surface of the cam shaft body, according to ascending of the piston during the return of the door, to thereby control an escalating speed of the piston in multiple steps; and a housing lower packing which is coupled with the lower portion of the housing to seal the lower chamber.

According to another aspect of the present invention, there is also provided a hinge apparatus for a door comprising: a cylindrical housing; a housing upper sealing packing at the center of which a throughhole is formed and which is combined with the upper end of the housing in order to seal the upper portion of the housing; a cam shaft through which first and second ascending and descending guide holes are penetratively formed in which the first and second ascending and descending guide holes are formed into a spiral shape of a mutually movable symmetrical structure along the outer circumferential surface of a cylindrical body, respectively, and which rotates by an external force relative to the housing when the shaft protrudes out of the housing through the throughhole of the upper packing from the upper end of the cylindrical body and thus a door rotates; a cylindrical guide tube which is fixedly installed in the inner circumferential portion of the housing, in which first and second vertical guide holes are formed up and down at positions opposing each other, and the cylindrical body of the cam shaft is rotatably installed in the inner circumferential portion of the housing; a guide pin both ends of which are combined with the first and second vertical guide holes through the first and second ascending and descending guide holes, respectively; a piston rod on the upper end of which the central portion of the guide pin is penetratively combined and which ascends and descends via the first and second vertical guide holes according to rotation of the cam shaft, in which a recessed groove communicating with the outer circumferential portion is formed in the lower portion of the piston rod; a piston which ascends and descends according to movement of the piston rod, and whose outer circumferential portion is slidably coupled with the inner circumferential portion of the housing to partition the inner space of the housing into an upper chamber and a lower chamber, in which the lower end of the piston rod is coupled with the central throughhole formed in the central portion thereof, and a first oil path communicating the upper chamber and the lower chamber with each other via the central throughhole of the piston rod is formed; at least one check valve which is installed in the piston and is opened during the time when the piston descends, and is closed during the time when the piston ascends, to thereby selectively form a second oil path communicating the upper chamber and the lower chamber with each other; an elastic member which is installed in the lower chamber to elastically support the piston, and provides an elastic force for making the elastic member compressed during the time when the piston descends, according to opening of the door, and making the piston ascend during return of the door; and a housing lower packing which is coupled with the lower portion of the housing to seal the lower chamber, wherein diameter of an exit at the lower end of the central throughhole is formed relatively smaller than that of the check valve, and the door is a door which is opened and closed up and down.

According to still another aspect of the present invention, there is also provided a multipurpose hinge apparatus comprising: a cylindrical housing whose inner circumferential portion is cylindrically formed; a housing upper sealing packing at the center of which a throughhole is formed and which is combined with the upper end of the housing in order to seal the upper portion of the housing; a cam shaft through which first and second ascending and descending guide holes are penetratively formed in which the first and second ascending and descending guide holes are formed into a spiral shape of a mutually movable symmetrical structure along the outer circumferential surface of a cylindrical body, respectively, and which rotates by an external force relative to the housing when the shaft protrudes out of the housing through the throughhole of the upper packing from the upper end of the cylindrical body and thus a door rotates; a cylindrical guide tube which is fixedly installed in the inner circumferential portion of the housing, in which first and second vertical guide holes are formed up and down at positions opposing each other, and the cylindrical body of the cam shaft is rotatably installed in the inner circumferential portion of the housing; a guide pin both ends of which are combined with the first and second vertical guide holes through the first and second ascending and descending guide holes, respectively; a piston rod on the upper end of which the central portion of the guide pin is penetratively combined and which ascends and descends via the first and second vertical guide holes according to rotation of the cam shaft, in which a return oil path communicating with the outer circumferential portion thereof is formed on an oil path elongate groove which is opened downwards; an oil path adjustment unit which is in the oil path elongate groove of the piston rod, having an inner diameter smaller than that of the oil path groove, in which a first speed adjustment oil path of an orifice shape whose diameter becomes gradually narrow is formed therein so that an amount of oil flowing inside is adjusted; a piston which ascends and descends according to movement of the piston rod, and whose outer circumferential portion is slidably coupled with the inner circumferential portion of the housing to partition the inner space of the housing into an upper chamber and a lower chamber, in which the lower end of the piston rod is coupled with the central throughhole formed in the central portion thereof; at least one check valve which is installed in the piston and is opened during the time when the piston descends, and is closed during the time when the piston ascends, to thereby selectively form a second speed adjustment oil path communicating the upper chamber and the lower chamber with each other; an elastic member which is installed in the lower chamber to elastically support the piston, and provides an elastic force for making the elastic member compressed during the time when the piston descends, according to opening of the door, and making the piston ascend during return of the door; a housing lower sealing packing which is coupled with the lower portion of the housing; and a hydraulic control rod whose one end is supported to the housing lower packing and other end is inserted into the first speed adjustment oil path, in which diameter of the other end of the hydraulic control rod is changed in multiple steps so that cross-sectional area of the first speed adjustment oil path through which oil flows according to movement of the piston rod up and down is changed in multiple steps, wherein the other end of the hydraulic control rod is formed of a first diameter portion having a first diameter, a second diameter portion having a diameter smaller than the first diameter, and a spherical portion having a diameter identical with the first diameter, and an automatic return speed of a door is changed into low speed, high speed and low speed, in sequence.

As described above, the present invention can be applied in any hinge apparatus whose rotational axis is same or different from that of a door such as a hinge apparatus between a door and a frame for use in a left/right rotating door or an up/down rotational hinge apparatus applied in a Kimchi refrigerator.

Also, the present invention can control return speed and a return force of a door simultaneously in multiple steps by adjusting an amount of flowing oil and a cam diagram angle of an ascending and descending guide hole, to thereby make the door automatically closed, and to thereby also temporarily stop the door which is opened at a certain angle by a pattern of the cam diagram angle.

BRIEF DESCRIPTION OF THE DRAWINGS

The above and other objects and advantages of the present invention will become more apparent by describing the preferred embodiments thereof in detail with reference to the accompanying drawings in which.

DETAILED DESCRIPTION OF THE INVENTION

Preferred embodiments of the present invention will be described with reference to the accompanying drawings.

Figure 1:
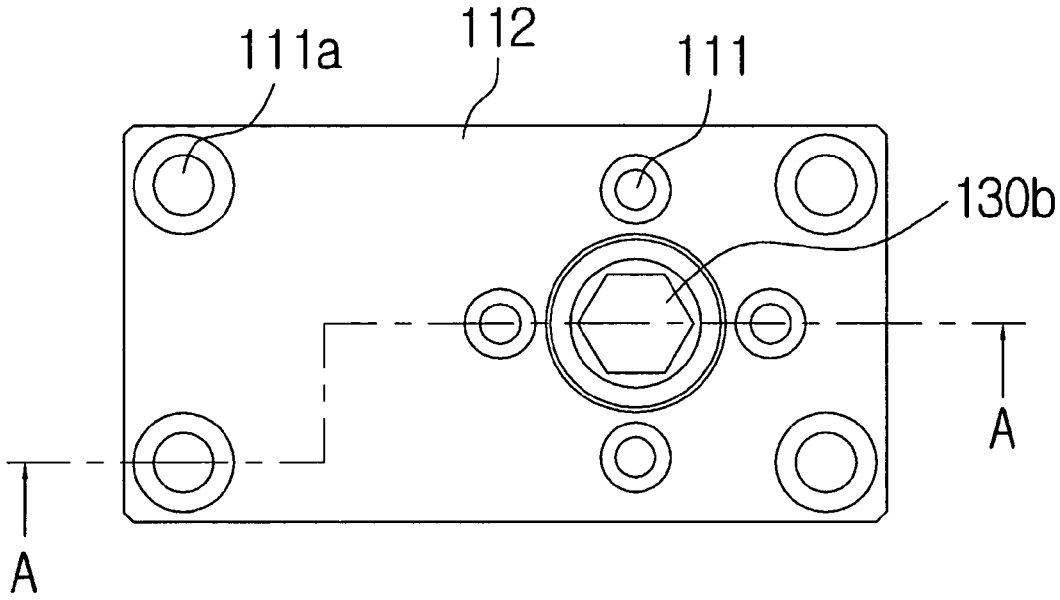
FIG. 1 is a plan view showing a multipurpose hinge apparatus according to a first embodiment of the present invention.
Figure 2:
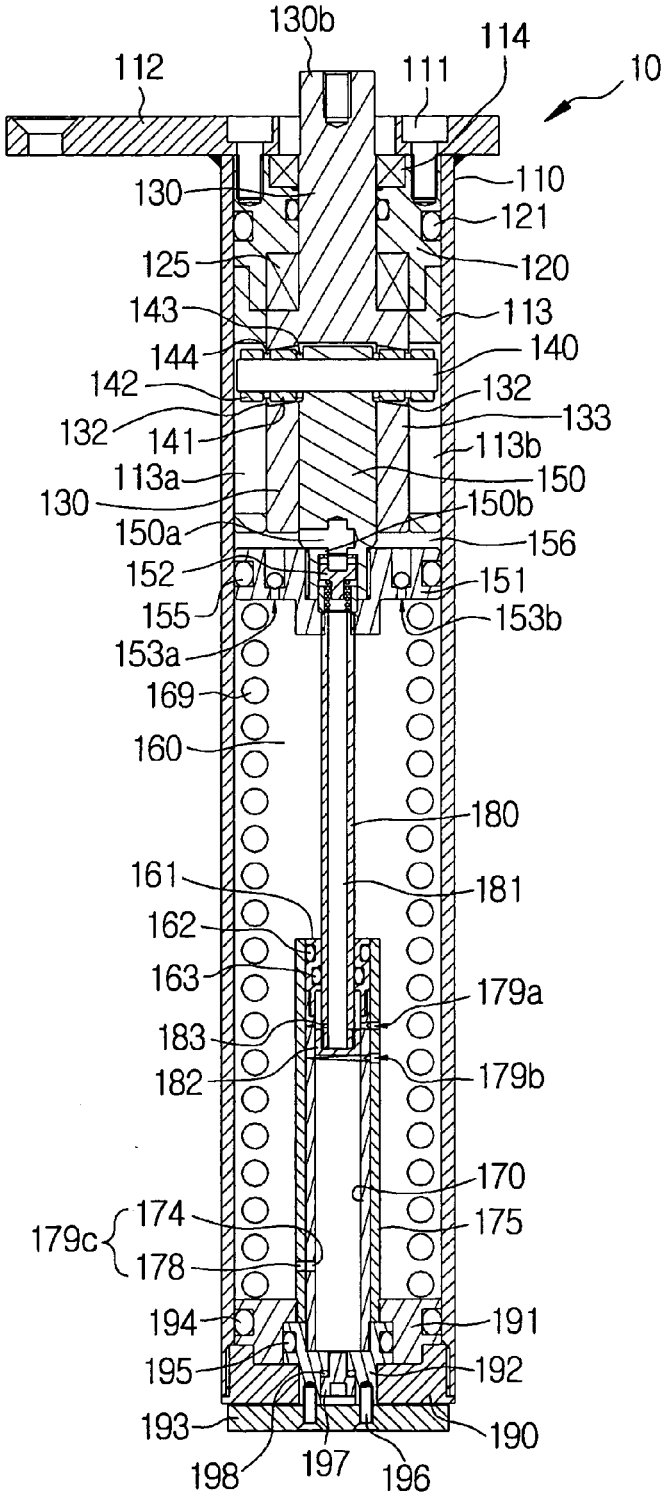
FIG. 2 is a lengthwise cross-sectional view cut along a line A—A of FIG. 1.
Figure 3:
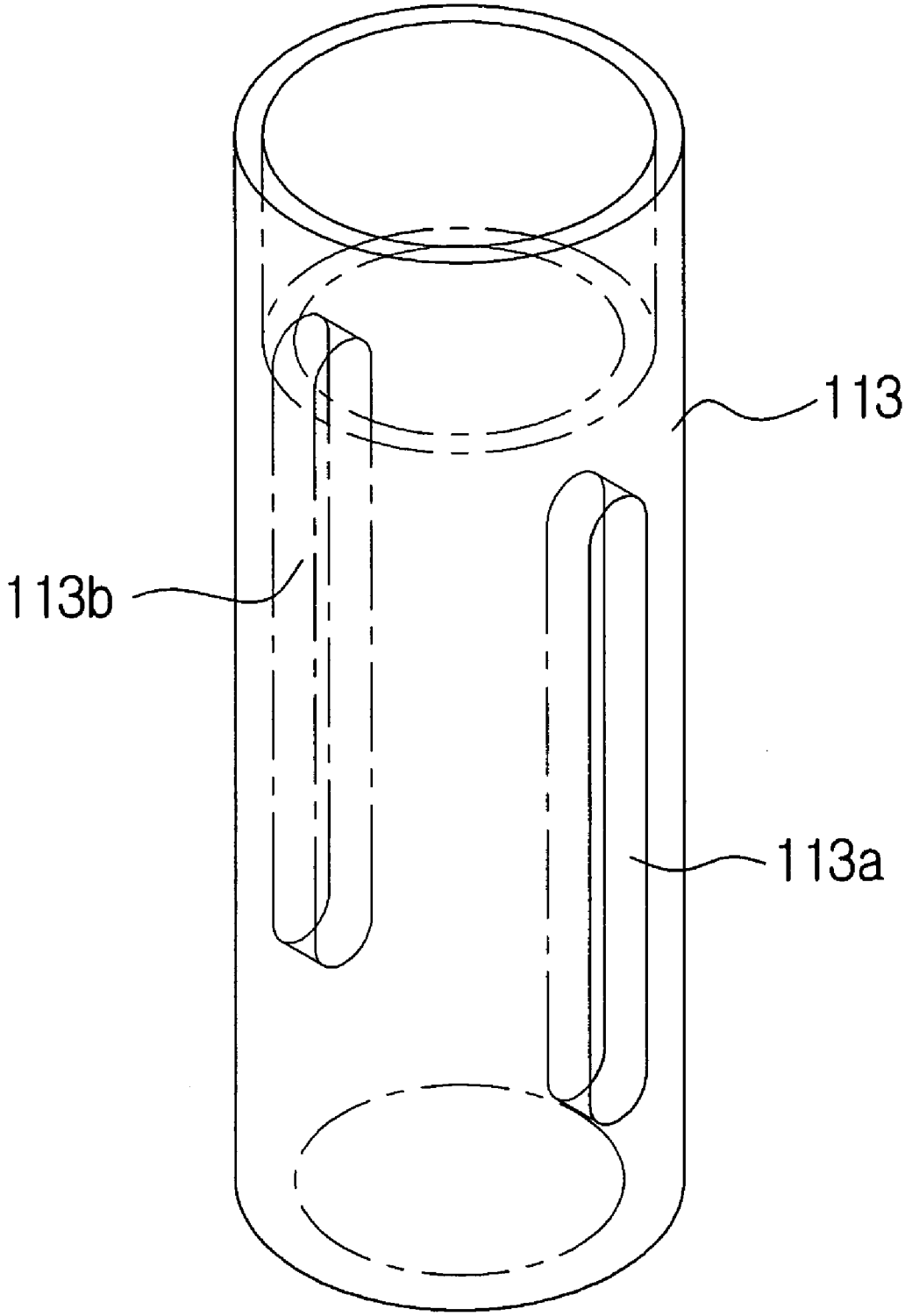
FIG. 3 is a perspective view showing a vertical guide for vertically guiding a guide pin which moves up and down in the multipurpose hinge apparatus shown in FIG. 2.
Figure 4A:
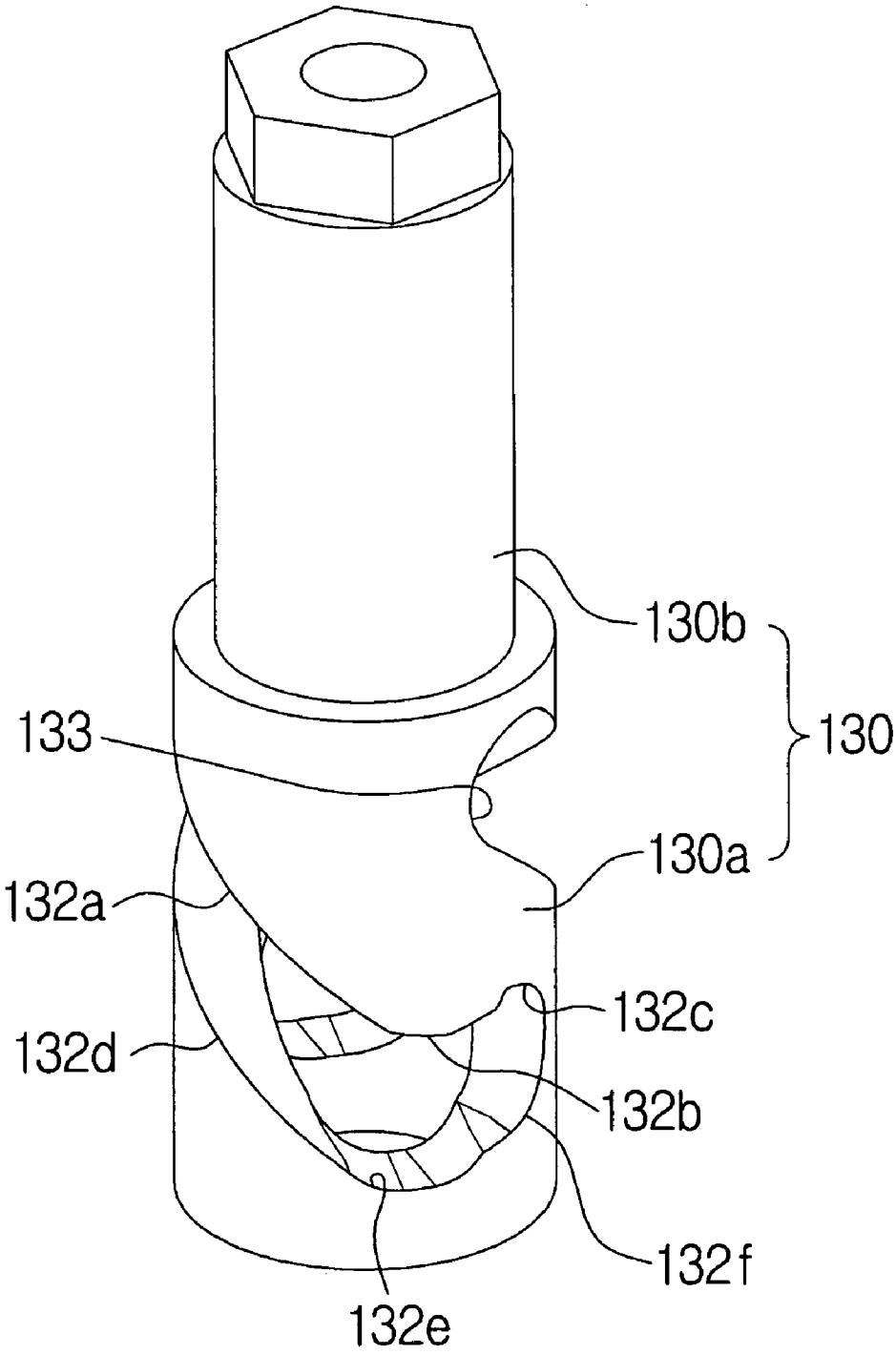
FIG. 4A is a perspective view showing a cam shaft for guiding a piston rod to move up and down according to opening and closing of a door in the multipurpose hinge apparatus shown in FIG. 2.

FIG. 1 is a plan view showing a multipurpose hinge apparatus according to a first embodiment of the present invention. FIG. 2 is a lengthwise cross-sectional view cut along a line A—A of FIG. 1. FIG. 3 is a perspective view showing a vertical guide for vertically guiding a guide pin which moves up and down in the multipurpose hinge apparatus shown in FIG. 2. FIG. 4A is a perspective view showing a cam shaft for guiding a piston rod to move up and down according to opening and closing of a door in the multipurpose hinge apparatus shown in FIG. 2.

As shown in FIGS. 1 through 4A, a multipurpose hinge apparatus 10 according to the first embodiment of the present invention includes a cylindrical housing 110 accommodating internal elements. A cylindrical upper packing 120 is combined with the inner circumferential portion of the upper end of the cylindrical housing 110 in order to seal the upper end portion of the cylindrical housing 110. The inner circumferential portion of the housing 110, the axial outer circumferential portion of a cam shaft to be described later, and O-rings 121 and 122 for sealing are inserted into respective recessed grooves in the outer and inner circumferential portions of the upper packing 120.

As shown in FIG. 3, the upper end portion of a cylindrical guide tube 113 in which a pair of vertical guide holes 113*a* and 113*b* are formed up and down at positions opposing each other is combined with the lower portion of the upper packing 120. Then, for example, mutual coupling portions are fixed by welding.

As shown in FIG. 4A, a cam shaft 130 through which a pair of ascending and descending guide holes 132 and 133 are formed forming a spiral pattern having a 180° movable symmetrical structure on the outer circumference of the cylindrical body 130*a* is rotatably installed in the inner circumferential portion of the guide tube 113. Also, the lower end of the shaft 130*b* is fixedly combined and integrated with the inner circumference of the upper end of the cylindrical body 130*a* of the cam shaft by welding. The upper end of the shaft is protruded through the central throughhole of the upper packing 120 out of the housing 110.

As will be described later, in the case that a rotational axis of a door differs from that of a door support frame according to an application pattern of a hinge apparatus, en end of a link is combined with a shaft 130*b* in the cam shaft 130 (refer to FIG. 9). Otherwise, in the case that the former is same as the latter, for example, in the case of a door hinge apparatus which is installed between a rotational door and a door frame of the door (refer to FIG. 10), a hinge knuckle fixed to the door support frame is combined with the shaft 130*b* in the cam shaft 130. Also, in the case of a hinge apparatus applied in an up/down rotational door such as a Kimchi refrigerator, an axial support buried in a door is connected and fixed to the shaft 130*b* in the cam shaft 130. As a result, since the hinge apparatus is buried in a door whose housing 110 is rotated or is fixedly installed in a support frame, the rotational force of the housing door is applied to the shaft 130*b* when the door is rotated, to thereby make the shaft rotate.

Also, since repulsive power of a return spring 169 to be described later functions between the upper packing and the cylindrical body 130*a* in the cam shaft, a trust bearing 125 is inserted in order to reduce rotational friction and noise when the cam shaft 130 rotates.

Further, both ends of a guide pin 140 which moves up and down according to rotation of the cam shaft 130 are inserted into the ascending and descending guide holes 132 and 133 formed in the outer circumference of the cylindrical body 130*a* in the cam shaft 130 and the vertical guide holes 113*a* and 113*b* in the guide tube 113, respectively. The upper end of a piston rod 150 which moves up and down according to movement of the guide pin up and down is connected with the guide pin 140.

On both ends of the guide pin 140 are installed first and second roller bearings 141 and 142 in order to prevent a partial wear from occurring together with reduction of friction and noise when the guide pin 140 moves along the ascending and descending guide holes 132 and 133 and the vertical guide holes 113*a* and 113*b* in the guide rod 113, respectively. Also, a first washer 143 is inserted between a first roller bearing 141 and the piston rod 150 in the guide pin 140, and a second washer 144 is inserted between the first and second roller bearings 141 and 142. The first and second roller bearings 141 and 142 closely contact the guide pin 140 in lengthy direction thereof without having any gap.

That is, the first roller bearing 141 is fitted into the position of the guide pin 140 contacting the ascending and descending guide holes 132 and 133 in the cam shaft 130, and the second roller bearing 142 is fitted into the position of the guide pin 140 contacting the vertical guide holes 113*a* and 113*b* in the guide tube 113.

Figure 5A:
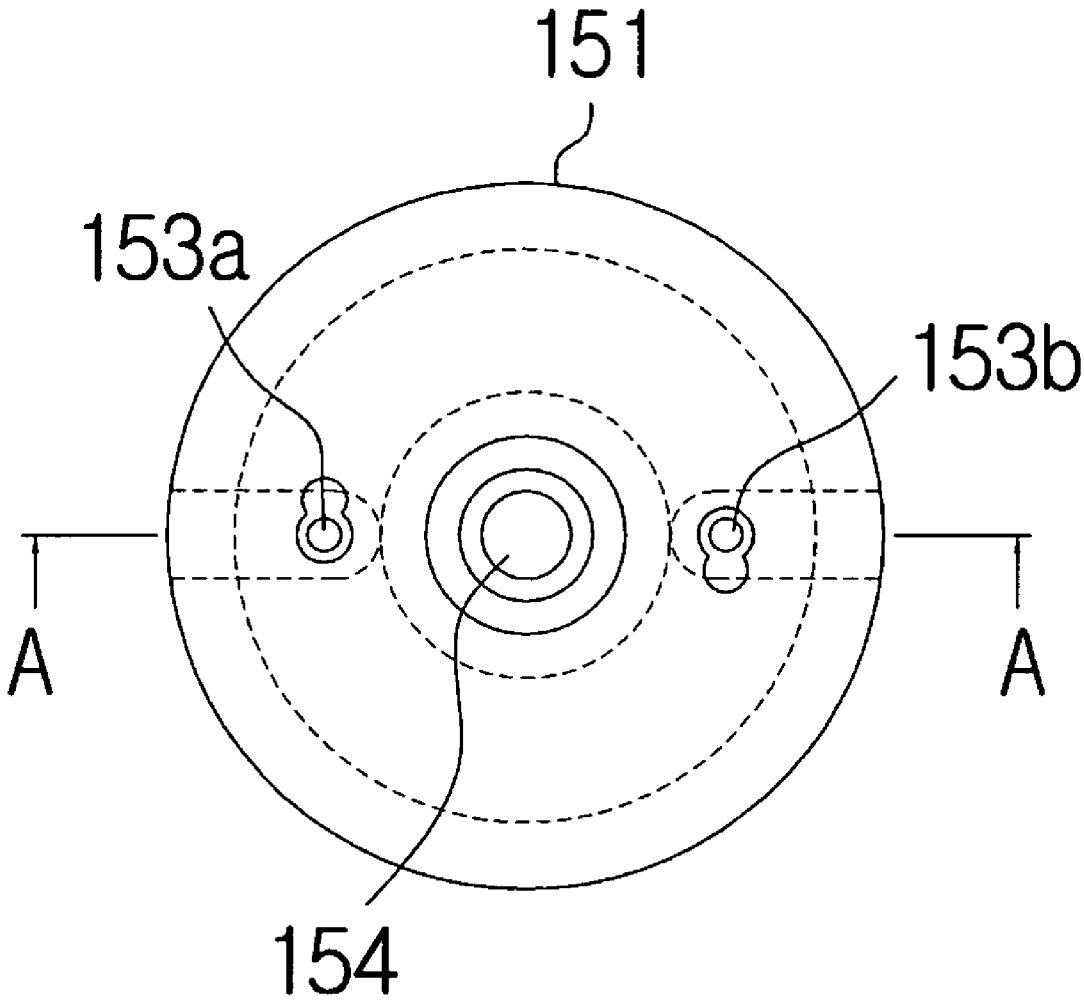
FIGS. 5A and 5B are a plan view showing a piston and a cross-sectional view cut along a line B—B of FIG. 5A, respectively.
Figure 5B:
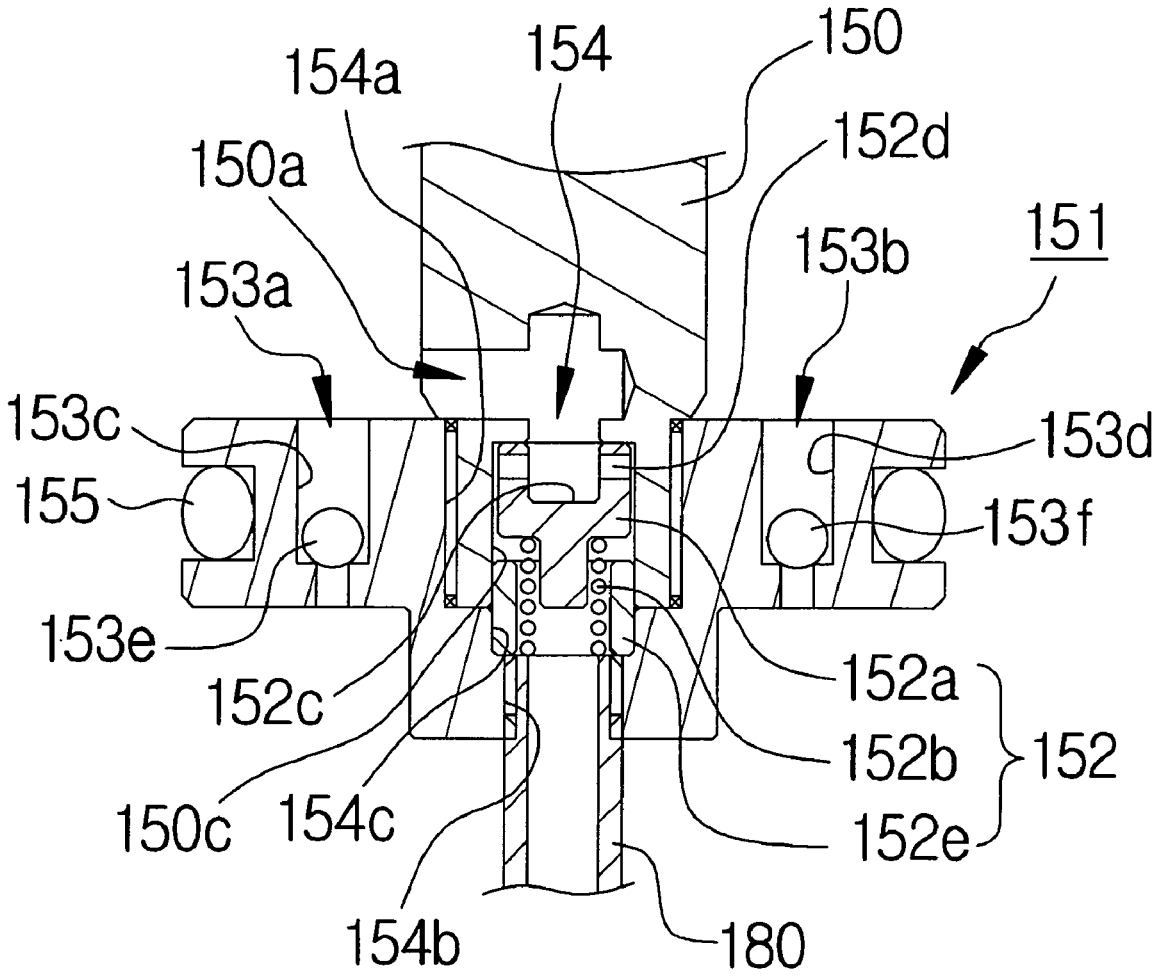

Meanwhile, as shown in FIGS. 5A and 5B, a piston 151 is combined with the lower portion of the piston rod 150. A central throughhole 154 is disposed in the central portion of the piston, in which an oil path is formed in the central throughhole 154 in order to guide oil in an upper chamber 156 located in the upper side of the piston 151 to move to a lower chamber 160 located in the lower side of the piston when a door is closed, that is, when the piston 150 ascends. On both sides of the central throughhole are disposed left/right throughholes 153*c* and 153*d* in which an oil path is formed when the door is opened, that is, the piston 151 descends.

In this case, first and second one-directional check valves 153*a* and 153*b* are installed in the left/right throughholes 153*c* and 153*d*. Accordingly, when the piston 151 descends according to opening of the door, the throughholes 153*c* and 153*d* are opened according to movement of incorporated check balls 153*e* and 153*f* upwards, so that oil in the lower chamber 160 can easily move to the upper chamber 156. Reversely, when the piston 151 ascends according to closing of the door, the throughholes 153*c* and 153*d* are closed according to movement of the check balls 153*e* and 153*f* downwards, so that oil in the upper chamber 156 cannot move to the lower chamber 160.

Also, the central throughhole 154 has a structure whose diameter is reduced stepwise in three steps, that is, a stepwise structure. Female screw threads are formed in the inner circumferential portions 154*a* and 154*b* of the upper and lower ends of the central throughhole 154. The lower portion of the piston rod 150 is screw-combined with the inner circumferential portion 154*a* in the upper end of the central throughhole 154. A second oil path 181 for the lower portion of the piston is formed in the inner circumferential portion 154*a* in the lower end of the central throughhole 154. Also, the upper end of a control pipe 180 which moves in association with movement of the piston 151 up and down is screw-combined with the inner circumferential portion 154*a* in the lower end of the central throughhole 154.

A first oil path 150*a* is formed in the upper side of the connection portion with the piston 151 in the lower portion of the piston rod 150, in which the first oil path 150*a* is directed to the center of the piston rod from the outer circumferential portion thereof and then bent and penetrated downwards from the central portion. Also, a downward bent portion 150*b* forming the first oil path 150*a* has a relatively narrow inner diameter, in which a groove 150*c* whose diameter is enlarged into an inner diameter which is same as that of the intermediate inner circumferential portion 154*c* of the central throughhole 154 is formed in the lower portion of the first oil path 150*a*.

In the enlarged groove 150*c* of the piston rod and the intermediate inner circumferential portion 154*c* of the central throughhole 154 are installed an overspeed prevention valve (OSV) 152 comprised of an overspeed prevention valve actuator 152*a* having a step structure, a spring 152*b* for elastically supporting the overspeed prevention valve actuator 152*a* upwards, and an overspeed prevention bushing 152*e* which is inserted into the intermediate inner circumferential portion 154*c* of the central throughhole, the overspeed prevention bushing 152*e* forming a valve together with the overspeed prevention valve actuator 152*a*. Here, in the overspeed prevention valve actuator 152*a*, the outer diameter of lower end whose central portion is protruded is smaller than the inner diameter of the control pipe 180, the outer diameter of the upper end thereof is larger than the inner diameter of the bent portion 150*b* and smaller than the inner diameter of the groove 150*c*.

At the center portion of the upper side of the overspeed prevention valve actuator 152*a* is formed a groove 152*c* having the inner diameter same as that of the bent portion 150*b*. In the groove is formed at least one throughhole 152*d* forming an oil path communicating with the outer circumferential portion of the valve actuator 152*a*.

Figure 8A:
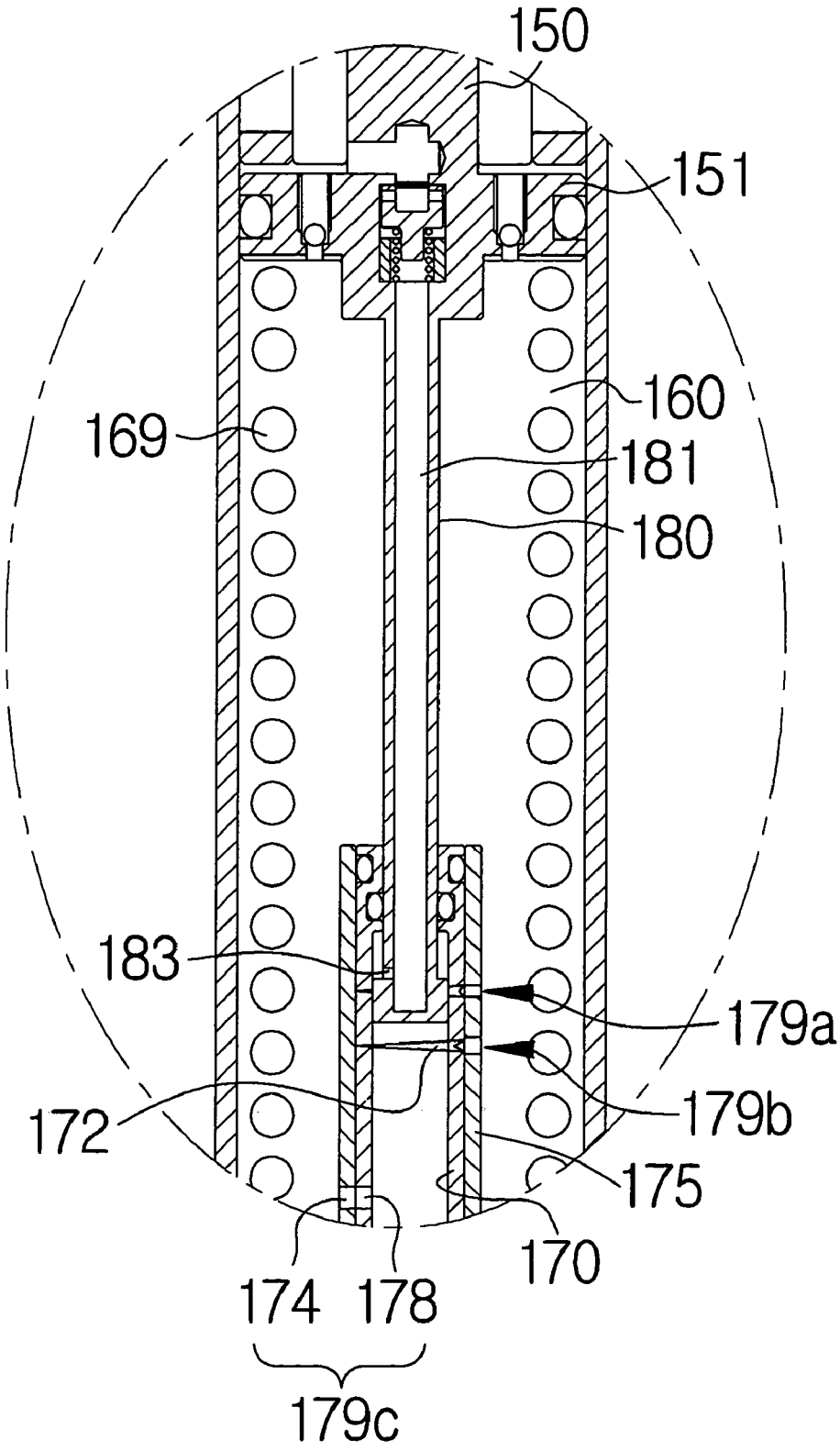
FIG. 8A is a cross-sectional view showing a piston and a return speed adjustment unit showing an initial position at which a piston is positioned at the upper dead point.
Figure 8B:
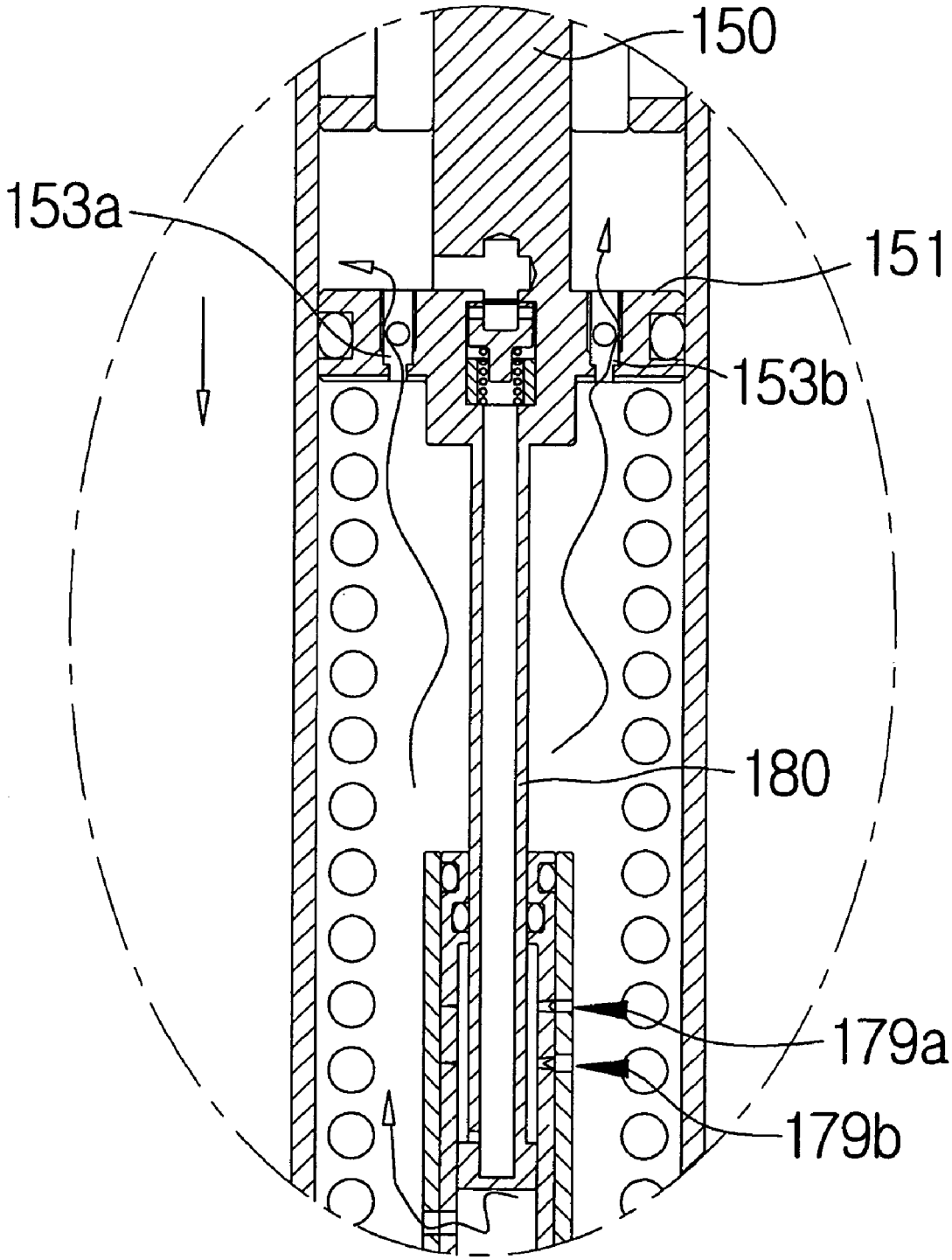
FIG. 8B shows that oil flows when a piston descends according to opening of a door.
Figure 8C:
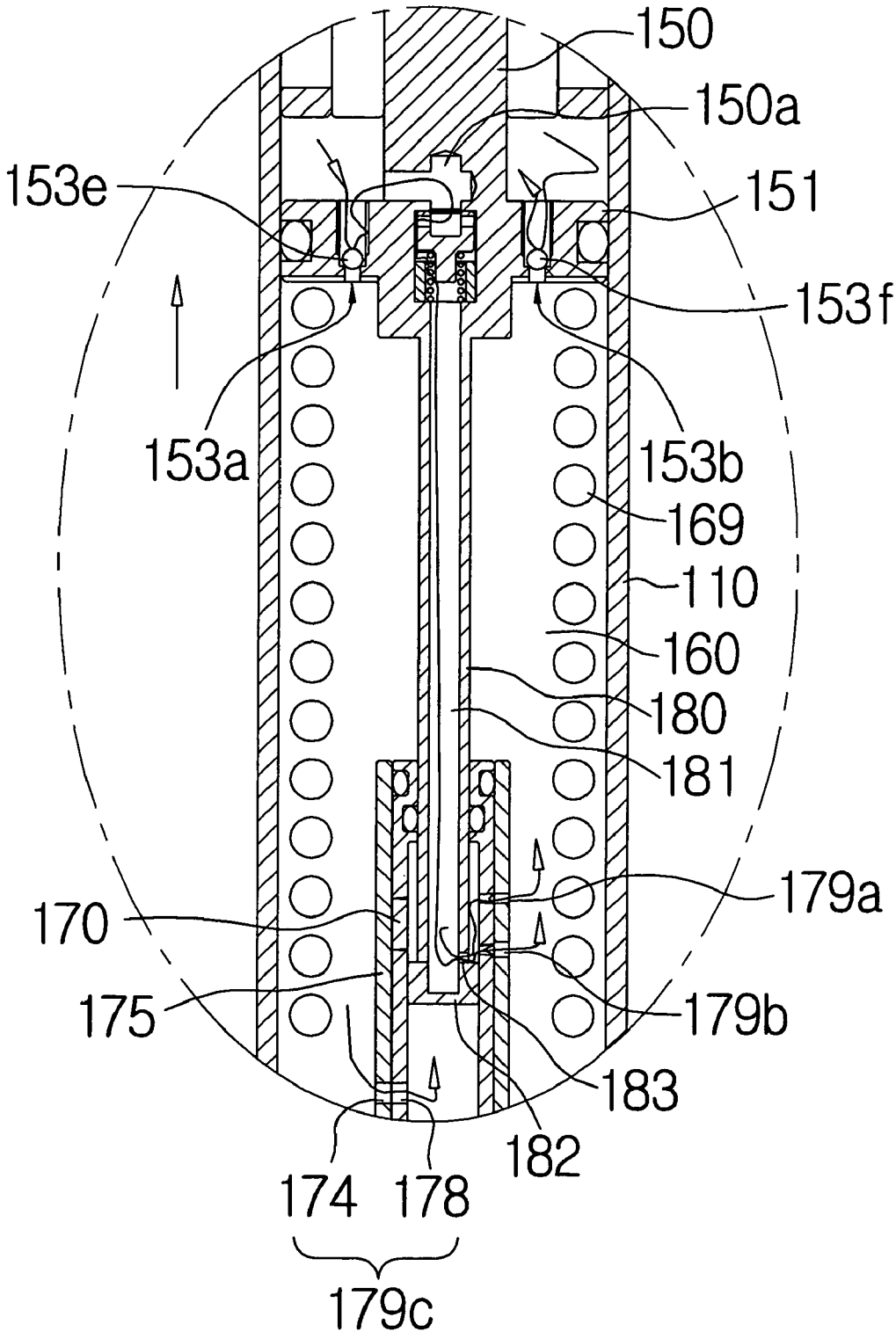
FIG. 8C shows that oil flows when a piston ascends at first speed until a door opening angle reaches 30° according to closing of a door.
Figure 8D:
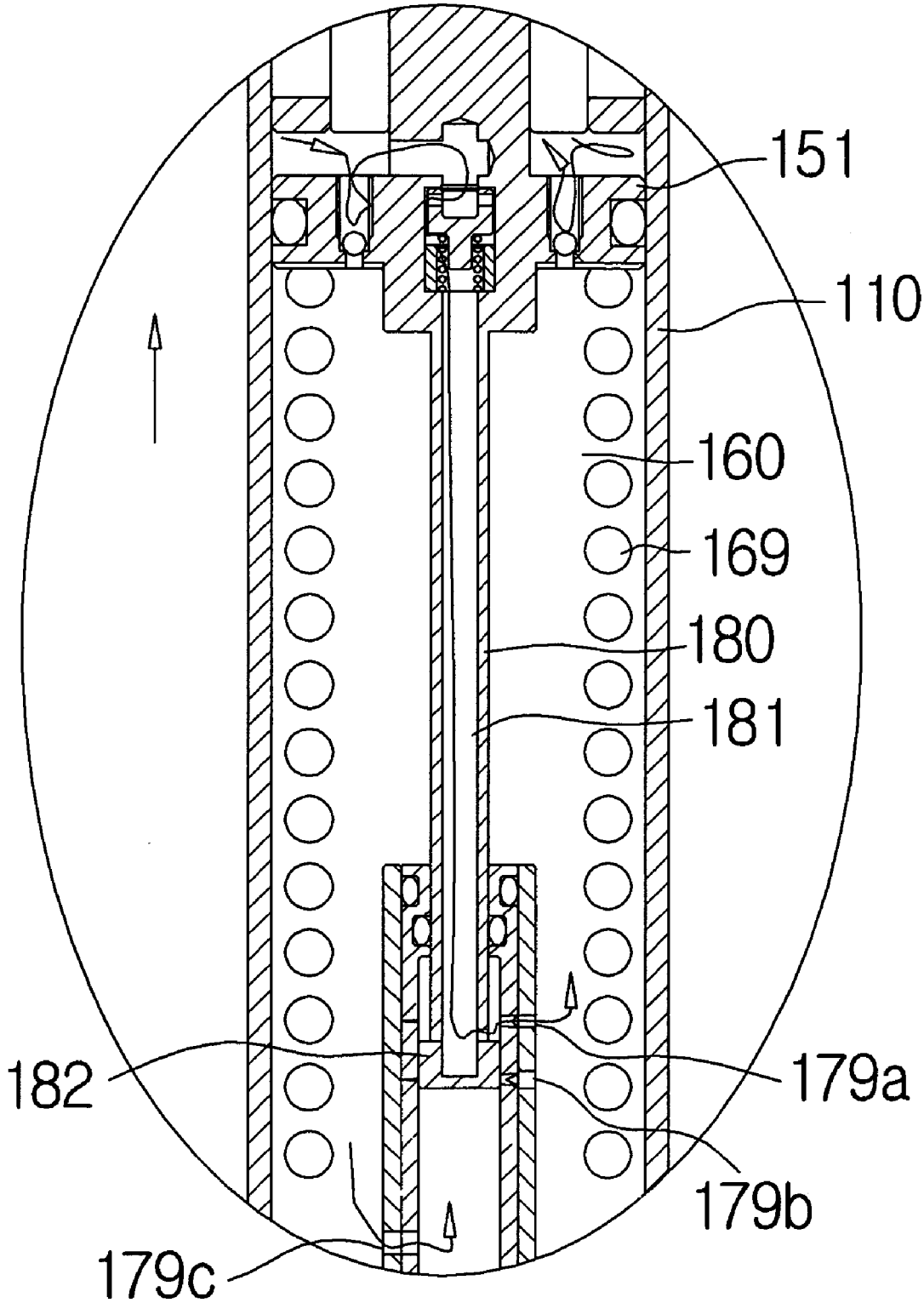
FIG. 8D shows that oil flows when a piston ascends at second speed until a door opening angle reaches 0° according to closing of a door.

Since the overspeed prevention valve actuator 152*a* is pushed upwards and raised by a return force of the spring 152*b* during a return of a normal door, as shown in FIGS. 8C and 8D, the overspeed prevention valve 152 opens the upper end of the control pipe 180 forming a second oil path 181 so that oil can move from the upper chamber 156 to the lower chamber 160 through the first and second oil paths 150*a* and 181.

Figure 8E:
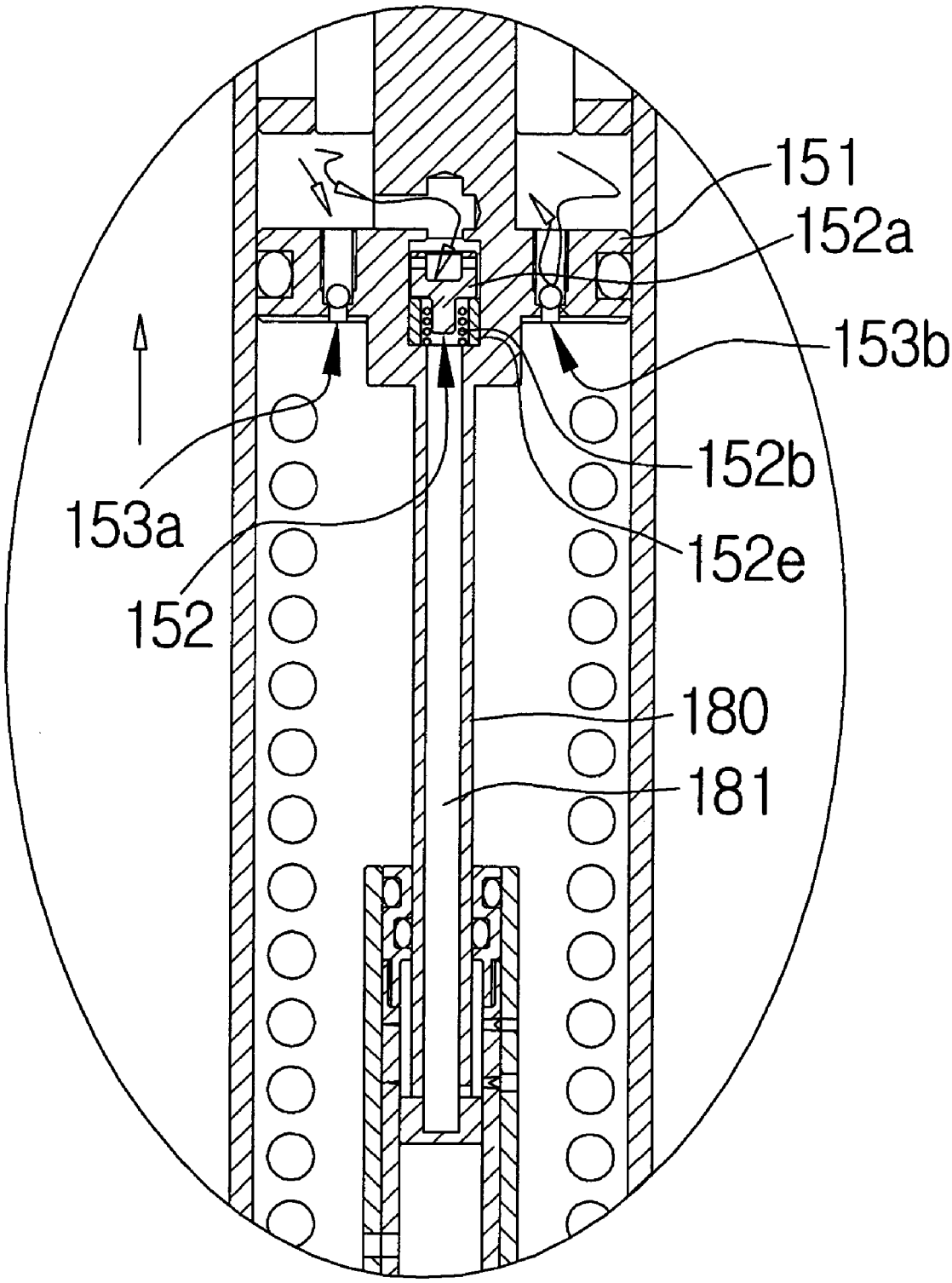
FIG. 8E shows that oil flows when the door is rotated at excessive speed by a strong wind, and then the piston ascends abruptly.

However, when a strong force such as a strong wind is applied to a door, as shown in FIG. 8E, an overspeed return prevention function is provided in order to prevent the door from being returned at excessive high speed, to thereby prevent a safety accident. That is, if a door is rotated at excessive high speed by a strong wind, the piston 151 abruptly ascends to thus make the first and second check valves 153*a* and 153*b* closed and simultaneously the overspeed prevention valve actuator 152*a* overcome an elastic force of the spring 152*b* and descend. As a result, the lower surface of the overspeed prevention valve actuator 152*a* closes the throughhole of the overspeed prevention bushing 152*e* to thereby cut off the connection between the first and second oil paths 150*a* and 181. Thus, in the case that a door is returned at excessive high speed by a strong wind, the ascending of the piston 151 is suppressed to thus prevent the door from being returned at excessive high speed. As a result, a safety accident can be prevented from occurring.

Also, an O-ring 155 is buried in a groove on the outer circumferential portion of the cylindrical piston 151 so that oil is prevented from moving through the outer circumferential portion thereof when the piston 151 moves along the inner wall of the housing 110.

Meanwhile, a cup-shaped head 182 is combined with the lower end of the control pipe 180 forming the second oil path 181, to thereby seal the lower end of the control pipe 180 and open or close a second speed adjustment oil path of the first and second speed adjustment oil paths formed in an inner tube 170 and an outer tube 175 both which will be described later. Accordingly, an ascending speed of the piston 151 is controlled. On the immediate upper side of the control pipe 180 with which the head 182 is combined is formed a throughhole 183 communicating with the second oil path 181 of the control pipe 180.

For this purpose, the head 182 located in the lower portion of the control pipe 180 is inserted into a pair of an inner tube 170 and an outer tube 175, by changing an amount of oil flowing from the second oil path 181 which is located below the piston to the lower chamber 160, according to an ascending position of the piston 151 during an automatic return of a door, that is, an opening angle of the door, to thereby control an ascending speed of the piston 151 (that is, a return speed of the door).

The lower portion of the outer tube 175 is fixedly screw-combined with the inner circumferential portion of a lower sealing packing 191 for sealing the lower chamber 160, and a sealing O-ring 194 is buried in a groove of the outer circumferential portion of the lower sealing packing. The inner tube 170 rotatably closely contacts the inner portion of the outer tube 175. The lower portion of the inner tube is fixedly screw-combined with the inner circumferential portion of the cylindrical groove on the upper side of a speed adjustment nut 192.

Also, a return spring 169 providing an elastic force upwards with respect to the piston 151 is incorporated in the space between the piston 151 and the lower sealing packing 191, that is, in the lower chamber 160, which provides a source of a force ascending the piston 151 during an automatic return of a door.

Meanwhile, a sealing packing 161 which is combined between the inner circumferential portion of the outer tube and the outer circumferential portion of the control pipe 180, to separate the upper ends of the outer tube 175 and the inner tube 170 from the lower chamber 160, is combined with the upper portion of the outer tube 175. For this purpose, sealing O-rings 162 and 163 are buried in respective grooves of the outer and inner circumferential portions of the sealing packing 161 and the lower portion of the sealing packing 161 is screw-combined with the upper portion of the inner tube 170.

Also, an O-ring 195 for sealing the inner circumferential portion of the lower sealing packing 191 is buried into a groove on the outer circumferential portion of the speed adjustment nut 192. The lower side of the speed adjustment nut 192 has a step structure whose central portion is protruded in a cylindrical fashion. A lower packing 190 suppressing the speed adjustment nut 192 and the lower sealing packing 191 from seceding is combined with the step portion of the speed adjustment nut 192 and the lower side of the lower sealing packing 191, in which the cylindrical protrusion of the speed adjustment nut 192 is combined with the inner circumferential portion of the lower packing 190 and the lower end of the housing 110 is screw-combined with the outer circumferential portion thereof.

Meanwhile, in the cylindrical protrusion of the speed adjustment nut 192 is formed a throughhole for exiting air in oil at the state where all elements have been assembled in the housing 110 and then oil is filled therein. A bolt 197 for exiting air is screw-combined with the throughhole via a sealing O-ring 198.

Also, a speed adjustment handle 193 for turning the speed adjustment nut 192 from the lower portion of the housing 110 in order to adjust a return speed of a door according to the need of a user is screw-fixed in the cylindrical protrusion of the speed adjustment nut 192.

Hereinbelow, a mechanism of controlling a return speed of a door adopted in the present invention will be described.

Figure 6A:
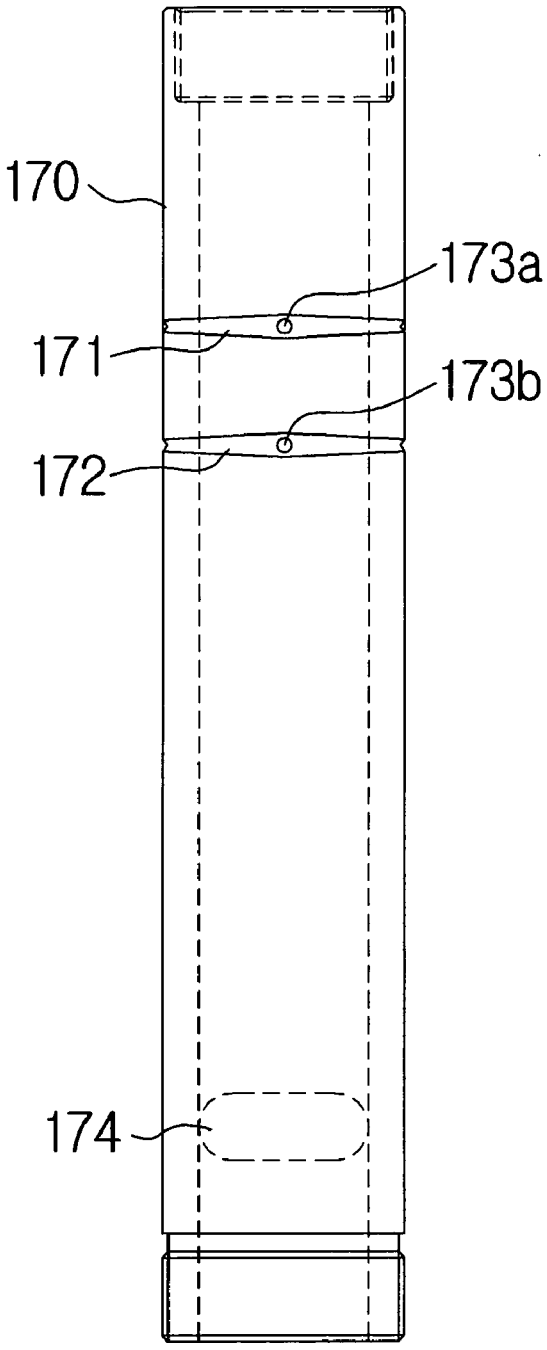
FIGS. 6A and 6B are a front view and a side view showing a return speed adjustment inner tube of a door, respectively.
Figure 6B:
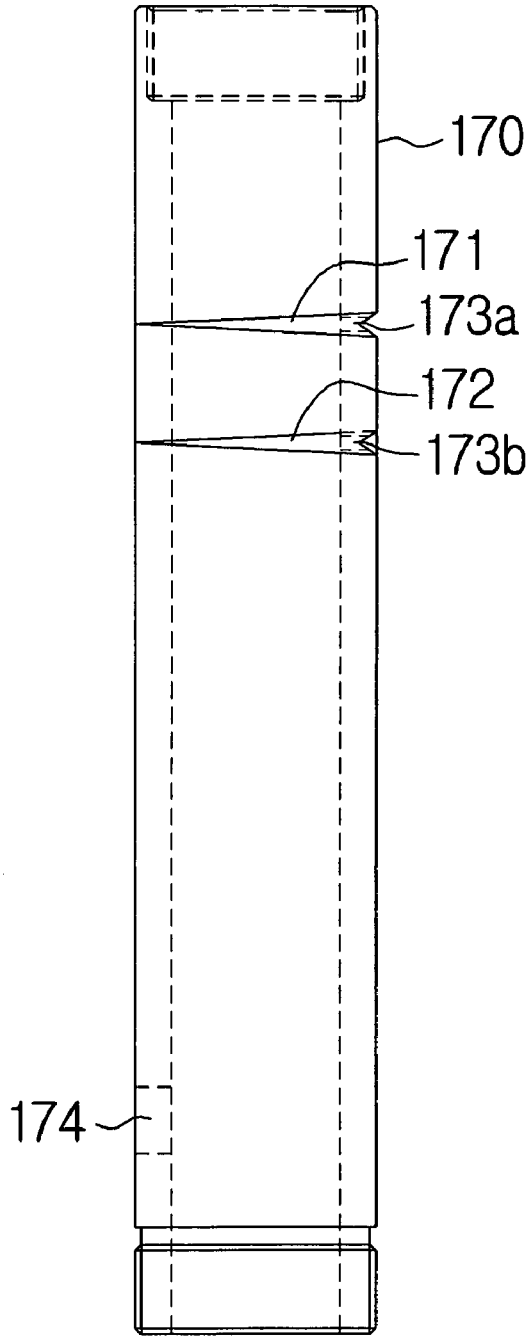

As shown in FIGS. 6A and 6B, a pair of first and second eccentric grooves 171 and 172 whose depths become deeper from both ends of the groove to the central portion thereof and throughholes 173*a* and 173*b* respectively communicating with the inner portion of the inner tube 170 and located in the central portions of the eccentric grooves, are formed in the outer circumferential portion of the inner tube 170. Also, a single elongate hole 174 is formed in the lower portion of the inner tube 170.

Figure 7:
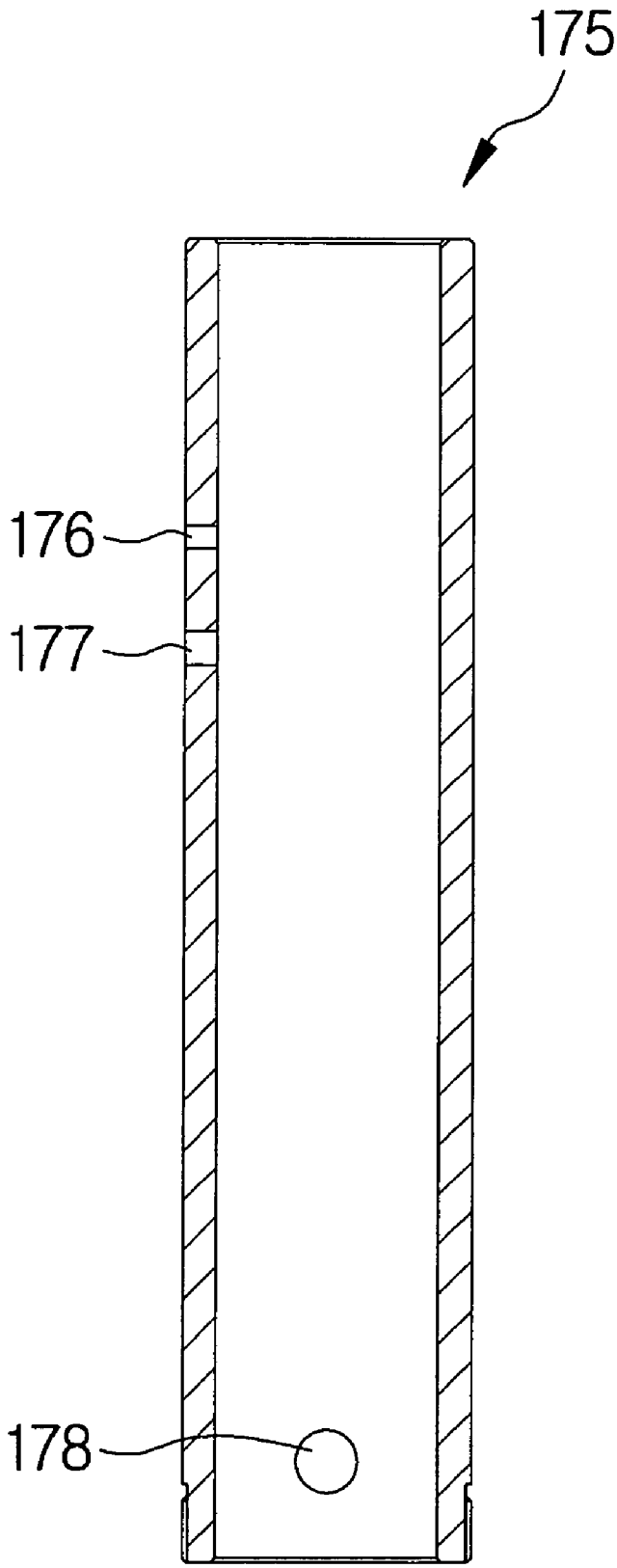
FIG. 7 is a lengthwise cross-sectional view showing a return speed adjustment outer tube of a door.

Also, as shown in FIG. 7, throughholes 176 and 177 are formed in the outer tube 175, at the same levels as those of the first and second eccentric grooves 171 and 172. In the lower side of the outer tube 175 is formed a throughhole 178 at the same level as that of the elongate hole 174 of the inner tube 170.

Thus, according to whether the throughholes 176 and 177 of the outer tube 175 are respectively disposed in opposition which portion of the first and second eccentric grooves 171 and 172 of the inner tube 170, a difference occurs in the cross-sectional areas of the eccentric grooves through which oil can pass. Therefore, since the speed adjustment nut 192 and the inner tube 170 rotate together when a user rotates the speed adjustment handle 193, the cross-sectional areas of the eccentric grooves 171 and 172 of the inner tube 170 opposing the throughholes 176 and 177 of the outer tube 175 are changed to thereby change an amount of oil flowing from the second oil path 181 to the lower chamber 160. As a result, under the same condition, the speed adjustment handle 193 is made to rotate to the left or right, and thus an amount of an oil flow is changed, to thereby adjust an ascending speed of the piston 151, that is, a return speed of a door.

In the following, for convenience of explanation, an oil path passing through the throughhole 173*a* of the inner tube 170, the first eccentric groove 171 and the throughhole 176 of the outer tube 175, is called as a first speed adjustment oil path 179*a*. An oil path passing through the throughhole 173*b* of the inner tube 170, the second eccentric groove 172 and the throughhole 177 of the outer tube 175, is called as a second speed adjustment oil path 179*b*. Also, an oil path passing through the elongate hole 174 of the inner tube 170 and the throughhole 178 of the outer tube 175 is called as a third oil path 179*c*.

Hereinbelow, an ascending and descending guiding mechanism of a piston according to the present invention will be described in detail with reference to FIGS. 4A and 4B.

Figure 4B:
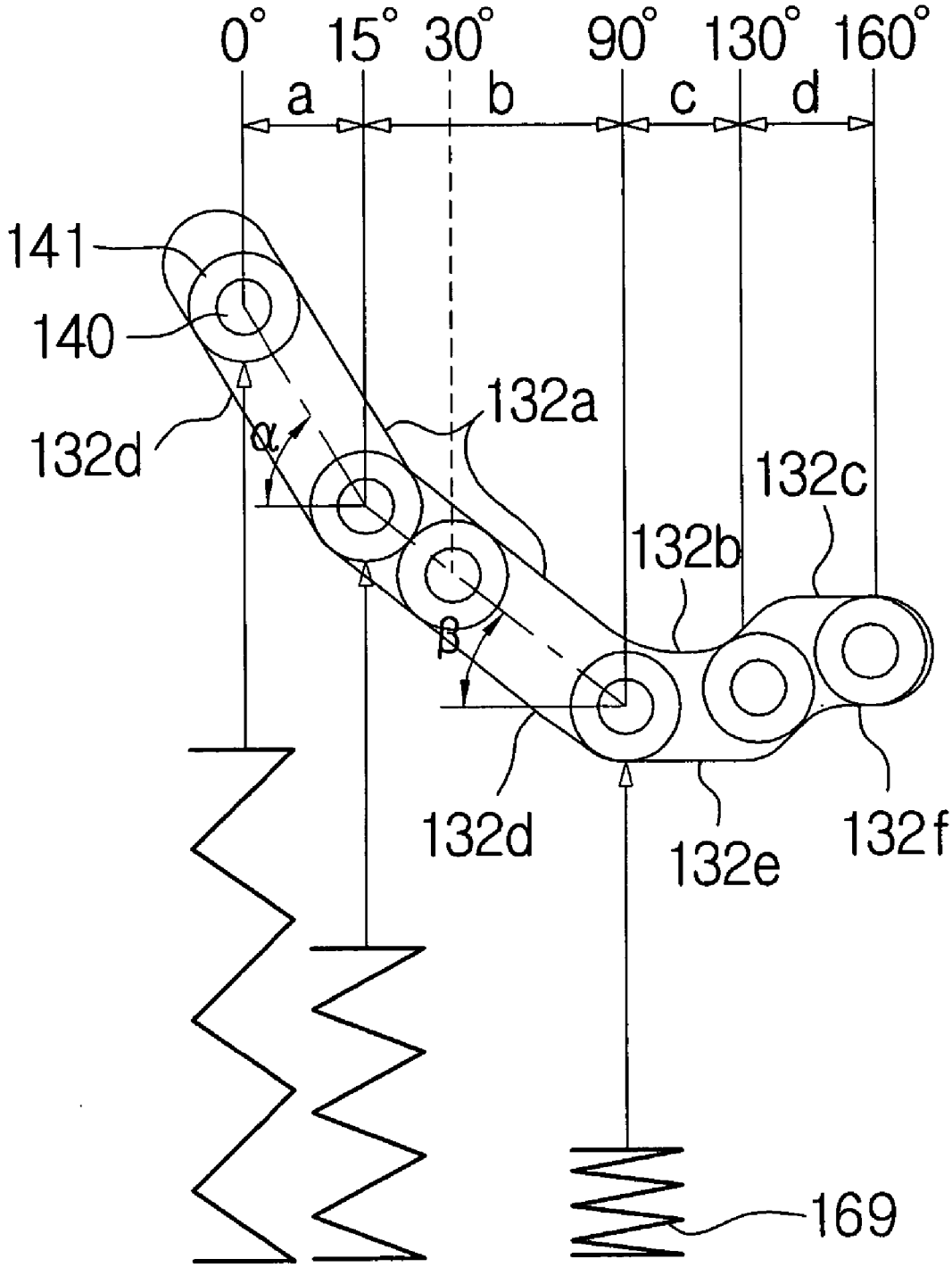
FIG. 4B shows position of a guide pin and a compressed state of a return spring according to operation of the multipurpose hinge apparatus in an ascending and descending guide hole of the cam shaft shown in FIG. 4A.

FIG. 4A is a perspective view showing a cam shaft for guiding a piston rod to move up and down according to opening and closing of a door in the multipurpose hinge apparatus shown in FIG. 2, and FIG. 4B shows position of a guide pin and a compressed state of a return spring according to operation of the multipurpose hinge apparatus in an ascending and descending guide hole of the cam shaft shown in FIG. 4A.

As shown in FIG. 4B, the ascending and descending guide holes 132 and 133 of the cam shaft 130 are divided into four sections "a" through "d" according to a door opening angle, that is, a first section "a" when the door opening angle ranges from 0° to 15°, a second section "b" when the door opening angle ranges from 15° to 90°, a third section "c" when the door opening angle ranges from 90° to 130°, and a fourth section "d" when the door opening angle ranges from 130° to 160°.

The first section "a" is a low-speed return section during an automatic return of a door. In the first section "a," oil flows at the state of a hydraulic circuit of FIG. 8D to be described later (that is, only one oil path of two oil paths formed in the inner and outer tubes 170 and 175 is opened), so that the door is closed at low speed. In this case, a closing force loss is due to a resistance of a hydraulic circuit and lowering of a proportional return force at low speed. Such a closing force loss is supplemented by setting the cam diagram angle α of the ascending and descending guide holes 132 and 133 to be a range between 45° and 65° relatively greater than an angle β of the second section "b" and increasing a piston ascending efficiency. As a result, although a torsion spring is not used as a return spring but a compression spring is used, during an automatic return of a door, a complete return (lock) can be accomplished into an initial position of the door.

The second section "b" is a high-speed return section during an automatic return of a door. In the second section "b," oil flows at the state of a hydraulic circuit of FIG. 8C to be described later (that is, both of two oil paths formed in the inner and outer tubes 170 and 175 are opened), so that the door is closed at high speed. Meanwhile, a return force of the return spring 169 is increased in proportion with an opening angle of a door, and thus a force needed when a user opens the door is also increased in proportion with an opening angle thereof. Thus, in the second section "b", an opening force increment which is increased in proportion with opening of the door is supplemented by setting the cam diagram angle β of the ascending and descending guide holes 132 and 133 to be a range between 10° and 45° relatively smaller than an angle α of the first section "a" and increasing a rotating efficiency of the cam shaft 130 proportionally when the door is opened.

Also, the third section "c" is a section where the cam diagram angle is set to be zero (0) to thus interrupt an automatic return by a return spring 169. In the third section "c," an angle at the state where the door is opened is maintained and a return force of the return spring 169 becomes the largest. The fourth section "d" is formed in a slanted fashion upwards from the third section "c" and is a stopping force reinforcing section, so that the guide pin 140 is locked not to move and but to stop. In this case, it is possible to extensively form the fourth section "d" so that a door opening angle exists between 130° and 180°.

Meanwhile, the ascending and descending guide holes 132 and 133 can be formed with a slope that the cam diagram angle ranges between 30° and 45° in the first section "a." In the case that a slope in the first section "a" is formed between 30° and 45°, an ascending and descending distance of the piston 151 connected to the guide pin 140 is short. Accordingly, an efficiency of the compressed return spring 169 becomes low in comparison with an external force rotating the cam shaft 130. Therefore, in the case that a slope in the first section "a" ranges between 30° and 45°, a door which is opened and closed up and down absorbs an impact when the door is closed by an external force such as inertia so that the door can be slowly closed.

Also, in the case that a slope in the first section "a" ranges between 45° and 65°, an ascending and descending distance of the piston 151 is long. Accordingly, a repulsive force of the compressed return spring 169 becomes larger than the external force rotating the cam shaft 130. Thus, in the case that a slope in the first section "a" ranges between 45° and 65°, an efficiency of the return spring 169 is increased, and thus a door which is opened and closed to the left and right can be swiftly closed to a complete return position more easily.

Also, it is preferable that the ascending and descending guide holes 132 and 133 are formed with a certain width to closely contact a first roller bearing 141 combined with the guide pin 140.

In the case that cam diagram angles are established in the ascending and descending guide holes 132 and 133 as described above, the guide pin 140 descends along the ascending and descending guide 132*a* in the ascending and descending guide holes 132 and 133 which is slanted up and down in the first and second sections "a" and "b," and does not move up and down but temporarily stops in the third section "c." Also, in the case that the cam shaft 130 consistently rotates, the guide pin 140 proceeds to the fourth section "d" which is a little slanted upwards from the third section "c" and thus is caught in a first stopper 132*b* and does not move but stops.

Also, the ascending and descending guide holes 132 and 133 are formed in a manner that a second stopper 132*c* and a third cam diagram supporter 132*f* are formed of a slope ranging from 15° to 60° in the fourth section "d." In the case that a slope of the section "d" is less than 15°, the cam shaft 130 can easily rotate by a repulsive force of the elastic member 169 such as a return spring, or a finite external force. In this case, since a force stopping the guide pin 140 is weak, the slope of the angle less than 15° is inappropriate in the fourth section "d." Also, in the case that a slope of the section "d" is more than 60°, a force stopping the guide pin 140 becomes large by catching of the first stopper 132*b*. However, when the guide pin 140 proceeds from the fourth section "d" to the third section "c," that is, in the case of ascending of the guide pin 140, a large amount of an external force is needed. As a result, the slope of the angle more than 60° is inappropriate in the fourth section "d."

Meanwhile, in the case that the guide pin 140 ascends by a repulsive force of the compressed return spring 169, the oil pressure in the upper portion of the piston 151 functions more greatly than the elastic force of the return spring 169, near a limit where the piston 151 can ascend. Accordingly, the piston 151 can descend reversely abruptly. Thus, it is necessary to make a first cam diagram supporter 132*d* closely contact the first roller bearing 141 combined with the guide pin 140 and prevent the guide pin 140 from seceding from an ascending and descending diagram path.

Also, at the initial time when the guide pin 140 proceeds from the third section "c" to the second section "b," internal noise and damage of the internal elements can occur due to the initial irregular movement of the guide pin 140. To prevent this, it is preferable that a boundary portion between the first cam diagram supporter 132*d* and a second cam diagram supporter 132*e* is formed of a curve in the ascending and descending guide holes 132 and 133.

Hereinbelow, the entire operation of the multipurpose hinge apparatus according to the present invention will be described with reference to FIGS. 8A through 8E, together with FIG. 2.

FIG. 8A is a cross-sectional view showing a piston and a return speed adjustment unit showing an initial position at which a piston is positioned at the upper dead point. FIG. 8B shows that oil flows when a piston descends according to opening of a door. FIG. 8C shows that oil flows when a piston ascends at first speed until a door opening angle reaches 30° according to closing of a door. FIG. 8D shows that oil flows when a piston ascends at second speed until a door opening angle reaches 0° according to closing of a door. FIG. 8E is a cross-sectional view showing a flow of oil when the door is rotated at excessive speed by a strong wind and the piston ascends abruptly.

First, as described above, a hinge apparatus 10 according to the present invention can be used on multipurpose, which will be described later. In this embodiment, a housing 110 is installed in a door or frame, or is fixed to any one of a refrigerator or furniture to which a hinge apparatus is installed. Here, a mechanism that a rotational force is applied to a shaft 130*b* of a cam shaft 130 according to rotation of a door will be described as an example.

A multipurpose hinge apparatus according to the present invention forms a hydraulic circuit as shown in FIGS. 8A and 8B, when a door is opened.

That is, when the door is opened, an external rotational force is transferred to the shaft 130*b* of the cam shaft 130 in the multipurpose hinge apparatus 10 according to the present invention. In this case, the internal elements operate as follows.

When a user opens a door at the initial state of FIG. 8A where the door is closed, a right-hand direction rotational force is transferred to the cam shaft 130. Accordingly, the guide pin 140 whose both ends are inserted into the ascending and descending guide holes 132 and 133 and a pair of vertical guide holes 113*a* and 113*b* in a cylindrical guide tube 113 moves downwards along the ascending and descending guide holes 132 and 133 according to rotation of the cam shaft 130.

In this case, as shown in FIG. 8B, a force for making the piston 151 move downwards is applied to the piston 151 which communicates with each other through the guide pin 140 and the piston rod 150. Here, since the first and second check valves 153*a* and 153*b* are opened, oil contained in the lower chamber 160 located below the piston 151 easily moves to the upper portion of the piston, that is, the upper chamber 156, through the check valves. According to descending of the piston 151, oil contained in the inner tube 170 starts exiting toward the lower chamber 160 via a third oil path 179*c* provided below the inner tube 170 and the outer tube 175.

Here, the guide pin 140 moves in the first and second sections "a" and "b" like the operational state in the ascending and descending guide holes 132 and 133 shown in FIG. 4B. That is, the guide pin 140 moves down, so that the piston rod 150 and the piston 151 compress the return spring 169.

Meanwhile, the guide pin 140 reaches the third section "c" when the cam shaft 130 consistently rotates, and the first stopper 132*b* in the third section "c" in the ascending and descending guide holes 132 and 133 limits movement of the guide pin 140. Thus, the piston 151 is maintained at a stop state.

Meanwhile, when a user opens or closes the door so that a door opening angle is less than 90° in the hinge apparatus according to the present invention, the door performs an automatic return operation. Here, two kinds of hydraulic circuits are established according to a door opening angle as shown in FIGS. 8C and 8D.

First, the piston 151 ascends swiftly at first speed since a hydraulic circuit shown in FIG. 8C is established until a door opening angle reaches 90° through 30°. That is, when the door opening angle is 90°, that is, the door is at a stop state, a user rotates the door to transfer a small amount of a left-hand directional external force to the cam shaft 130. As a result, the guide pin 140 passes through the first stopper 132*b* and secedes from the third section "c."

Thus, the piston 151 starts to move upwards by a repulsive force of the compressed return spring 169, and the guide pin 140 connected to the piston 151 also ascends along the ascending and descending guide 132*a* in the second section "b" in the ascending and descending guide holes 132 and 133, that is, at a slow sloped angle of 10° through 45°. As a result, the cam shaft 130 rotates in the left-hand direction and makes the door restored into the initial position.

Here, since throughholes 153*c* and 153*d* are clogged by check balls 153*e* and 153*f* in the check valves 153*a* and 153*b* as shown in FIG. 8C, oil contained in the upper portion of the piston 151, that is, the upper chamber does not pass through the throughholes 153*c* and 153*d*, but passes through the first oil path 150*a* provided in the piston rod 150, the overspeed prevention valve 152, the second oil path 181 provided in the control pipe 180, and the first and second speed adjustment oil paths 179*a* and 179*b* in sequence, to then move to the lower chamber 160 located below the piston 151.

As described above, when the piston 151 ascends until the door opening angle reaches 90° through 30°, the second speed adjustment oil path 179*b* is not closed by the head 182 of the control pipe 180. Accordingly, since the oil located above the piston 151 flows through the first and second speed adjustment oil paths 179*a* and 179*b* toward the lower chamber 160, the piston 151 thus can ascend swiftly at first speed.

In this case, the oil in the lower chamber 160 starts to proceed into the inner tube 170 via the third oil path 179*c* provided below the inner tube 170 and the outer tube 175 according to ascending of the piston 151.

Thereafter, in the case that the door opening angle reaches 30°, a hydraulic circuit is established as shown in FIG. 8D, and the second speed adjustment oil path 179*b* is closed by the head 182 of the control pipe 180. Accordingly, oil located in the upper portion of the piston 151 flows toward the lower chamber 160 via only the first speed adjustment oil path 179*a*. As a result, an amount of oil flow is reduced into half the normal oil flow, and thus the piston 151 ascends at second speed slower than the first speed.

Also in this case, the guide pin 140 connected to the piston 151 ascends along the ascending and descending guide 132*a* in the second section "b" of the ascending and descending guide holes 132 and 133, that is, at a slow slope angle.

Since the ascending of the piston 151 at the slow second speed is maintained until the door opening angle reaches 15°, user's safety accident or inconveniences due to an abrupt return of the door can be prevented.

Thereafter, in the case that the door opening angle reaches 15° as shown in FIG. 4B, the guide pin 140 connected to the piston 151 starts to ascend along the ascending and descending guide 132*a* in the first section "a" of the ascending and descending guide holes 132 and 133, that is, at an abrupt slope angle between 45° and 65°.

Thus, when the door opening angle ranges from 15° to 0°, the same hydraulic circuit as that when the door opening angle ranges from 30° to 15° is formed, but a slop angle of the ascending and descending guide 132*a* is formed relatively greater than the slope angle of the second section "b." As a result, the return force of the return spring 169 is reduced but a frictional resistance of the ascending and descending guide 132*a* is reduced. The ascending speed of the piston 151 is accelerated at third speed. Thus, the door is returned to the initial position and locked by a latch of the door.

As described above, the present invention properly establish the cam diagram angle with respect to the ascending and descending guide 132*a* of the ascending and descending guide holes 132 and 133. Accordingly, although a compression spring is used as a return spring, a problem that the door is not completely closed due to reduction of the return force of the spring in the case that the door reaches the initial position during an automatic return of the door, can be solved.

As described above, in the hinge apparatus according to the present invention, the automatic return speed and return force of the door can be controlled by the return force of the return spring, the oil path control of the hydraulic circuits, and change in a frictional resistance due to change in the cam diagram angle of the ascending and descending guide holes, during the automatic return of the door.

Also, in the case that the door is rotated at excessive speed by a strong wind, the piston 151 ascends abruptly, and thus the first and second check valves 153*a* and 153*b* are closed as shown in FIG. 8E. Simultaneously, the overspeed prevention valve actuator 152*a* overcomes the elastic force of the spring 152*b* and descends, to thus close a throughhole of the overspeed prevention bushing 152*e*. Thus, when the door is abruptly returned by a strong wind, the overspeed prevention valve 152 suppresses ascending of the piston 151, to thereby play a role of suppressing the return of the door at excessive speed.

Meanwhile, the multipurpose hinge apparatus according to the present invention can be applied in the following various kinds of utilities.

First, a case that it is inappropriate to install a rotational center of a door and that of a hinge apparatus concentrically such as a refrigerator or a large-scale door will be described with reference to FIGS. 9 and 10A through 10D. FIG. 9 is an exploded perspective view showing an installation structure when the multipurpose hinge apparatus according to the first embodiment of the present invention is applied to the lower portion of a refrigerator. FIGS. 10A through 10D are configurational views for explaining the operations of the hinge apparatus according to a door opening angle in FIG. 9.

Figure 9:
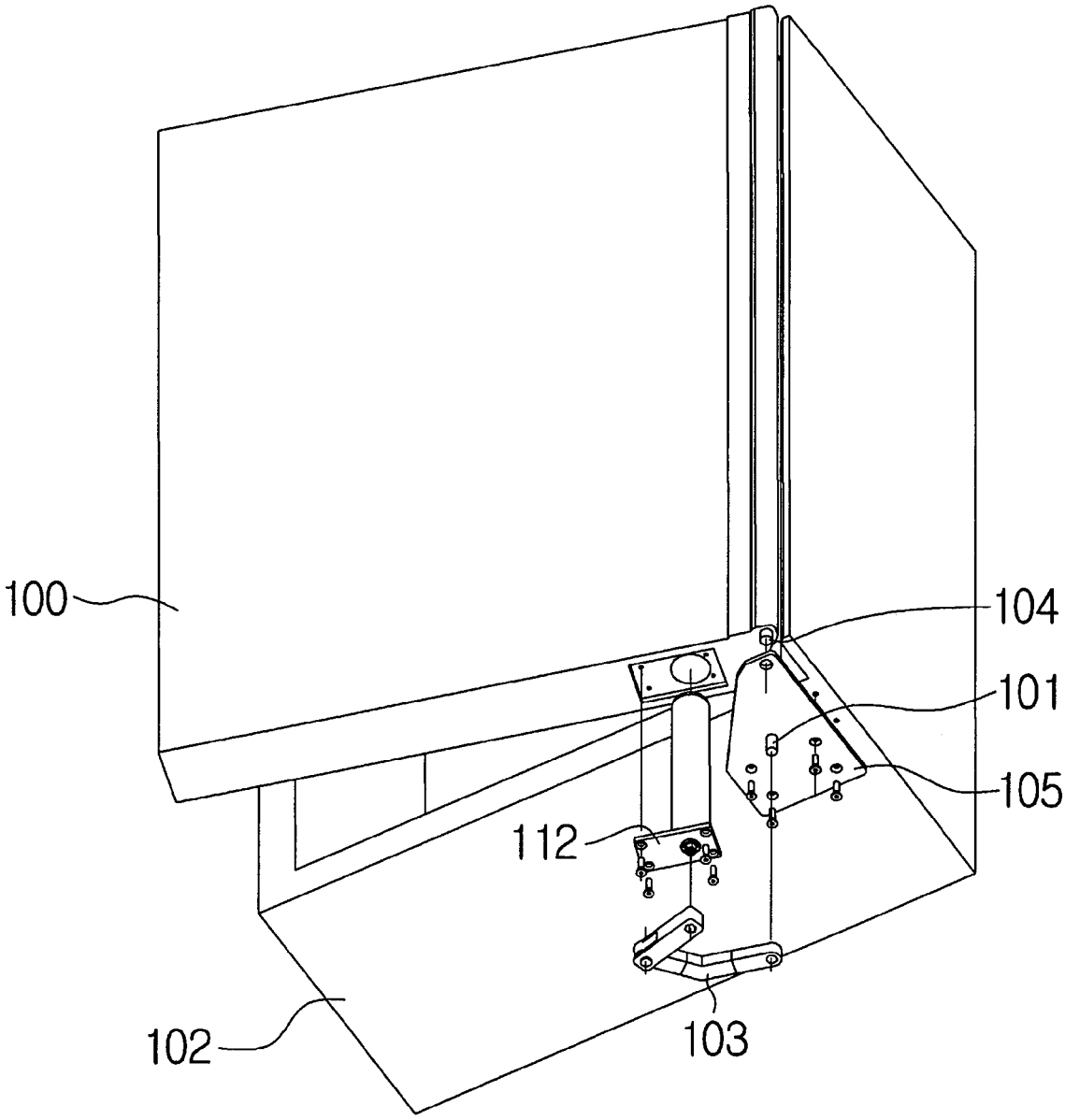
FIG. 9 is an exploded perspective view showing an installation structure when the multipurpose hinge apparatus according to the first embodiment of the present invention is applied to the lower portion of a refrigerator.

As shown in FIGS. 1 and 2, a rectangular flange 112 is fixed on the upper portion of the housing 110 by using a number of bolts 111 in an upper packing 120, and the flange 112 is buried and fixed into a groove located below the door 100 by a number of fixing bolts 111*a* as shown in FIG. 9. In this case, an aesthetic viewpoint is not considered, or a large-scale door can be installed in the upper end of the door.

In this case, a contacting portion of the flange 112 and the housing 110 can be welded in order to heighten a coupling strength. It is preferable to form the end of the shaft 130*b* protruded from a cam shaft 130 in a hexagonal form. As a result, the shaft 130*b* is easily combined with the other elements and a strong force can be transferred via the shaft 130*b*.

The hinge apparatus according to the present invention uses a two-joint link 103 and a support bracket 105 and can be installed in a left/right rotational door such as a common refrigerator. The other end of the two-joint link 103 whose one end is rotatably connected with a hinge axis 101 installed in the lower end of a refrigerator main body 102 is fixedly combined with the cam shaft 130. The rotational axis 104 of the door 100 is rotatably supported to the leading end extended from the support bracket 105 whose one end is fixed in the upper end of the main body 102. The two-joint link 103 includes a following link 103*a* and a driving link 103*b*.

Also, it is preferable to install a radial bearing 114 in the periphery of the shaft in the upper portion of the upper packing 120, in order to prevent a partial wear since the rotational force is applied to the shaft 130*b* via the two-joint link 103.

In this case, when a user opens the door 100, the first and second check valves 153*a* and 153*b* are opened as shown in FIG. 8B. Thus, the door is opened without a toil while rotating around the rotational axis 104 located in the support bracket 105. When the door is closed, an amount of oil flow is changed according to opening and closing of the second speed adjustment oil path 179*b* as shown in FIGS. 8C and 8D, to thereby adjust a return speed.

Figure 10A:
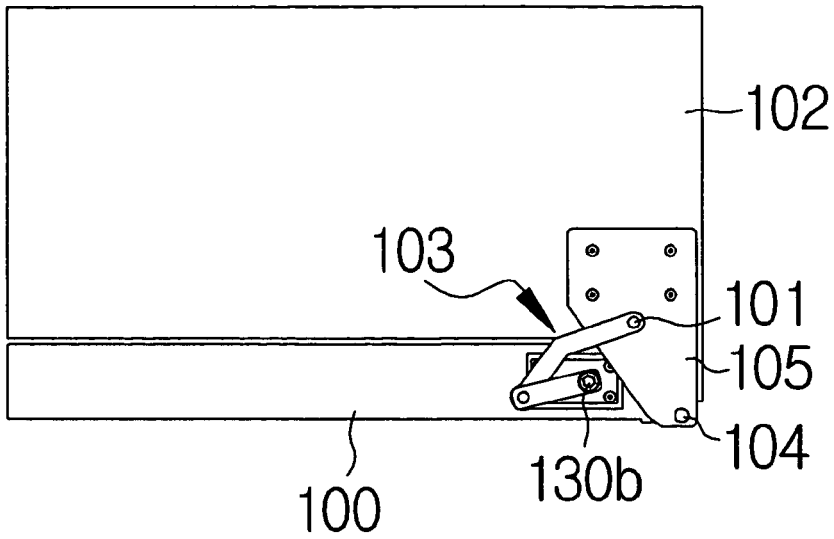
FIGS. 10A through 10D are configurational views for explaining the operations of the hinge apparatus according to a door opening angle in FIG. 9.
Figure 10B:
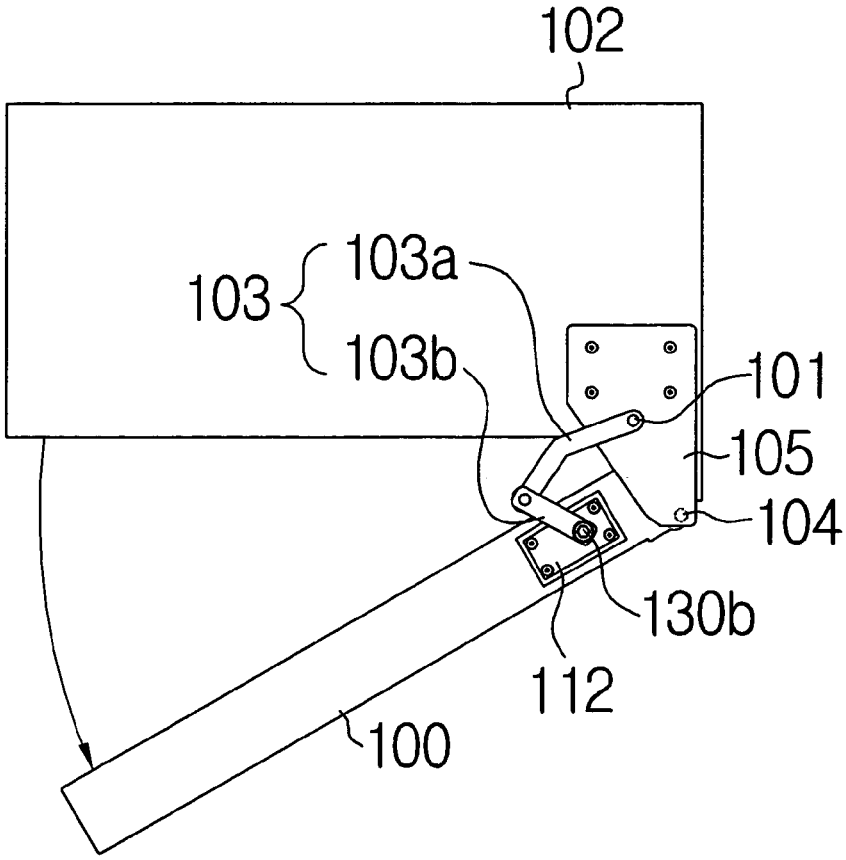
Figure 10C:
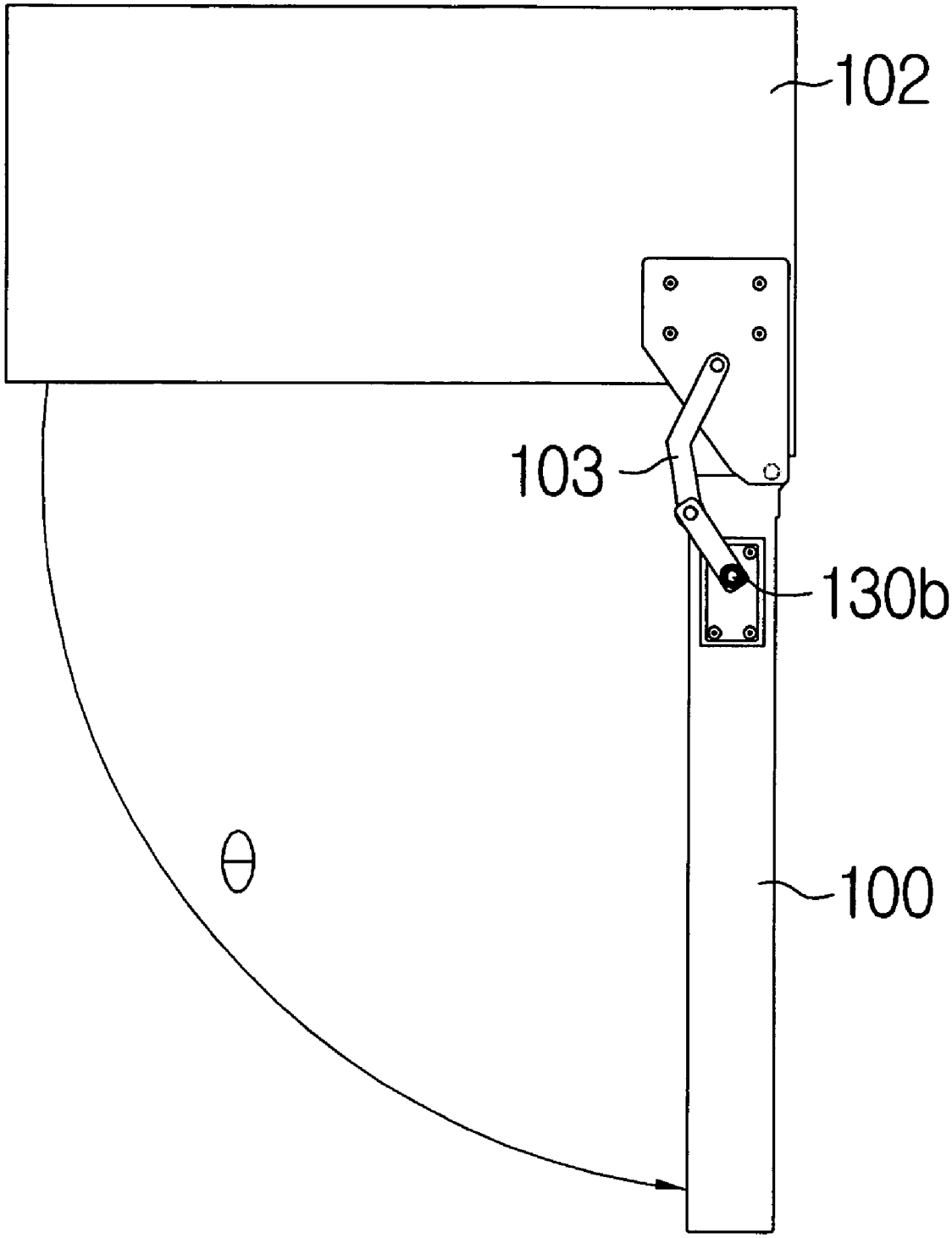
Figure 10D:
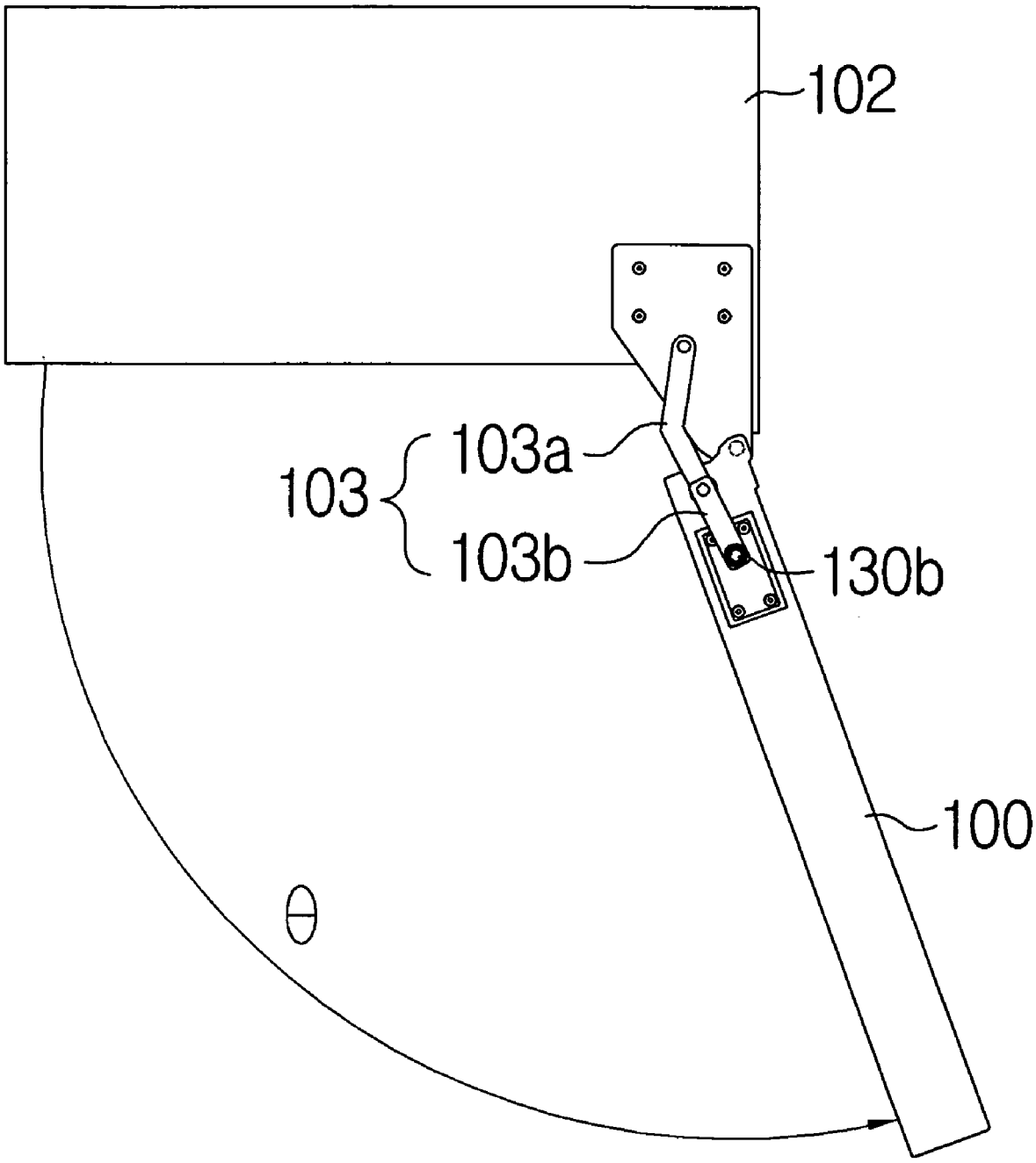

However, the door opening angle θ differs from the door opening angle which is referred to in the hinge apparatus embodiment shown in FIG. 4B, that is, the rotational angle of the shaft 130*b*. For example, in the case that the door opening angle θ is about 90° as shown in FIG. 10C, the shaft 130*b* of the hinge apparatus rotates by about 140° and in the case that the door opening angle θ is about 105° as shown in FIG. 10D the shaft 130*b* of the hinge apparatus rotates by about 180°.

In order to minimize cool air to be discharged from a refrigerator when a user opens the refrigerator door and in the case that the present invention is applied to the door of the refrigerator, it is very often for the user to open the door at a range of 30° through 50° and to then take out foodstuff or a bottle of water from the refrigerator.

Thus, since the rotational angle of the shaft 130*b* of the hinge apparatus ranges below 90° when the door is opened within a range of typical use described above, the door is automatically returned. In the case that more foodstuff is taken out or loaded into a refrigerator, it is convenient to open the door at an angle of more than 60° for convenience of work. In this case, the shaft 130*b* in the hinge apparatus according to the present invention remains at a state where the door rotates by more than 90°, and the door 100 of the refrigerator maintains the state where the user opens it.

Thus, in the case that the door opening angle is less than 60°, the door is automatically closed at fast speed and low speed according to first speed, second speed and third seed. As a result, when a user takes out a vessel for foodstuff from the refrigerator with both hands thereof, a loss of cool air is minimized to thereby close the door.

As described above, in the case that it is inappropriate to install the rotational center of the door and that of the hinge apparatus concentrically, an amount of rotation and a closing force value of the hinge apparatus according to rotation of the door can be effectively changed by changing a lever ratio and the rotational center of the following link 103*a* and the driving link 103*b* of the two-joint link 103.

Meanwhile, in the case that the rotational center of the door coincides with that of the hinge apparatus in the present invention, that is, the multipurpose hinge apparatus can be installed between the door and the door frame.

Figure 11:
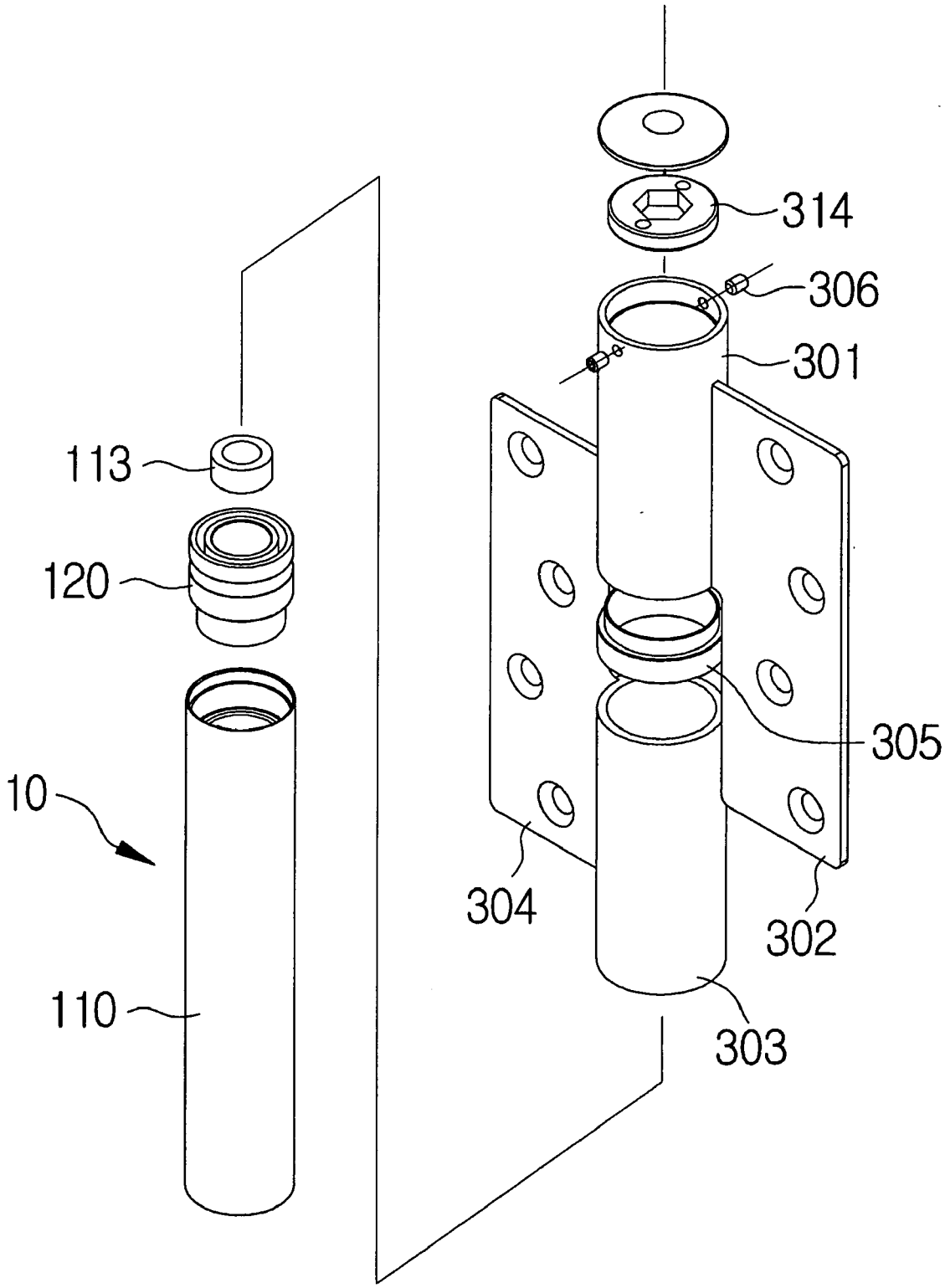
FIG. 11 is an exploded perspective view showing an installation structure when the multipurpose hinge apparatus according to the first embodiment of the present invention is applied to a door hinge apparatus.

In this case, instead of coupling the flange 112 in the embodiment of FIG. 2, a movable hinge plate 302 is fixed to the door as shown in FIG. 11, and a fixed hinge plate 304 is fixed to the door frame. A trust bearing 305 is installed between an upper hinge knuckle 301 attached to one side of the movable hinge plate 302 and a lower hinge knuckle 303 attached to one side of the fixed hinge plate 304, in order to reduce a friction due to rotation.

Also, the hinge apparatus 10 is inserted and installed in the upper and lower hinge knuckles 301 and 303. Thereafter, a stopping angle connection plate 314 is engaged with the shaft 130*a* protruding from the cam shaft 130 protruding above the upper packing 120. The stopping angle connection plate 314 is fixed to the upper hinge knuckle 301 by a stopping angle adjustment bolt 306. Therefore, the cam shaft 130 rotates according to opening of the door.

In this case, the multipurpose hinge apparatus according to the present invention rotates the stopping angle connection plate 314 engaged with the cam shaft 130 by a certain amount, and then fixes it by the stopping angle adjustment bolt 306, to thereby adjust a rotational angular range of the cam shaft 130, and adjust the rotational range and the stopping angle of the opening and closing of the door.

Further, even in the case that the hinge apparatus according to the present invention is used in a door for a Kimchi refrigerator whose door is opened and closed up and down, the hinge apparatus is buried into the door, and a connection hinge plate is combined with the shaft 130*a* of the hinge apparatus. Thereafter, the hinge pin is fixed to a support of the refrigerator main body in a spline coupling manner, or the shaft 130*a* of the hinge apparatus is extended instead of the connection hinge pin and fixed directly to the main body.

In the case that the door is opened and closed up and down as described above, an increase in a return force according to its own weight of the door when the door is closed is considered. Thus, it is preferable that the cam diagram angle $\alpha$ in the first section "a" of the ascending and descending guide holes 132 and 133 is set relatively smaller than or same as an angle $\beta$ of the second section "b." Thus, when the door is returned to the initial position, and even if the return speed of the door is fast, components of an electronic controller which is mounted in the main body can be prevented from damaging.

The present invention is not limited to the above-described embodiments, but many modifications and variations can exist.

For example, in the case of the cam shaft, it is possible to form the first and second ascending and descending guide holes formed of a spiral fashion shown in FIG. 4A, in a direction reverse to the above-described embodiment. In this case, the guide pin is also guided to ascend and descend according to rotation of the cam shaft.

Also, only the second speed adjustment oil path 179*b* is opened and closed according to ascending and descending of the control pipe 180 in the above-described embodiment. However, in the case that a third speed adjustment oil path is provided below the second speed adjustment oil path 179*b* of the inner tube 170 and the outer tube 175, it is possible to control an ascending speed of the piston 151 in further multiple steps according to ascending of the control pipe 180.

Further, the return speed of the door is controlled by controlling the ascending speed of the piston in multiple steps in which an amount of oil flow is controlled using the opening and closing of the second speed adjustment oil path 179*b* according to an ascending of the control pipe 180, in the above-described embodiment. In the case that the present invention is applied to the hinge apparatus for connecting the up/down opening and closing door such as a Kimchi refrigerator to the main body, that is, it is not necessary to change the return speed by user, it is possible to simplify a control of an amount of oil flow.

Figure 12:
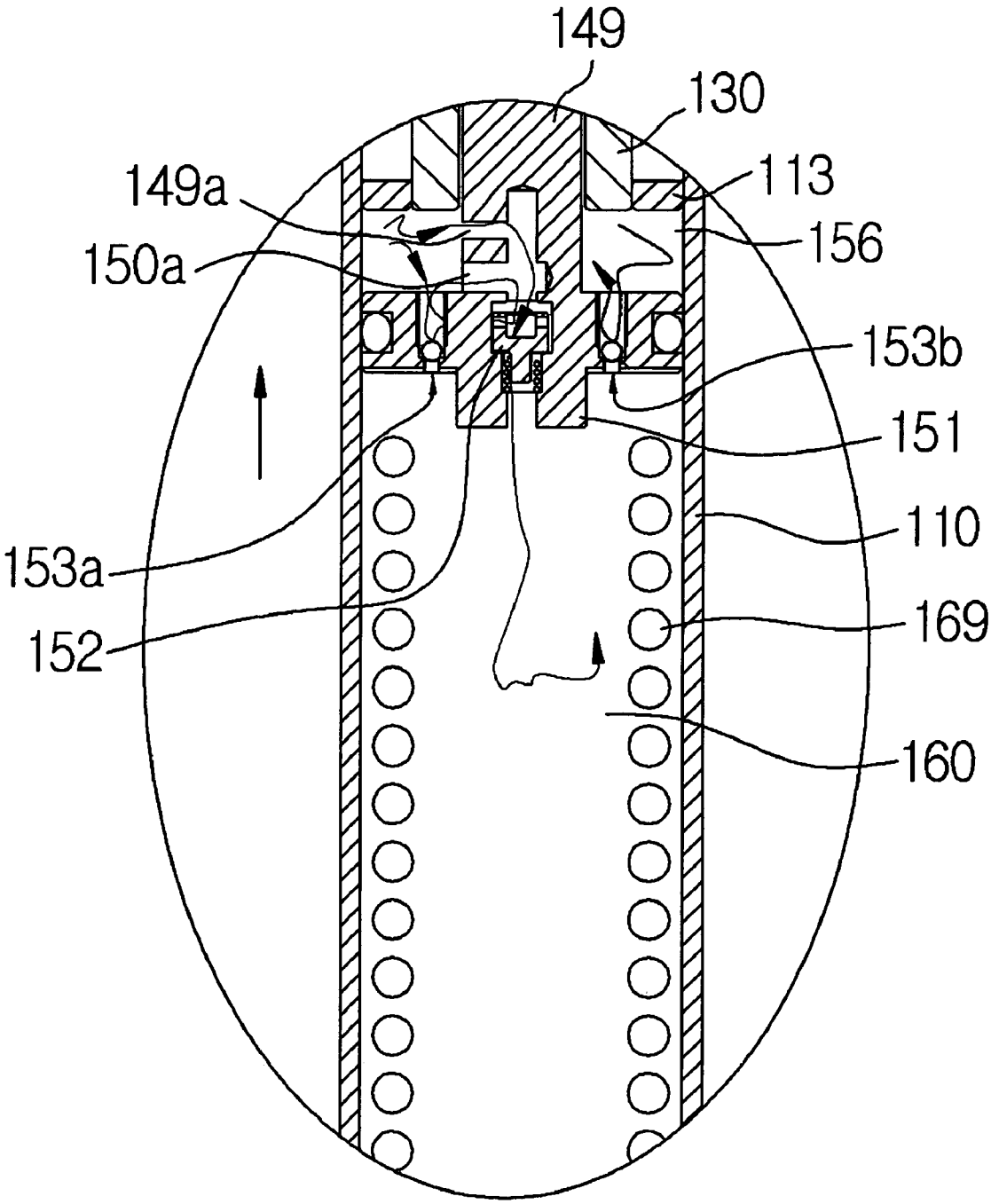
FIG. 12 is a cross-sectional view showing essential portions of a multipurpose hinge apparatus according to a second embodiment of the present invention.

That is, the control pipe 180 necessary for a multiple step speed adjustment, and the inner tube 170 and outer tube 175 connected to the control pipe 180, and the speed adjustment handle 193, are removed from the first embodiment shown in FIG. 2, and it is possible to embody the present invention as in the second embodiment shown in FIG. 12.

In this case, if an overspeed prevention valve arranged in the central throughhole 154 of the piston 151 is used as it is, there is no need to change a diameter in an exit of the central throughhole 154. However, if the overspeed prevention valve is removed, it is necessary to make a diameter of an exit of the first oil path 150*a* communicating the upper chamber and the lower chamber with each other relatively smaller than diameters of the check valves 153*a* and 153*b*.

In the hinge apparatus dedicated for the up/down opening and closing door, the structure of the first oil path 150*a* communicating the upper chamber and the lower chamber with each other which is located below the piston rod 149 is changed as shown in FIG. 12 in order to control the return speed of the door in multiple steps. Accordingly, at least one horizontal throughhole perpendicularly formed on the outer circumferential surface of the piston rod is formed in the upper side of a first oil path 150*a*, to thereby form a speed adjustment oil path 149*a* internally connected with the first oil path 150*a*.

The position of the speed adjustment oil path 149*a* is established in the same interval as that between the first and second speed adjustment oil paths 179*a* and 179*b* in the first embodiment. Thus, it is preferable that the position of the speed adjustment oil path 149*a* is located at a position where it is sealed by the inner circumferential surface of the cam shaft 130 when the door opening angle reaches 30°. In this case, it is possible to control the piston speed minutely by additionally providing another oil path having the same function as that of the speed adjustment oil path 149*a*.

In the second embodiment, it is needed that the inner circumferential surface of the cam shaft 130 and the outer circumferential surface of the piston rod 149 are proximate to contact each other in a sliding manner.

In the second embodiment, when the piston rod 149 ascends along the inner circumferential surface of the main body of the cam shaft 130 in association with ascending of the piston during a return of the door, the speed adjustment oil path 149*a* is closed according to the ascended height of the piston rod, that is, the door opening angle, an amount of oil flowing from the upper chamber 156 to the lower chamber 160 via the first oil path 150*a* and the overspeed prevention valve 152 is adjusted. As a result, the ascending speed of the piston 151 is adjusted in multiple steps, similarly to that of the first embodiment.

In the up/down opening and closing door hinge apparatus, a closing speed is reduced when the door is returned downwards by its own weight. Accordingly, when oil flows from the upper chamber to the lower chamber via the first oil path, an amount of oil flow should be controlled so that the piston ascends at retarded speed. For this purpose, it is necessary to properly establish the weight of the door, a return force of the return spring 169, a position of the speed adjustment oil path 149*a*, a diameter of an exit of the first oil path 150*a*, and a cam diagram angle of the ascending and descending guide hole.

Further, it is possible to apply the second embodiment in a left/right opening and closing door in addition to the up/down opening and closing door. The second embodiment has no speed adjustment function by a user, but is simplified in structure in comparison with the first embodiment. Accordingly, the second embodiment of the present invention provides a light hinge apparatus. Also, the second embodiment of the present invention provides an excellent assembly and reduces a production cost, to thereby provide an effect of reducing a product price. Further, the second embodiment can embody slim type hinge apparatus having diameter of 24 mm and length of 153 mm Also, the first and second embodiments are applied in the structure that the hinge axis is protruded from the door frame, in addition to the above-described applications. As a result, the housing of the hinge apparatus is installed in the pivot hinge of the door side, and the shaft of the cam shaft is combined with the hinge of the door frame side so that the shaft is prevented from rotating.

Further, it is possible that the speed adjustment mechanism of the second embodiment is used in combination with the first embodiment. That is, the hinge apparatus according to the first embodiment can include another speed adjustment unit in which at least one horizontal throughhole perpendicularly formed on the outer circumferential surface of the piston rod is formed in the upper side of a first oil path 150*a*, is formed, in the same manner as that of the second embodiment, to thereby additionally form a speed adjustment oil path 149*a* internally connected with the first oil path 150*a*. In this case, a much further minute speed adjustment can be accomplished in comparison with the first and second embodiments.

Figure 13:
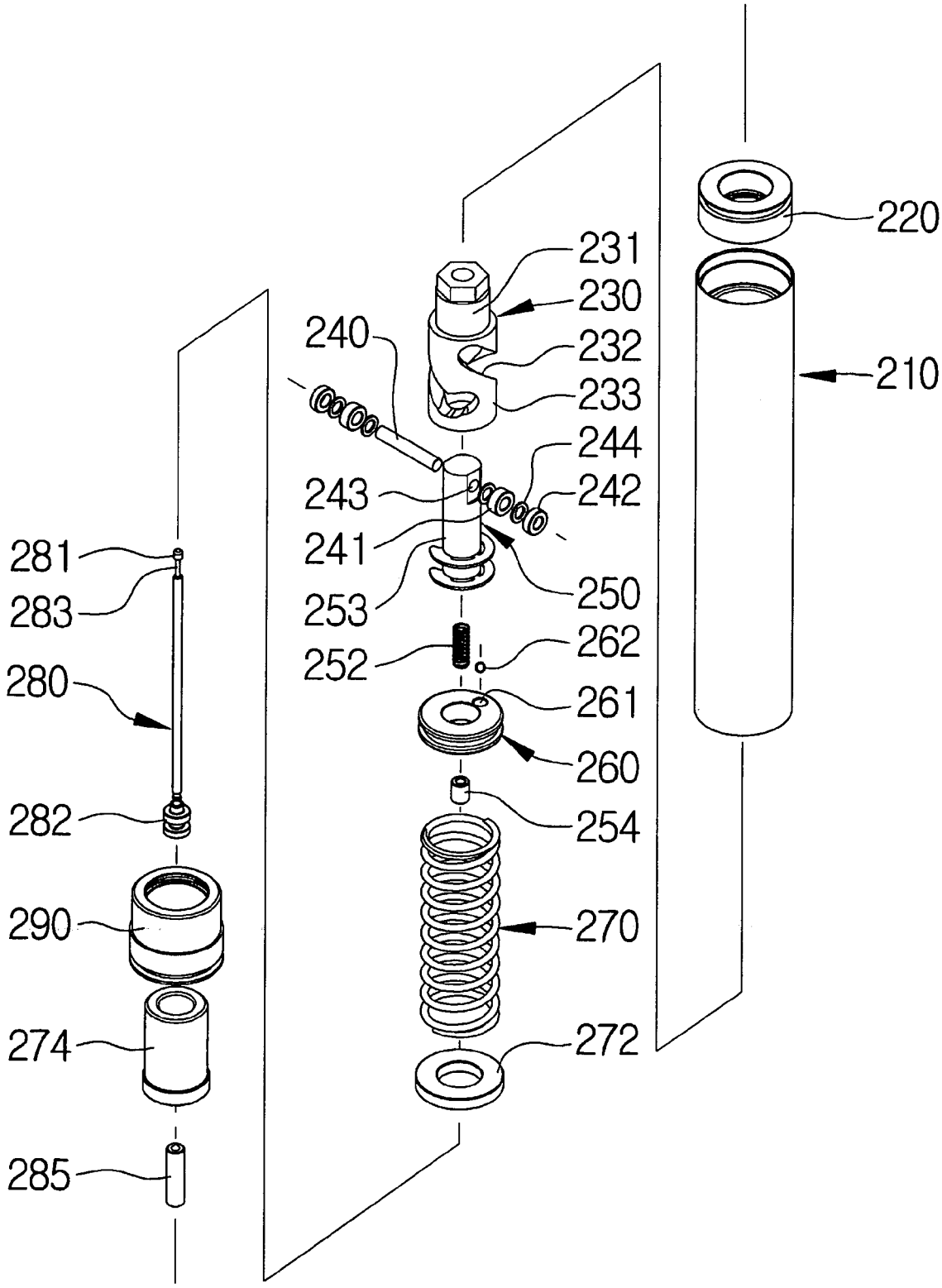
FIG. 13 is an exploded perspective view showing a multipurpose hinge apparatus according to a third embodiment of the present invention.
Figure 14:
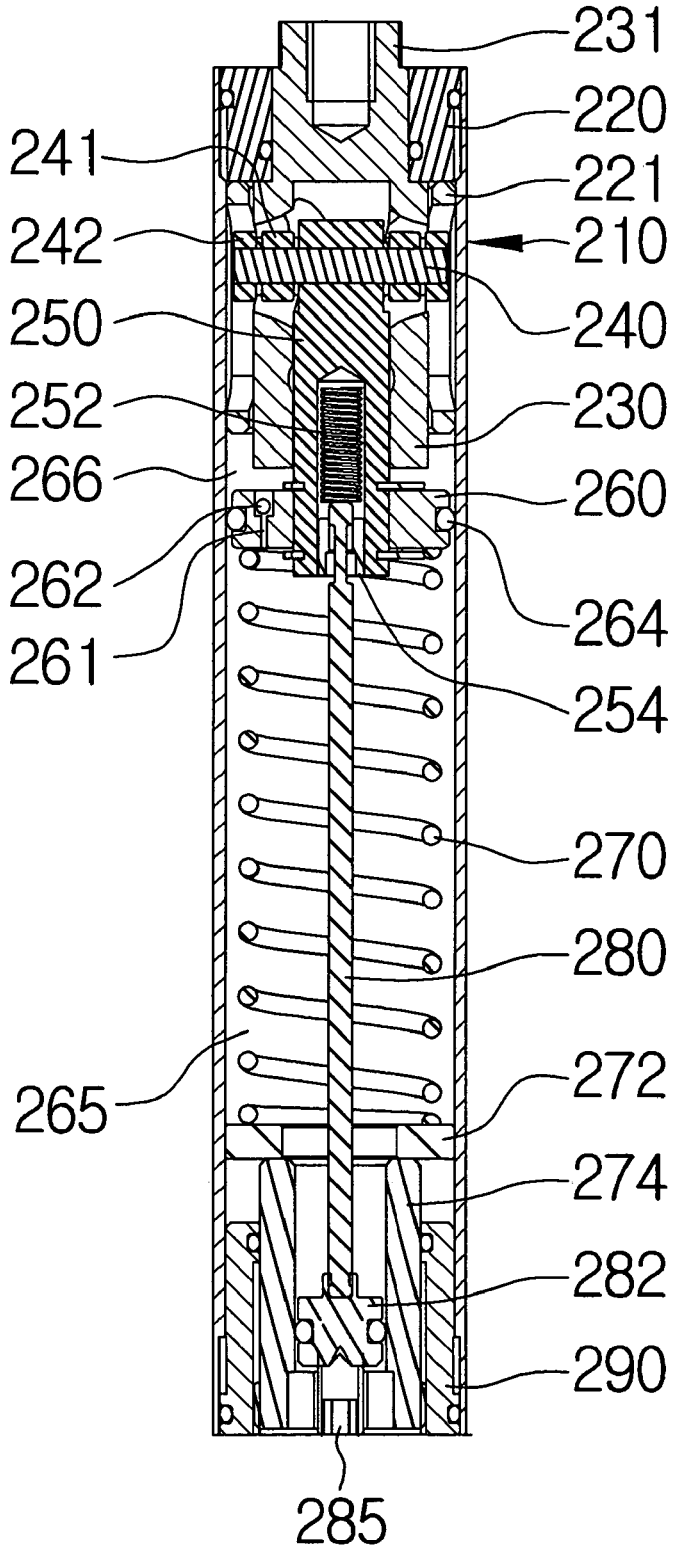
FIG. 14 is a lengthwise cross-sectional view showing an assembly state of the multipurpose hinge apparatus shown in FIG. 13.
Figure 15:
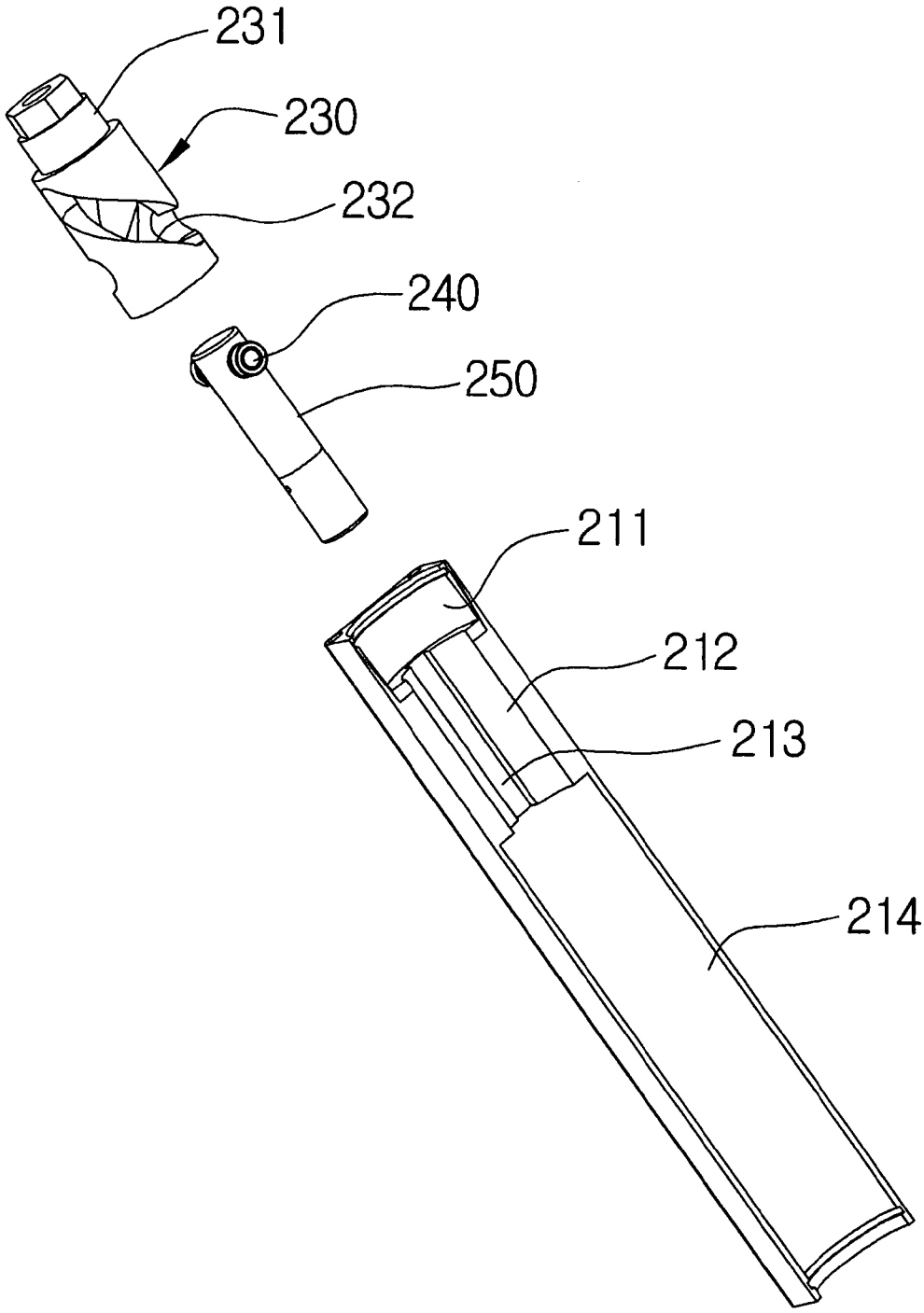
FIG. 15 is an exploded perspective view showing a coupling relationship among a cam shaft, a piston rod, and a cam shaft guide in the multipurpose hinge apparatus shown in FIG. 14.

Meanwhile, FIG. 13 is an exploded perspective view showing a multipurpose hinge apparatus according to a third embodiment of the present invention. FIG. 14 is a lengthwise cross-sectional view showing an assembly state of the multipurpose hinge apparatus shown in FIG. 13. FIG. 15 is an exploded perspective view showing a coupling relationship among a cam shaft, a piston rod, and a cam shaft guide in the multipurpose hinge apparatus shown in FIG. 14.

As shown in FIGS. 13 through 15, a multipurpose hinge apparatus according to the present invention includes a housing 210 accommodating internal components, a cam shaft 230 whose part is protruded upward from the housing 210 and which rotates by an external force, a guide pin 240 which moves along ascending and descending guide holes 232 which are formed on the outer circumference of the cam shaft 230 and vertical guide grooves 213 formed in the inner surface of the housing 210, a piston rod 250 which is connected with the guide pin 240 and moves up and down, a piston 260 which is combined with the lower portion of the piston rod 250, and includes an oil path therein, an elastic member 270 which provides an elastic force upwards from the lower portion of the piston 260, and a hydraulic control rod 280 whose one end is inserted and installed into the oil path formed in the cross-sectional center of the piston 260, and which changes an amount of oil flow according to the up and down movement of the piston 260.

The housing 210 is a cylindrical body having a certain length, in which a throughhole is formed along the lengthy direction at the cross-sectional center. The inner surface of the housing 210 is formed in various forms according to position of the lengthy direction. An upper inner surface 211 has the same inner circumferential shape as that of an upper packing 220 so that an upper packing 220 is fitted into the inner surface of the housing. Also, a cam shaft guide 212 having a smaller diameter than the upper inner surface is formed below the upper inner surface 211 in the housing 210. A pair of vertical guide grooves 213 facing each other are formed in the cam shaft guide 212 in lengthy direction. At the assembled state of the present invention, the cam shaft 230 is position in the cam shaft guide 212. A guide pin 240 protruded out of the cam shaft 230 is inserted into the pair of guide grooves 213. Also, a lower inner surface 214 where the piston 260 and the elastic member 270 are positioned below the cam shaft guide 212 is formed in the inner surface of the housing 210 (refer to FIGS. 13 and 15).

The upper packing 220 is inserted into and installed on the upper inner surface of the housing 210, and a trust bearing 221 for offsetting a surface friction due to rotation of the cam shaft 230 is position in the lower portion of the upper packing 220. An upper packing hole is formed in the cross-sectional center of the upper packing 220 so that a shaft 231 of the cam shaft 230 is penetrated through the cross-sectional center of the upper packing 220. The shaft 231 is protruded out of the upper packing 220 via the upper packing hole.

The end of the shaft 231 protruding from the cam shaft 230 is angularly formed. When an actuator such as a door is connected with the shaft 231, a rotational force is efficiently transferred externally. Also, a body 233 having a larger diameter than that of the shaft 231 is formed in the cam shaft 230 stepwise. A groove is formed along the lengthy direction in the body 233 so that the piston rod 250 is inserted into and connected with the body 233. Also, a pair of ascending and descending guide holes 232 facing each other are formed in the outer circumferential surface of the body 233, respectively (refer to FIGS. 16A and 16B).

Figure 16A:
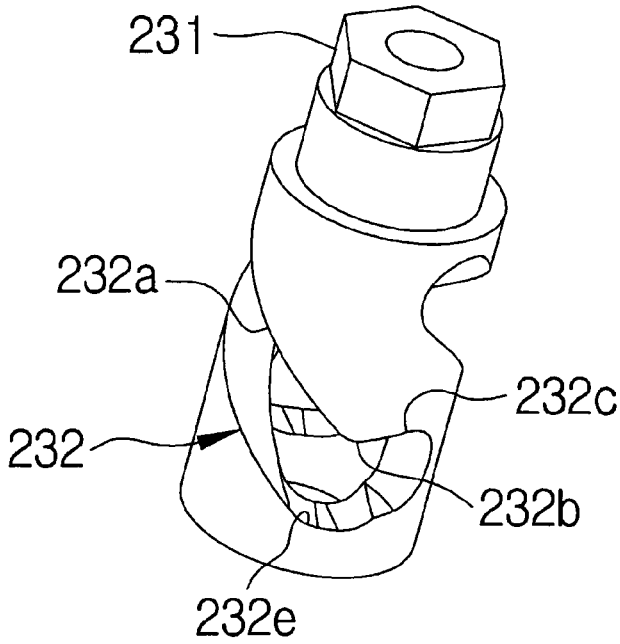
FIG. 16A is an enlarged perspective view showing the cam shaft shown in FIG. 15.
Figure 16B:
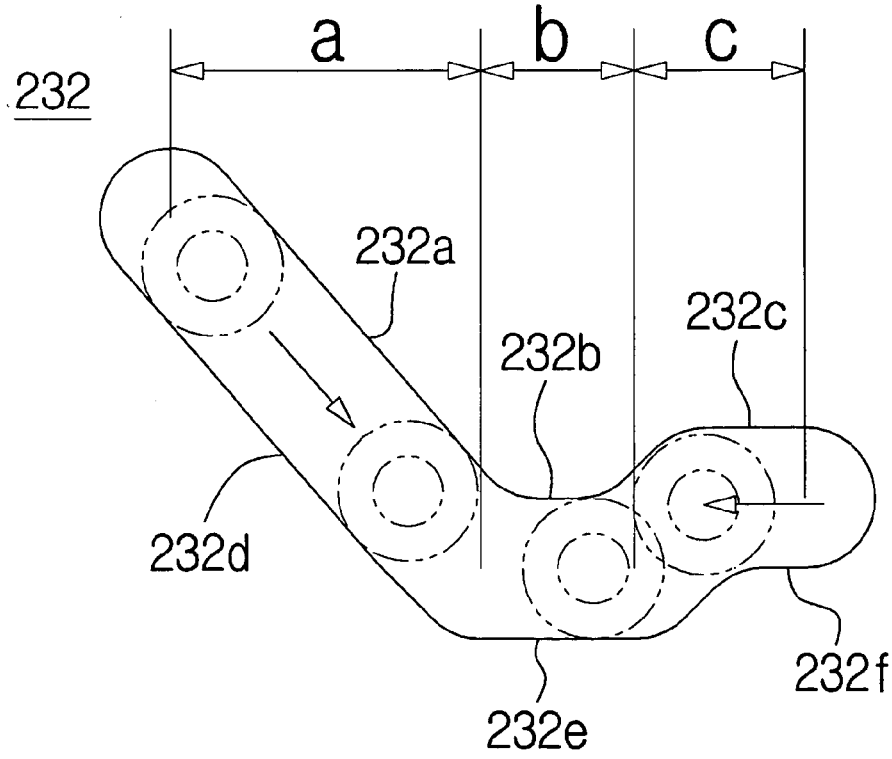
FIG. 16B is a view showing a position of a guide pin according to the operation of the multipurpose hinge apparatus in an ascending and descending guide hole of the cam shaft shown in FIG. 16A.
Figure 17A:
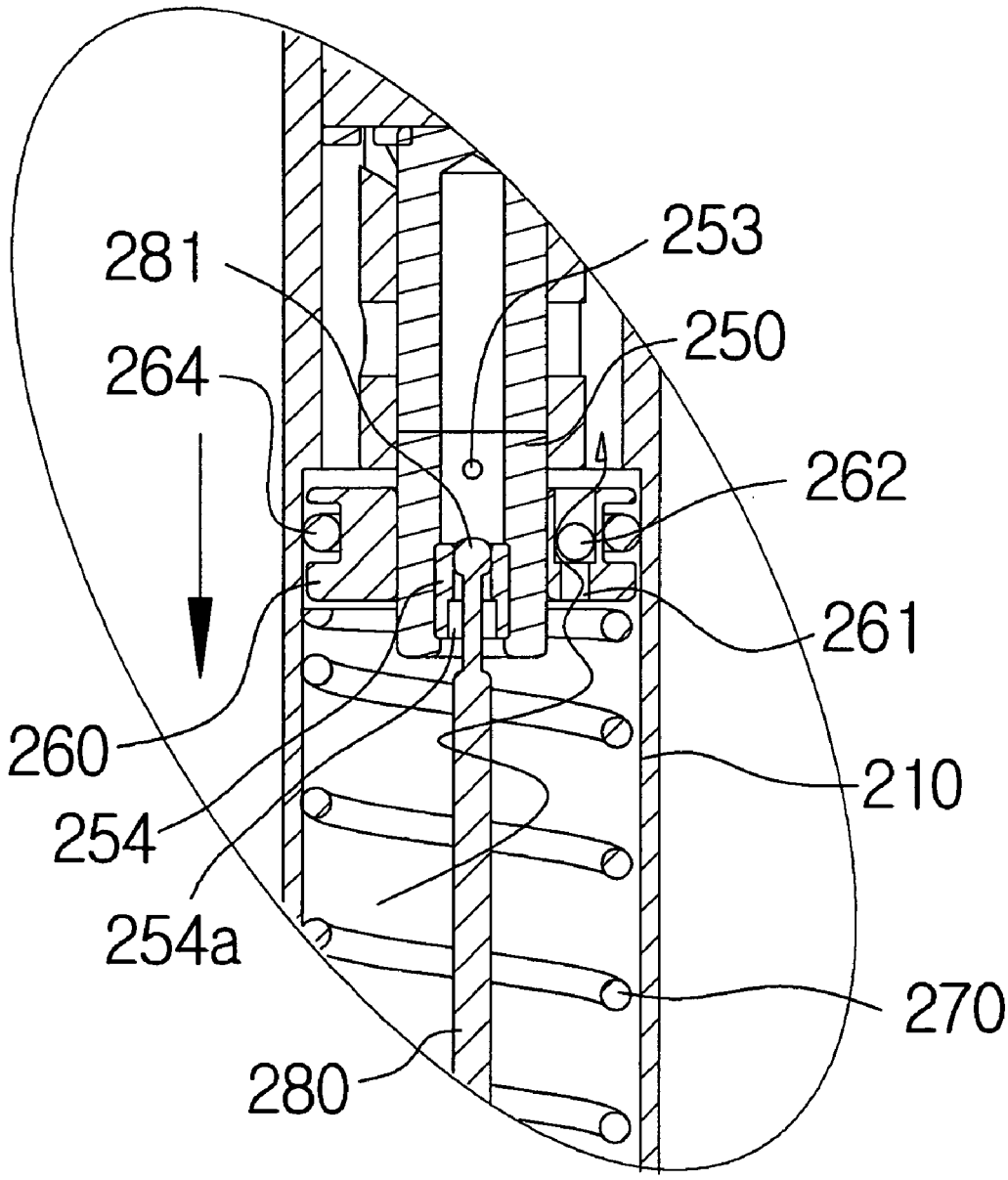
FIGS. 17A and 17B are partially cross-sectional views showing the internal operating state when the piston descends according to the relative rotational force applied to the multipurpose hinge apparatus shown in FIG. 14.
Figure 17B:
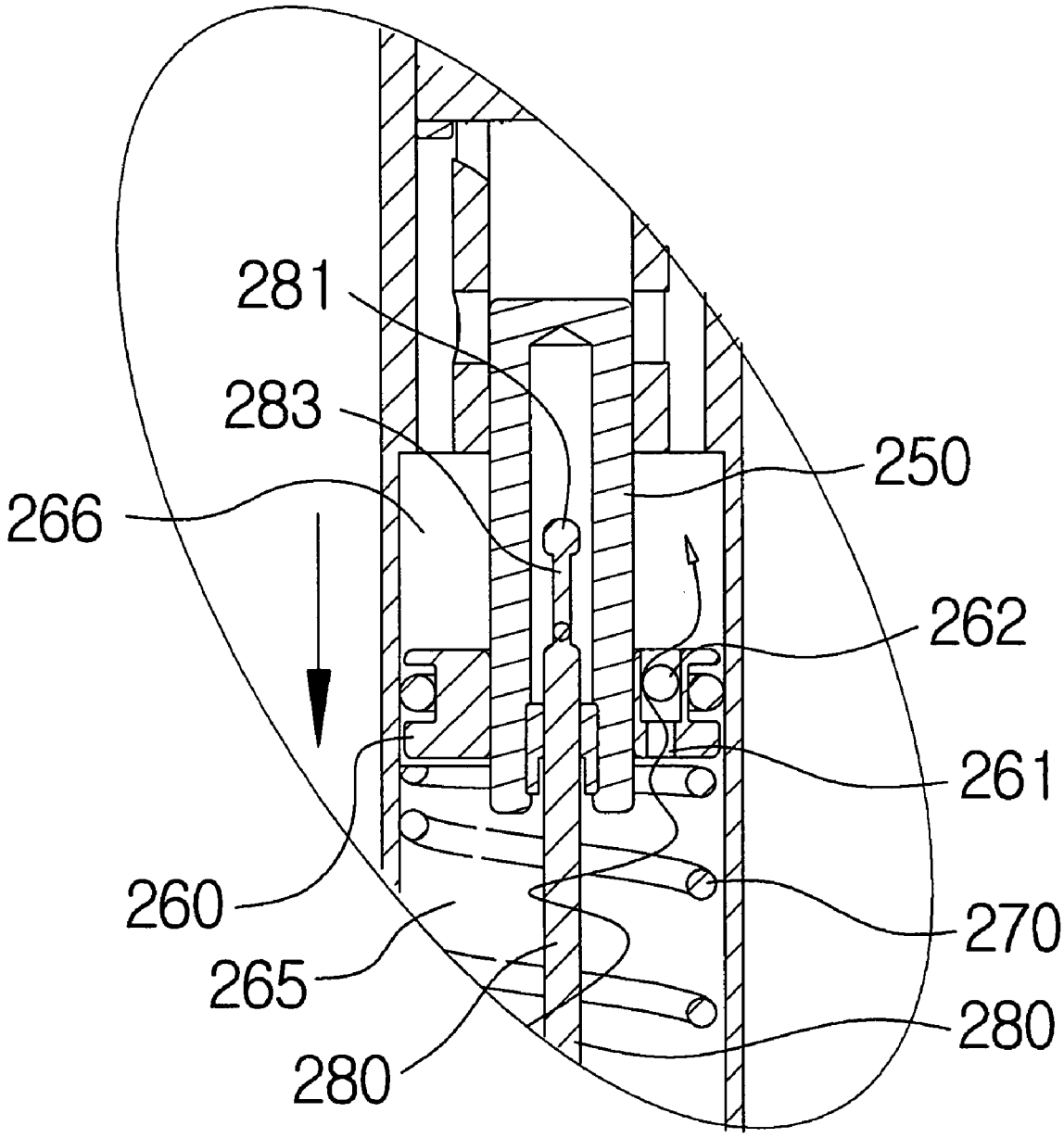
Figure 17C:
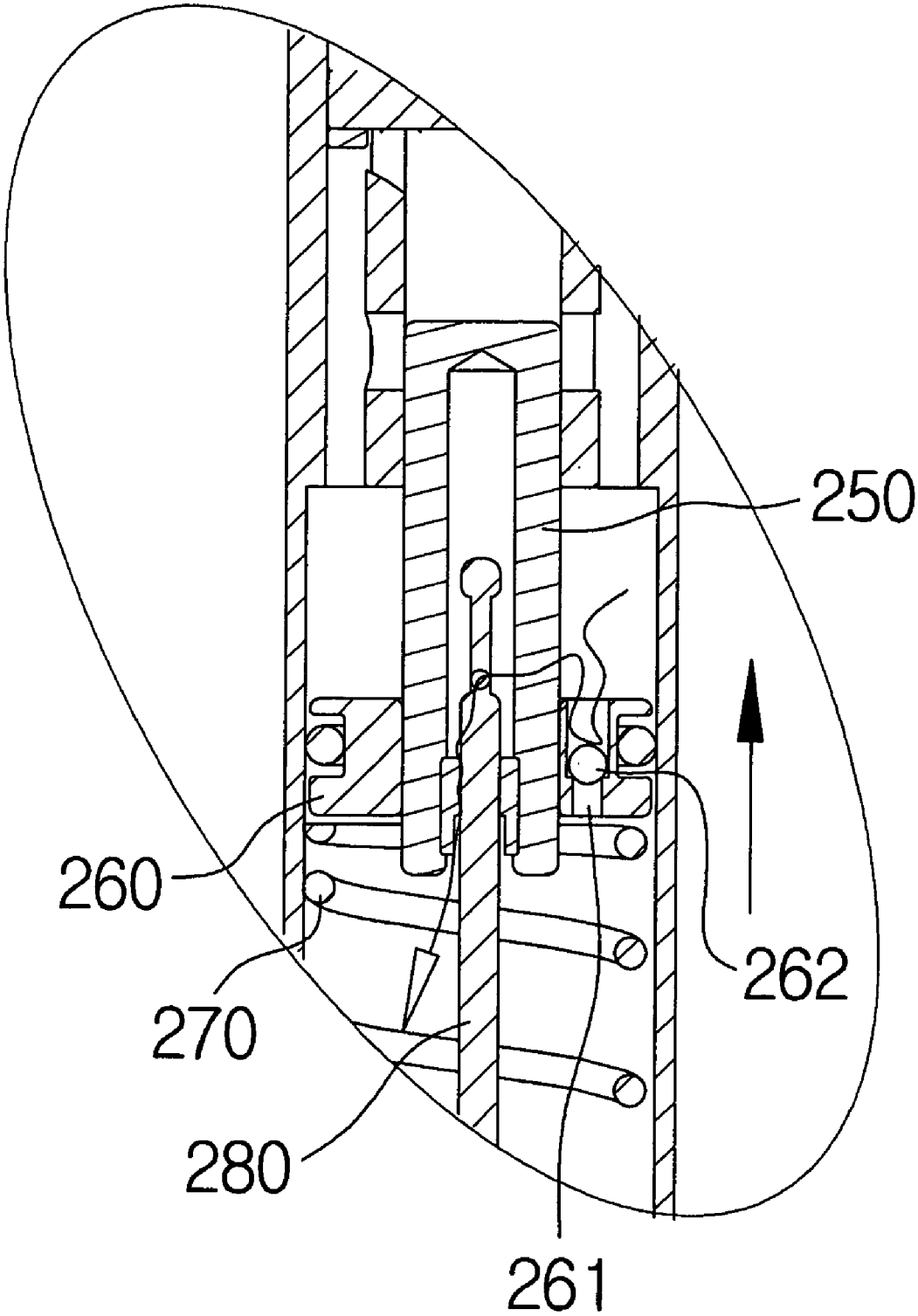
FIGS. 17C, 17D and 17E are partially cross-sectional views showing the internal operating state when the piston ascends according to the relative rotational return force applied to the multipurpose hinge apparatus shown in FIG. 14.
Figure 17D:
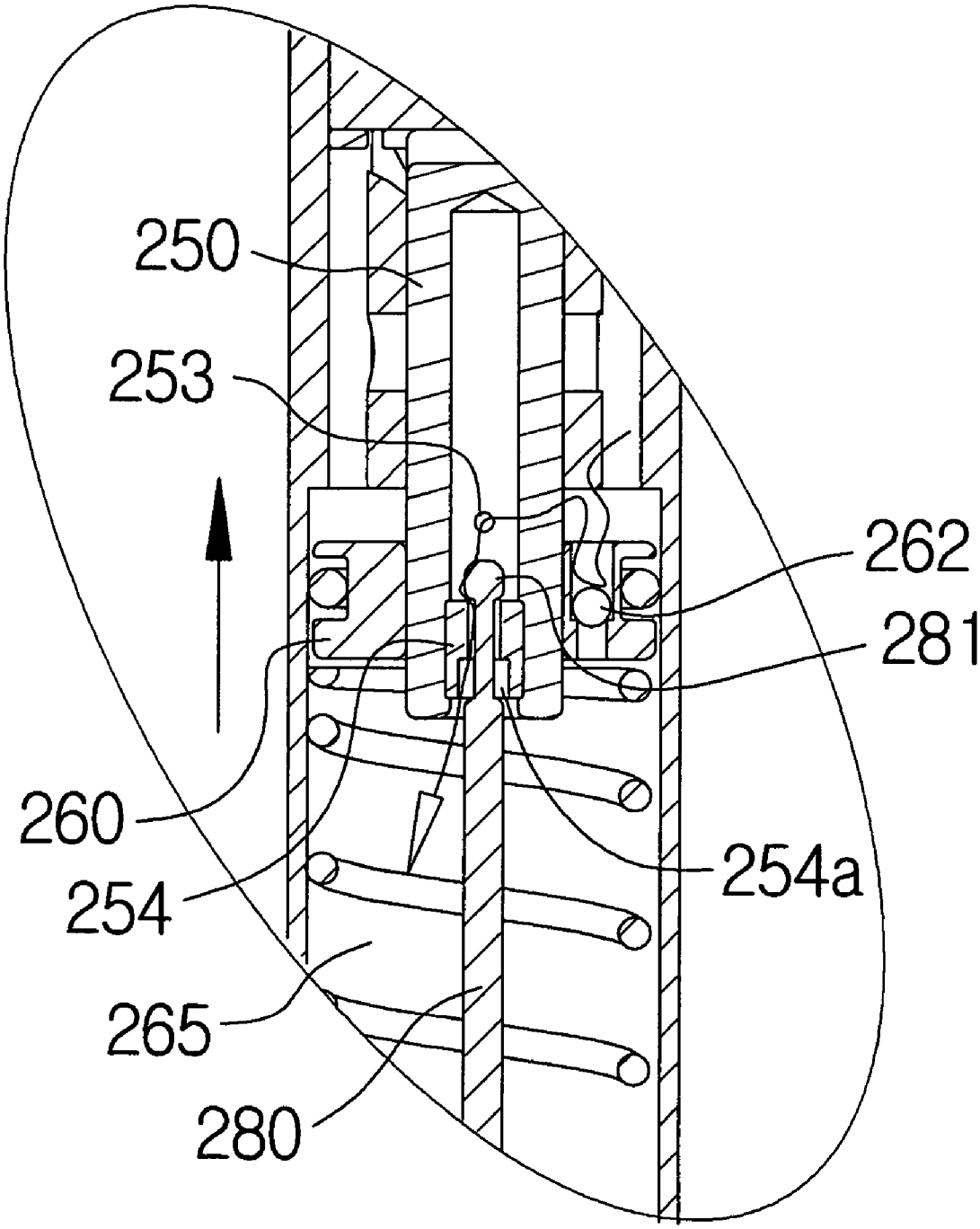
Figure 17E:
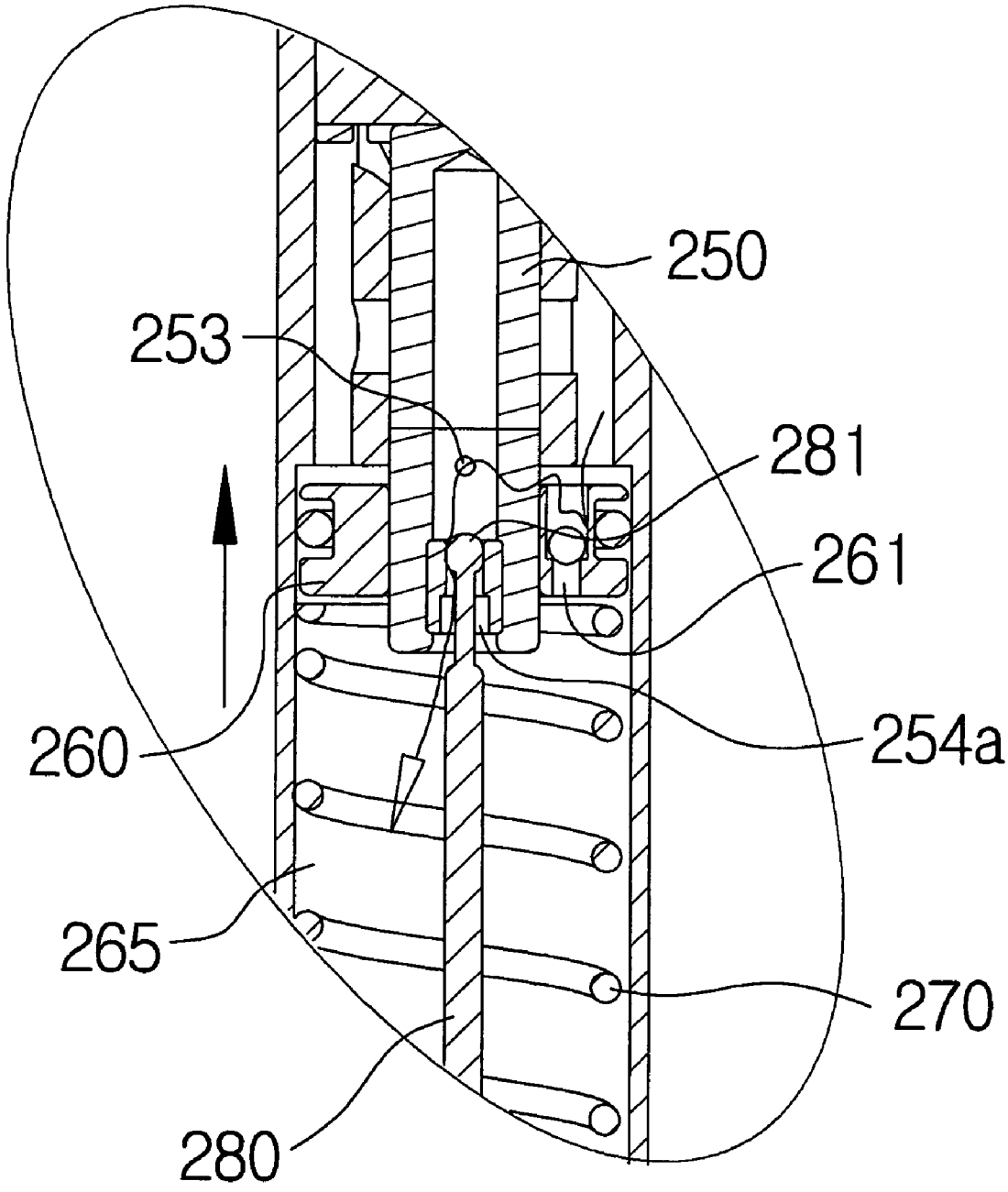

FIG. 16A is an enlarged perspective view showing the cam shaft shown in FIG. 15. FIG. 16B is a view showing a position of a guide pin according to the operation of the multipurpose hinge apparatus in an ascending and descending guide hole of the cam shaft shown in FIG. 16A. FIGS. 17A and 17B are partially cross-sectional views showing the internal operating state which occurs according to the relative rotational force in the multipurpose hinge apparatus according to a third embodiment of the present invention. FIGS. 17C, 17D and 17E are partially cross-sectional views showing the internal operating state which occurs according to the relative rotational return force in the multipurpose hinge apparatus.

As shown in FIGS. 16A through 17E, the ascending and descending guide holes 232 are formed counterclockwise along the outer surface of the cam shaft 230, and includes an ascending and descending section "a" which proceeds downwards in a slope shape from a plane, a first stop section "b" which is formed to proceed on the same level from the lower end of the ascending and descending section "a" so that the guide pin 240 which moves along the ascending and descending section "a" does not ascend and descend, and a second stop section "c" which is formed in a slope shape upwards by a short distance from the first stop section "b," and is stopped not to move furthermore by a catch of the guide pin 240. Also, the ascending and descending guide holes 232 are formed with a certain width to closely contact the first roller bearing 241 combined with the guide pin 240.

Also, in each of the ascending and descending guide holes 232, an ascending and descending portion 232*a* and a first cam diagram support 232*d* are formed to have the same slope of 30° through 60° in the ascending and descending section "a." In the case that the ascending and descending section "a" is formed to have a slope of 30° through 45°, an efficiency of the compressed elastic member 270 becomes low in comparison with an external force which rotates the cam shaft 230 because an ascending and descending distance of the piston 260 connected with the guide pin 240 is short in the case of the cam shaft 230 having a limited length. Therefore, in the case that the ascending and descending section "a" is formed to have a slope of 30° through 45°, the door which is opened and closed up and down by an external force such as inertia by its own weight absorbs an impact so that it can be slowly closed. Also, in the case that the ascending and descending section "a" is formed to have a slope of 45° through 60°, an ascending and descending distance of the piston 220 becomes long and thus a repulsive force of the compressed elastic member 270 becomes larger than an external force rotating the cam shaft 230. Thus, in the case that the ascending and descending section "a" is formed to have a slope of 45° through 60°, the left/right opening and closing door is more easily and swiftly closed than the up/down opening and closing door.

The guide pin 240 descends along the ascending and descending section "a" which slopes up and down and does not move up and down in the first stop section "b" but temporarily stops. Also, in the case that the cam shaft 230 consistently rotates, the guide pin 240 proceeds to the second stop section "c" which slopes a little upwards from the first stop section "b." The guide pin 240 is caught by a curved first stopper 232*b* and does not rotatably move but stops.

In each of the ascending and descending guide holes 232, a second stopper 232*c* and a third cam diagram support 232*f* are formed to have the same slope of 15° through 60° in the second stop section "c." In the case that the second stop section "c" is formed to have a slope of less than 15°, the cam shaft 230 easily rotates by a repulsive force of the elastic member 270 or a minute external force. Accordingly, the second stop section "c" having a slope of less than 15° is inappropriate since a force stopping the guide pin 240 is feeble. Also, in the case that the second stop section "c" is formed to have a slope of more than 60°, a force stopping the guide pin 240 is increased by a catch of the second stopper 232*b*. However, the second stop section "c" having a slope of more than 60° is inappropriate since a large force is needed during ascending of the guide pin 240.

Meanwhile, in the case that the guide pin 240 ascends by a repulsive force of the compressed elastic member 270, an oil pressure at the upper portion of the piston 260 functions more greatly than an elastic force of the elastic member 270, near the limit up to which the piston 260 can ascend. In this case, the piston 260 can descend reversely abruptly. Therefore, in each of the ascending and descending guide holes 232, the first cam diagram support 232*d* closely contacts the first roller bearing 241 connected with the guide pin 240, and thus the guide pin 240 is made not to secede from an ascending and descending diagram.

Also, at the initial time when the guide pin 240 proceeds from the first stop section "b" to the ascending and descending section "a," internal noise and damage of the internal elements can occur due to the initial irregular movement of the guide pin 240. To prevent this, it is preferable that a boundary portion between the first cam diagram supporter 232*d* and a second cam diagram supporter 232*e* is formed of a curve in each of the ascending and descending guide holes 232.

The guide pin 240 is fitted into a pair of ascending and descending guide holes 232, and moves along a path on which the pair of ascending and descending guide holes 232 are formed. Also, the guide pin 240 moves along a pair of vertical guide grooves 213 formed up and down, in which a portion protruded to an outer surface of the cam shaft 230 is positioned in a pair of vertical guide grooves 213 of the housing 210.

Also, in the guide pin 240 are respectively installed first and second roller bearings 241 and 242 in order to reduce friction when the guide pin 240 contacts the ascending and descending guide holes 232 and the vertical guide grooves 213. That is, the first roller bearing 241 is fitted into a position of the guide pin 240 contacting the ascending and descending guide holes 232 of the cam shaft 230 and the second roller bearing 242 is fitted into a position of the guide pin 240 contacting the vertical guide grooves 213 of the housing 210. Also, a first washer 243 is inserted between the first roller bearing 241 and the piston rod 250 in the guide pin 240, and a second washer 244 is inserted between the first and second roller bearings 241 and 242. The first and second roller bearings 241 and 242 closely contact the guide pin 240 in lengthy direction thereof without having any gap.

A piston rod 250 connected with the guide pin 240 is connected with the cam shaft 230. The piston rod 250 is cylindrically shaped and the guide pin 240 is combined with the upper portion of the piston rod 250, and the piston 260 is integrally combined with the lower portion thereof. An oil path elongate groove is formed in the cross-sectional center of the piston rod 250 along the lengthy direction. A spring 252 is installed in the oil path elongate groove. An oil path adjustment unit 254 is in the oil path elongate groove of the piston rod 250, having an inner diameter smaller than that of the oil path elongate groove, in which a first speed adjustment oil path 254*a* of an orifice shape whose diameter becomes gradually narrow is formed therein so that an amount of oil flowing inside is adjusted. Accordingly, in the case that a hydraulic control rod 280 is positioned in the first speed adjustment oil path 254*a*, a cross-sectional area through which oil can flow according to movement of the piston rod 250 up and down is changed to thereby adjust an amount of oil flow. Also, a return oil path 253 is formed in the upper side of the piston rod 250 a little higher than the piston 260, so that the inner portion and the outer portion of the piston rod 250 can be connected with each other.

The piston 260 is integrally combined with the piston rod 250, which ascends and descends in the lower inner surface 214 of the housing 210, by an oil pressure or elastic force. Here, the upper end of the piston 260 closely contacts the cam shaft guide 212 so that the piston 260 is limited to move upwards. Also, an oil ring 264 is combined on the outer circumference of the piston 260. Accordingly, the piston 260 closely contacts the lower inner surface 214 of the housing 210, and thus oil is prevented from flowing through a gap between the piston 260 and the lower inner surface 214 of the housing 210.

A second speed adjustment oil path 261 penetrating through the piston 260 up and down is formed in the piston 260, which includes a one-directional check valve to make oil filled in the housing 210 move from the lower portion to the upper portion only in one direction. As the second speed adjustment oil path 261 proceeds from the lower portion to the upper portion, the cross-sectional area is widened. A check ball 262 is installed in the second speed adjustment oil path 261. The check ball 262 has a diameter which is larger than that of the lower portion of the second speed adjustment oil path 261, and smaller than that of the upper portion thereof. For this reason, the check ball 262 moves upwards in the case that oil flows from the lower portion of the piston 260 to the upper portion thereof, so that oil can flow easily. Meanwhile, the check ball 262 moves downwards, and is clogged by the lower portion of the second speed adjustment oil path 261, to thereby limit a flow of oil, in the case that oil flows toward the lower portion of the piston 260.

A coil spring which is an elastic member 270 is inserted into and installed in the housing 210, below the piston 260. The hydraulic control rod 280 is positioned in the center of the elastic member 270.

The head 281 of the hydraulic control rod 280 is inserted into the first speed adjustment oil path 254*a* of the piston rod 250, to thereby control an amount of oil flow and control a descending speed of the piston rod 250 and the piston 260. The head 281 of the hydraulic control rod 280 is spherically shaped, and has a diameter a little smaller than the first speed adjustment oil path 254*a* of the piston rod 250. A neck portion 283 which is located in the lower end of the head 281 is formed to have a cross-sectional diameter relatively smaller than the head 281. The lower portion 282 of the hydraulic control rod 280 is pivotably connected with an oil flow control bolt 285.

An elastic force adjustment plate 272 supporting the elastic member 270 is positioned in the lower portion of the elastic member 270. A hole is formed at the center of the elastic force adjustment plate 272, so that the hydraulic control rod 280 penetrates the elastic force adjustment plate 272.

An elastic force adjustment unit 274 contacts the lower portion of the elastic force adjustment plate 272. The outer circumference of the elastic force adjustment unit 274 are formed of screw threads, and are screw-combined with the throughhole of the lower packing 290 combined with the lower portion of the housing 210. Thus, in order to adjust the elastic force of the elastic member 270, the elastic force adjustment unit 274 is made to rotate and thus the elastic force adjustment plate 272 is made to ascend and descend up and down, to thereby adjust a compression ratio of the elastic member 270. The lower portion 282 of the hydraulic control rod 280 and the oil flow control bolt 285 are inserted into and combined with the inner portion of the elastic force adjustment unit 274.

Hereinbelow, the operation of the multipurpose hinge apparatus according to the third embodiment of the present invention having the above-described structure will be described.

As shown in FIGS. 13 through 17E, if an external rotational force is transferred to the shaft 231 of the cam shaft 230 in the multipurpose hinge apparatus according to the present invention, the internal elements operate as follows.

First, a case that the housing 210 in the multipurpose hinge apparatus according to the present invention is buried and is fixed in the upper end and the lower end of one side of a rotatable door, and the shaft 231 of the cam shaft 230 is fixed to the door frame, will be described below as an example.

If an external rotational force is transferred to the cam shaft 230 when a user opens a rotational door, the guide pin 240 moves downwards along the ascending and descending guide holes 232. Then, as shown in FIGS. 17A and 17B, a force moving downwards is applied to the piston 260 operating in association with the guide pin 240, and the check valve is opened. Accordingly, oil contained in the lower chamber 265 below the piston 260 starts to move toward the upper chamber 266 via the second speed adjustment oil path 261.

As a result, the guide pin 240 moves in the ascending and descending section "a" as in the operational state in the ascending and descending guide holes 232 shown in FIG. 16B. Then, the piston rod 250 and the piston 260 compress the elastic member 270 and descend. Thereafter, the guide pin 240 reaches the second stop section "c" in the case that the cam shaft 230 consistently rotates, and is limited to move by the first stopper 232*b* in the first stop section "b" which is curved in the ascending and descending guide holes 232, to thereby maintain the piston 260 to be at the stop state.

Meanwhile, in the case of the multipurpose hinge apparatus according to the third embodiment of the present invention, if a small external force is applied to the cam shaft 230 in the reverse direction with respect to the rotational direction of the cam shaft 230, that is, the door is closed, the guide pin 240 passes through the curved first stopper 232*b* and secedes from the second section "c." In this case, the piston 260 starts to move upwards by a repulsive force of the compressed elastic member 270, and the guide pin 240 connected to the piston 260 also ascends along the ascending and descending section "a" in the ascending and descending guide holes 232.

Here, oil located toward the upper chamber 266 does not pass through toward the second speed adjustment oil path 261 by the check ball 262 in the check valve, and moves toward the lower chamber 266 located below the piston 260 via the return oil path 253 and the first speed adjustment oil path 254*a*. since the hydraulic control rod 280 is positioned in the first speed adjustment oil path 254*a* as shown in FIG. 17C, an amount of oil flow is small at the initial time when the piston 260 ascends, and thus the piston 260 also ascends at low speed.

Thereafter, in the case that the bent portion of the hydraulic control rod 280 is positioned in the first speed adjustment oil path 254*a* as shown in FIG. 17D, an amount of oil flow becomes large, and thus the piston 260 also ascends at high speed. In the case that the head 281 of the hydraulic control rod 280 is positioned in the first speed adjustment oil path 254*a* as shown in FIG. 17E (that is, at a point near the ascending limit point of the piston), an amount of oil flow becomes small again, and thus the piston 260 ascends at low speed.

As described above, the hinge apparatus according to the third embodiment of the present invention includes the same unit for ascending and descending the piston rod in association with opening and closing of the door as in the other embodiments. However, a speed adjustment unit for adjusting an ascending speed of the piston in multiple steps has been modified in which an amount of oil flowing from the upper chamber to the lower chamber is adjusted in association with the ascending of the piston during a return of the door.

As a result, in the hinge apparatus according to the third embodiment of the present invention, oil also moves to the upper chamber via the second speed adjustment oil path 261 while the check valve is opened according to opening of the door, and thus the piston 260 easily descends to make the door opened, and maintains the stop state in the first and second stop sections "b" and "c."

Also, when the door is closed, oil in the upper chamber moves to the lower chamber via the return oil path 253 and the first speed adjustment oil path 254*a* as the check valve maintains the closed state. In this case, the ascending speed of the piston 260 is controlled in three steps such as low speed, high speed and low speed according to the structure of the hydraulic control rod 280, and thus the door is also closed at three-step speed.

Figure 18:
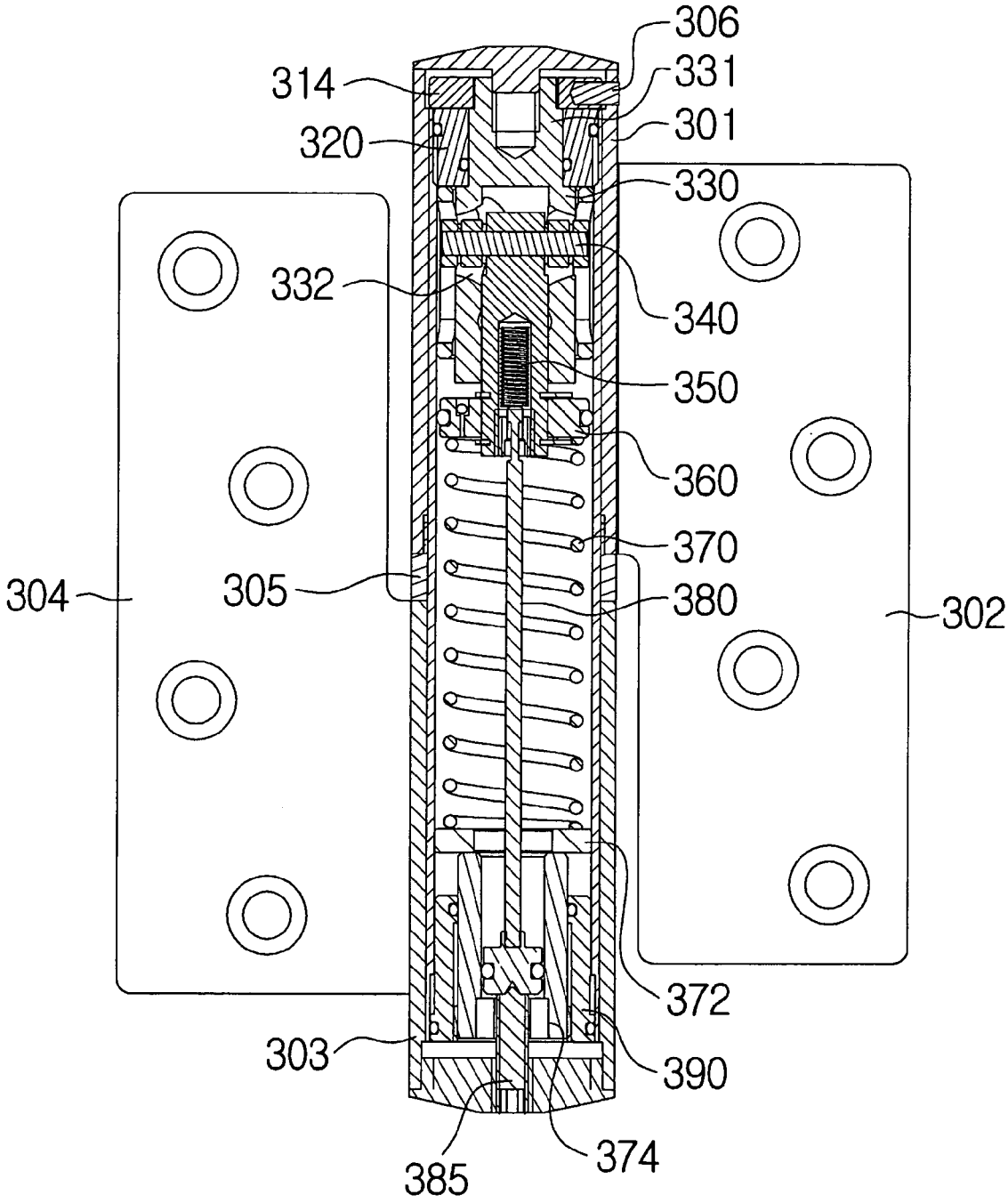
FIG. 18 is an exploded perspective view showing an installation structure when the multipurpose hinge apparatus according to the third embodiment of the present invention is applied to a door hinge apparatus.

The hinge apparatus according to the third embodiment of the present invention can be applied to the door hinge apparatus as in the first embodiment of the present invention shown in FIG. 11. FIG. 18 is an exploded perspective view showing an installation structure when the multipurpose hinge apparatus according to the third embodiment of the present invention is applied to a door hinge apparatus.

As shown in FIG. 18, in the door hinge apparatus which is installed between a door and a door frame, a movable hinge plate 302 is fixed to the door, a fixed hinge plate 304 is fixed to the door frame, and a trust bearing 305 for reducing a friction due to rotation is installed between an upper hinge knuckle 301 attached to one side of the movable hinge plate 302 and a lower hinge knuckle 303 attached to one side of the fixed hinge plate 304.

Also, in the hinge apparatus, the same components as those of the third embodiment of the present invention are inserted into and assembled in the upper and lower hinge knuckles 301 and 303. In this case, a stop angle connection plate 314 is engaged with a shaft 231 of the cam shaft 330 which protrudes upwards from the upper packing 320. The top angle connection plate 314 is fixed to the upper hinge knuckle 301 by a stop angle adjustment bolt 306. Thus, the cam shaft 320 rotates according to opening of the door.

In the case that the cam shaft 330 rotates, the guide pin 340 descends along ascending and descending guide holes 332 as in the operation of the third embodiment of the present invention, and a piston rod 350 and a piston 360 connected to the guide pin 340 compress an elastic member 370 and descend.

Also, in the case that a small external force is applied in a direction of closing a door, the guide pin 340 secedes from a stop section in ascending and descending guide holes 332, and then the guide pin 340 and the piston 360 ascend by a repulsive force of the elastic member 370, to thereby close the door while adjusting speed of the door.

In the multipurpose hinge apparatus according to the present invention, a stop angle connection plate 314 engaged with the cam shaft 330 is made to rotate by a certain amount and then is fixed by the stop angle adjustment bolt 306, to thereby adjust an rotational angular range of the cam shaft 330 and adjust a rotational range of opening and closing the odor and a stop angle of the door.

Also, the hinge apparatus ascends and descends elastic force adjustment plate 372 by means of elastic force adjustment unit 374, to thereby adjust a compression ratio of the elastic member 370, respectively. Accordingly, speed of the door which is closed can be adjusted by change in an amount of oil flow.

Also, the multipurpose hinge apparatus according to the present invention ascends and descends hydraulic control rod 380 which is inserted into the first speed adjustment oil path 254*a* which provides an oil path by means of an oil flow control bolt 385. Accordingly, speed of the door which is closed can be adjusted by change in an amount of oil flow.

Hereinbelow, a structure of a hinge apparatus according to the present invention when the hinge apparatus is applied to an up/down rotational refrigerator door, will be described.

Figure 19A:
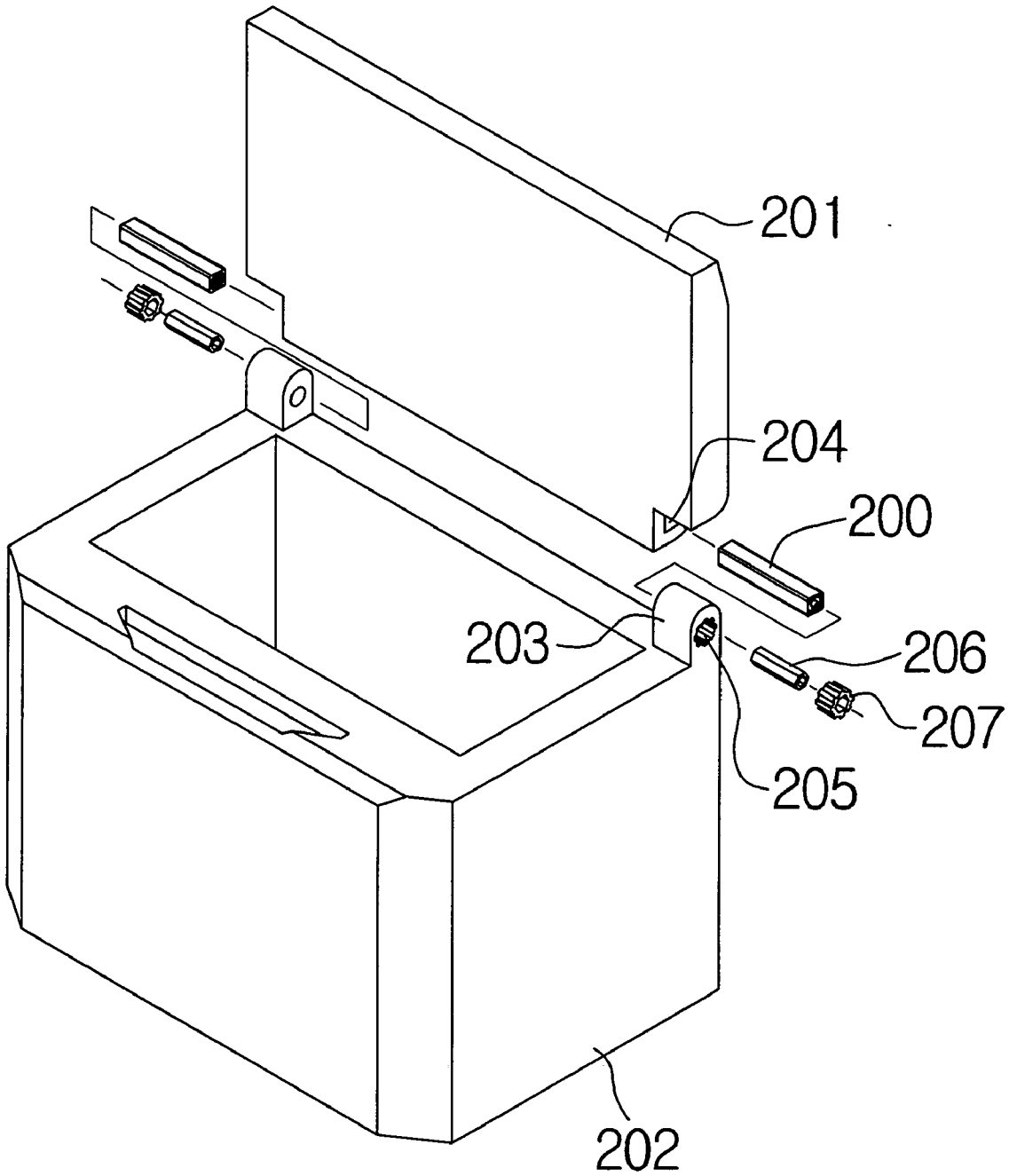
FIGS. 19A and 19B are an exploded perspective view and an assembly perspective view respectively showing a connection structure when the multipurpose hinge apparatus according to the third embodiment of the present invention is applied to an up/down rotational door.
Figure 19B:
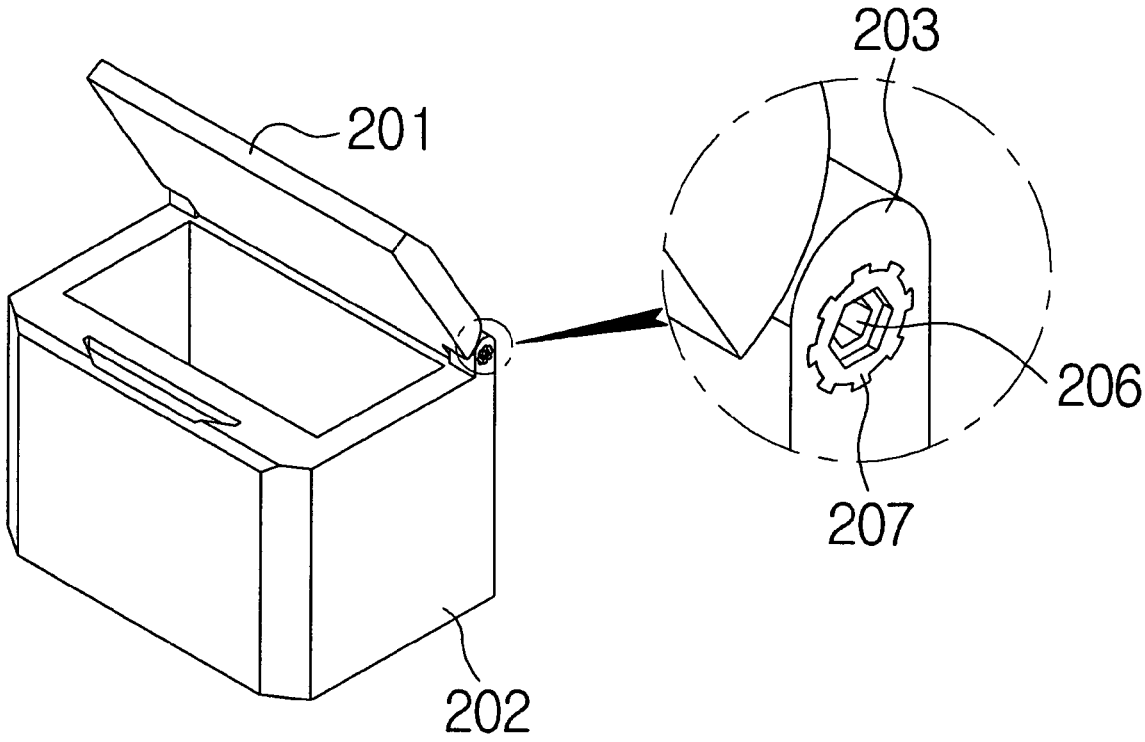
Figure 20:
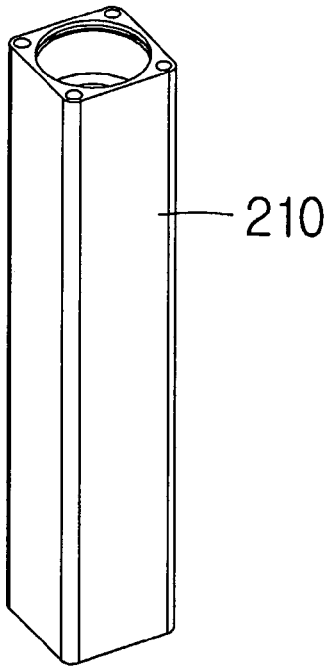
FIG. 20 is an enlarged perspective view showing the connection structure in the housing shown in FIG. 19A.

For example, FIGS. 19A and 19B are an exploded perspective view and an assembly perspective view respectively showing a connection structure when the multipurpose hinge apparatus according to the third embodiment of the present invention is applied to an up/down rotational door. FIG. 20 is an enlarged perspective view showing the connection structure in the housing shown in FIG. 19A. However, the hinge apparatuses according to the first and second embodiments of the present invention in addition to the third embodiment can be applied to the up/down rotational door in the same manner as those of the others. Also, the present invention can be applied to other devices other than a refrigerator.

As illustrated, when the multipurpose hinge apparatus according to the present invention is applied in a box-shaped refrigerator up/down rotational door, the multipurpose hinge apparatus 200 is inserted into and installed in burial grooves formed in both ends of the door 201. The door 201 is connected with a main body 202 of the refrigerator so as to be rotated up and down around both ends of the door 201. In this case, it is preferable that a housing 210 and the burial grooves 204 are formed in a rectangular form as in FIG. 20, in order to prevent the housing from rotating during rotation of the door.

In the multipurpose hinge apparatus 200, a shaft 231 of the cam shaft 230 is engaged with a hinge pin 206. That is, the outer circumference of the shaft 231 of the cam shaft 230 is formed in a rectangular form and the inner portion of the hinge pin 206 is formed in a rectangular form which is same as that of the shaft 231. Accordingly, the cam shaft 230 and the hinge pin 206 are engaged with each other.

Also, the outer circumference of the hinge pin 206 is also formed in a polygonal form. In the present invention, the outer circumference of the hinge pin 206 is formed of a hexagonal shape as an example. The hinge pin 206 is again engaged with a throughhole formed in a stop angle adjustment nut 207. The throughhole of the stop angle adjustment nut 207 is same as the shape of the outer circumference of the hinge pin 206, and thus the stop angle adjustment nut 207 is engaged with the hinge pin 206 mutually.

The outer circumference of the stop angle adjustment nut 207 is formed in a spline fashion. A spline boss groove 205 is formed in a main body fixing portion 203 which is engaged with the stop angle adjustment nut 207. Accordingly, the stop angle adjustment nut 207 is inserted into and fixed to the spline boss groove 205. As needed, the stop angle adjustment nut 207 is separated from the spline boss groove 205, and then the former is inserted into the latter again.

Thus, the multipurpose hinge apparatus according to the present invention is applied to an up/down rotational refrigerator door using the above-described door connection structure, the door 201 is opened upwards by a user. When the door in the multipurpose hinge apparatus 200 is closed, the door speed is controlled in three steps such as low speed, high speed and low speed as in the third embodiment of the present invention, and thus closed downwards.

As a result, the hinge apparatus is prevented from being exposed externally, to thereby make the external appearance of the refrigerator good. Also, the door is closed at maximum at high speed by an appropriate hydraulic control. Also, a problem that a large impact is transferred to a refrigerator body by its own weight during closing of the door, can be solved.

Also, in the refrigerator door connection structure according to the present invention, an angle of stopping the door 201 can be adjusted according to user selection. That is, a user rotates the hinge pin 206 to thus make the cam shaft 230 rotate at a predetermined angle. Thereafter, the hinge pin 206 is fitted into the stop angle adjustment nut 207 and then the stop angle adjustment nut 207 is combined with and fixed to the spline boss groove 205 of the main body fixing portion 203.

As a result, the cam shaft 230 in the multipurpose hinge apparatus 200 is at a state where it is rotated by a certain angle as described above, and thus a distance through which the guide pin 240 moves in the ascending and descending section "a" shown in FIG. 16B, is for example, reduced or extended. Thus, a rotational angle of the cam shaft 230 (that is, a door opening angle) which reaches the first and second stop sections "b" and "c" is also changed, to thereby adjust a stop angle and a rotational range of the door 201.

Thus, a user establishes a stop angle and a rotational range of the door 201 as described above, considering an opening angle of the refrigerator door which is the most frequently used, to thereby use the refrigerator conveniently.

Figure 21A:
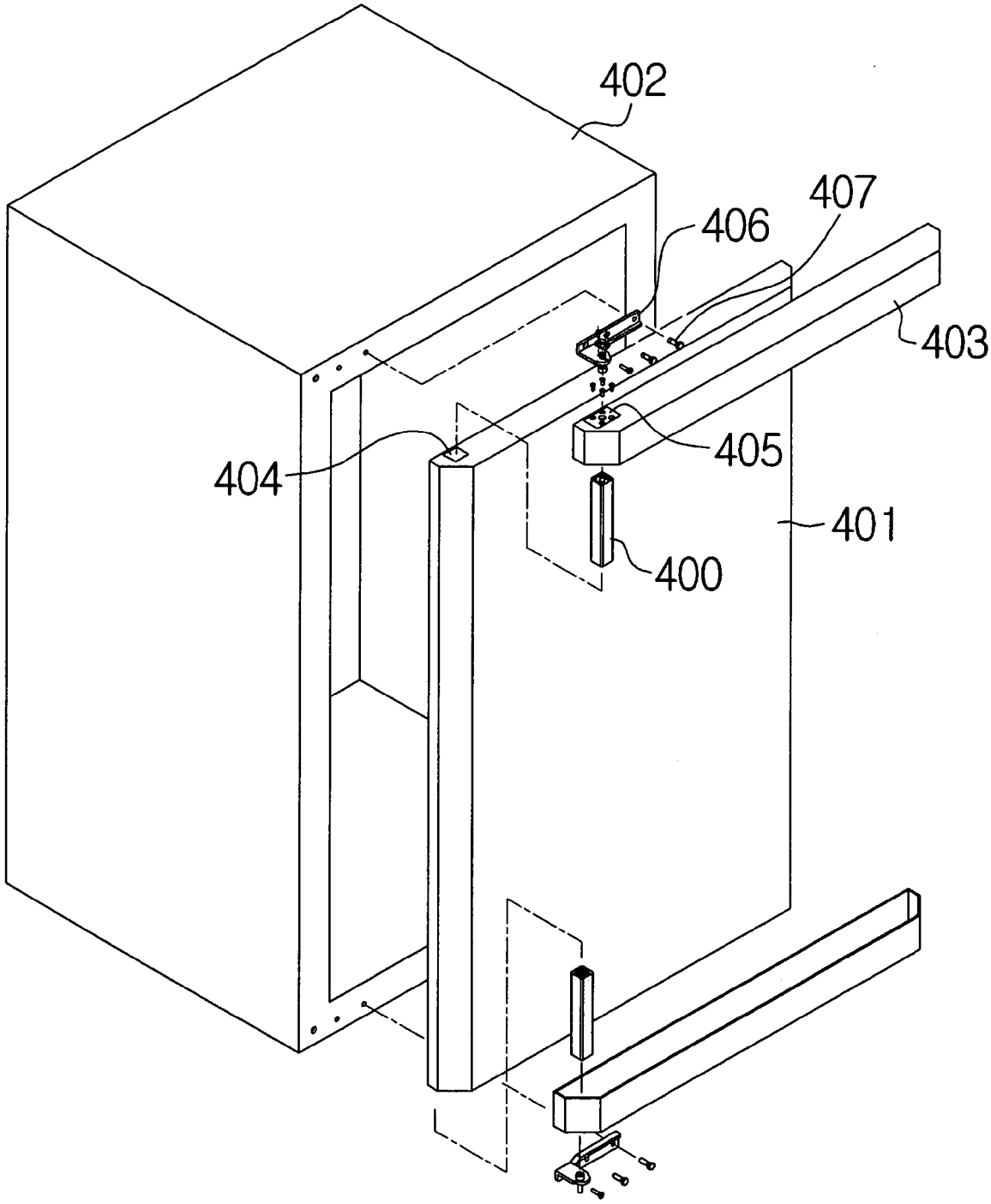
FIGS. 21A and 21B are an exploded perspective view and a partial enlarged perspective view respectively showing a connection structure when the multipurpose hinge apparatus according to the present invention is applied to a left/right rotational door.
Figure 21B:
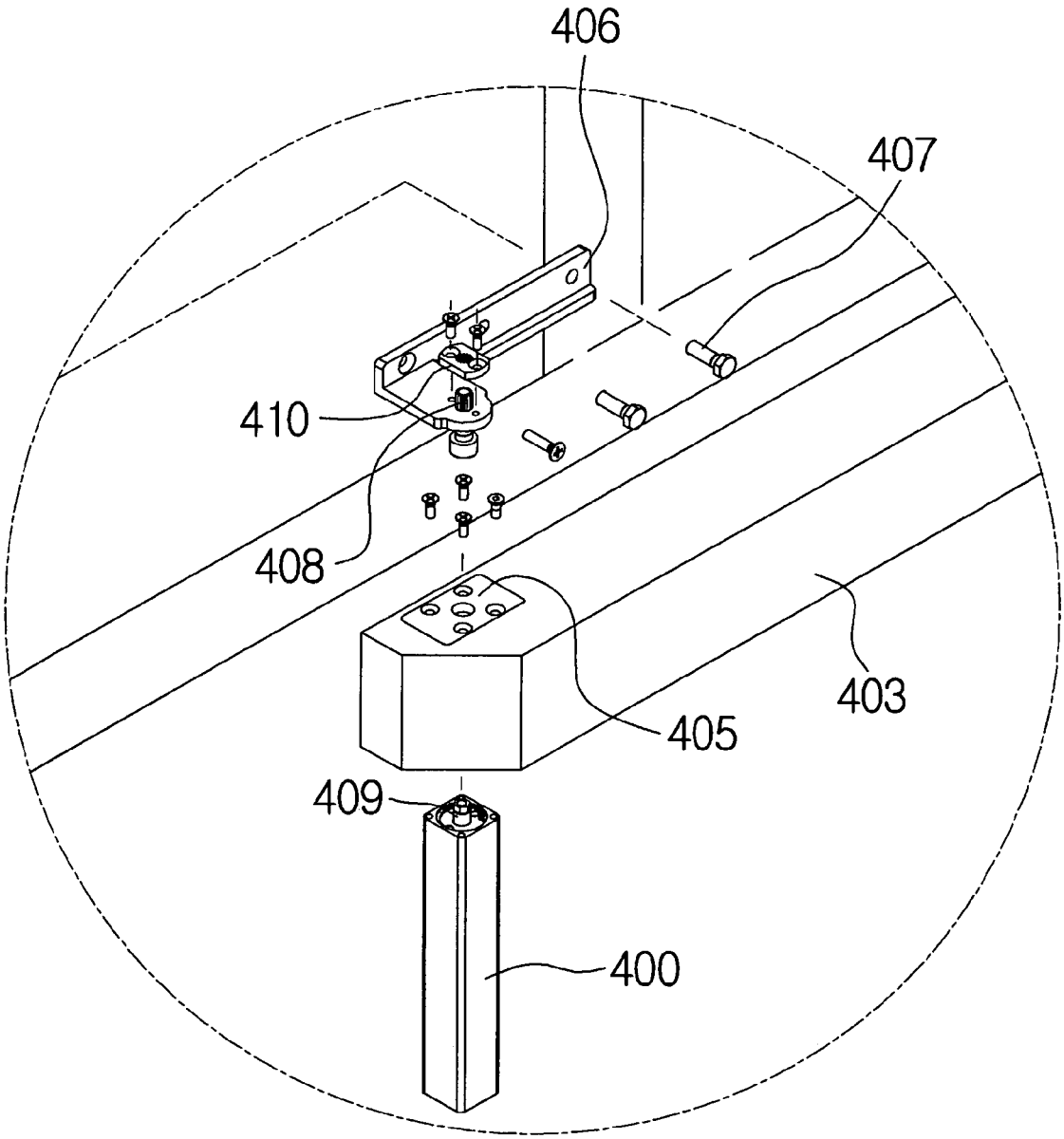

Also, the hinge apparatus according to the present invention can be applied to a left/right rotational door as shown in FIGS. 21A and 21B, in which the rotational axis of the hinge apparatus is same as that of the door, for example, a refrigerator door.

In the door connection structure for a refrigerator, a door 401 is connected with a refrigerator body 402 by a multipurpose hinge apparatus 400, so that the door 401 can rotate to the left and right with respect to the refrigerator body 402 around one end of the door 401 as an axis. For this purpose, burial grooves 404 are formed in the upper end and/or the lower end of the door 401 in correspondence to the shape of the multipurpose hinge apparatus 400, respectively. The multipurpose hinge apparatus 400 is inserted into and installed in each of the burial grooves 404. Here, it is preferable that the shape of the burial grooves 404 is identical with that of the housing in the multipurpose hinge apparatus 400 and is formed of a rectangular shape to suppress rotation.

In the multipurpose hinge apparatus 400, the upper end of the housing is combined with and fixed to a door upper supporting bar 403 by bolts. A reinforcement plate 405 enhancing a binding force of the multipurpose hinge apparatus 400 is additionally attached to the upper supporting bar 403.

In the multipurpose hinge apparatus 400 which is combined as described above, a shaft 409 of the cam shaft penetrates through and protrudes from the upper portion of the upper supporting bar 403. The outer circumference of the shaft 409 of the cam shaft is formed polygonally, and engaged with the inner side of a stop angle adjustment bolt 408.

The inner circumferential shape of one end of the stop angle adjustment bolt 408 is formed in correspondence to the outer circumferential shape of the shaft 409, and the outer circumferential shape of the other end of the stop angle adjustment bolt 408 is formed in a spline shape, and engaged with a main body fixing unit 406.

The main body fixing unit 406 whose one side is engaged with the stop angle adjustment bolt 408 and whose other side is fixed to the refrigerator main body 402 by a fixing bolt 407, has a shape of a certain length member which is bent at right angle. A spline boss pattern is formed in the inner side of the main body fixing unit 406 so that one side of the main body fixing unit 406 is engaged with the stop angle adjustment bolt 408. Also, a reinforcement plate may be added and fixed on one side of the main body fixing unit 406 in order to enhance a coupling force.

Since the shaft of the multipurpose hinge apparatus 400 is fixedly connected with the main body fixing unit 406 in the door connection structure for a refrigerator according to the present invention, the multipurpose hinge apparatus 400 operates as in the above-described embodiment, to thereby open and close the door 401.

Also, the door connection structure to which the hinge apparatus according to the present invention is applied can be applied to an opening and closing device such as a portable phone and a notebook computer where two members are widened or folded with each other around one axis, as well as a refrigerator.

As described above, a multipurpose hinge apparatus adjusts an amount of oil flow and a cam diagram angle in an ascending and descending guide hole, to thereby adjust a return speed and a return force of a door simultaneously and to thus automatically close the door, and also temporarily stop the door which is opened at a certain angle by a pattern of a cam diagram angle.

Also, a hinge apparatus according to the present invention can be completely returned to an initial position of a door although a torsion spring is not used but a compression spring is used as a return spring during an automatic return of the door, by establishing a cam diagram angle of an ascending and descending guide hole at a door opening angle region between 0° and 15° to be relatively larger than that at a door opening angle region between 15° and 90°. To the contrary, by establishing a cam diagram angle of an ascending and descending guide hole at a door opening angle region between 0° and 15° to be relatively smaller than that at a door opening angle region between 15° and 90°, an automatic return speed of the up/down opening and closing door can be retarded.

Further, the present invention provides a multipurpose hinge apparatus which can be automatically closed so that a door is adjusted at fast speed until the door gets close to an initial position and at slow speed after the door has got to the initial position, by establishing return speed in three steps, according to a door opening angle, by a cam diagram angle of an ascending and descending guide hole which guides ascending of a piston during an automatic return of a door and a hydraulic circuit mechanism.

Also, the present invention provides a multipurpose hinge apparatus which prevents a door from being automatically returned by a return spring, and maintains the door to be opened at an opened angle, by establishing a cam diagram angle of an ascending and descending guide hole which guides ascending of a piston to be zero when an opening angle of the door ranges between 90° and 130°.

Also, the present invention provides a multipurpose hinge apparatus having an excessive speed return prevention function which prevents a door from being returned at excessive speed by a strong force such as a strong wind and prevents a safety accident, which enables a user to freely and easily establish an amount of oil flow which determines return speed during an automatic return of a door, at the outer portion of the hinge apparatus, and which employs a bearing mechanism in order to minimize a friction between a stationery portion and a rotating axis and adopts a roller in a guide pin, to thereby suppress noise generation and partial wear due to the friction at minimum.

Further, the present invention provides a multipurpose hinge apparatus having a high operational reliability and an excellent assembly workability in which a return speed controlling mechanism and a return speed establishment mechanism of a door is simple and stable, and which enables a user to make a large-scale door to be returned with a small force in which a lengthwise space structure capable of accommodating a return spring at maximum with respect to the total length of the hinge apparatus is provided to thereby provide a large restoring force during an automatic return of a door.

Also, the present invention provides a hinge apparatus which can be applied in any hinge apparatus whose rotational axis is same or different from that of a door in a left/right rotating door hinge apparatus or an up/down rotational hinge apparatus which is applied in a Kimchi refrigerator for use in a storage device for storing a fermentation food such as Kimchi which is one of Korean traditional foods.

Also, the present invention provides a hinge apparatus which can be buried in an up/down rotational door such as a refrigerator door, to thereby provide a refrigerator whose appearance is elegant, and which enables a user to adjust a closing speed in multiple steps and establishment of an angle of an opened state, to thereby make it convenient to use the refrigerator.

As described above, a multipurpose hinge apparatus according to the present invention has been described with reference to the accompanying drawings. However, the present invention is not limited to the above-described embodiments. It is apparent to one who has an ordinary skill in the art that there may be many modifications and variations within the same technical spirit of the invention.

What is claimed is:

1. A hinge apparatus for a door comprising:

a tubular housing;

a housing upper sealing packing at the center of which a throughhole is formed and which is combined with the upper end of the housing in order to seal the upper portion of the housing;

a cam shaft including a cylindrical body having first and second ascending and descending guide holes penetratively formed into a spiral shape of a mutually movable symmetrical structure along the outer circumferential surface, respectively, and a shaft of protruding out of the housing through the throughhole of the upper packing from the upper end of the cylindrical body, the cam shaft rotating by an external force relative to the housing when a door rotates;

a cylindrical guide tube which is fixedly installed in the inner circumferential portion of the housing, in which first and second vertical guide holes are formed up and down at positions opposing each other, and the cylindrical body of the cam shaft is rotatably installed in the inner circumferential portion of the housing;

a guide pin both ends of which are combined with the first and second vertical guide holes through the first and second ascending and descending guide holes, respectively;

a piston rod on the upper end of which the central portion of the guide pin is penetratively combined and which ascends and descends along the inner circumferential surface of the cylindrical body of the cam shaft in a sliding method via the first and second vertical guide holes according to rotation of the cam shaft, in which a recessed groove communicating with the outer circumferential portion is formed in the lower portion of the piston rod;

a piston which ascends and descends according to movement of the piston rod, and whose outer circumferential portion is slidably coupled with the inner circumferential portion of the housing to partition the inner space of the housing into an upper chamber and a lower chamber, in which the lower end of the piston rod is coupled with the central throughhole formed in the central portion thereof, and a first oil path communicating the upper chamber and the lower chamber with each other via the piston rod and the central throughhole is formed;

at least one check valve which is installed in the piston and is opened during the time when the piston descends, and is closed during the time when the piston ascends, to thereby selectively form a unidirectional communication between the upper chamber and the lower chamber;

an elastic member which is installed in the lower chamber to elastically support the piston, and provides an elastic force for making the piston ascend during return of the piston after descending of the piston according to opening of the door;

means for adjusting an amount of oil flowing from the upper chamber to the lower chamber via the first oil path responsive to an escalated height of the piston rod when the piston rod ascends along the inner circumferential surface of the cam shaft body during the return of the door, to thereby control an escalating speed of the piston in multiple steps; and a housing lower packing which is coupled with the lower portion of the housing to seal the lower chamber.

2. The hinge apparatus for a door according to claim 1, wherein said means for adjusting an amount of oil flowing comprises at least one speed adjustment oil path internally connected with a recessed groove of the piston rod communicating with the first oil path perpendicularly from the outer circumferential surface of the piston rod, wherein the speed adjustment oil path is closed by the inner circumferential surface of the cam shaft in the case that the door opening angle reaches a set angle.

3. The hinge apparatus for a door according to claim 1, wherein said first and second ascending and descending guide holes are divided into a first ascending and descending section having a door opening angle ranging between 0° and 15°, a second ascending and descending section having a door opening angle ranging between 15° and 90°, a first stop section having a door opening angle ranging between 90° and 130°, and a second stop section having a door opening angle ranging between 130° and 160°.

4. The hinge apparatus for a door according to claim 3, wherein the cam diagram angle in the first ascending and descending section is established between 45° and 65° and the cam diagram angle in the second ascending and descending section is established between 10° and 45° when the door is a left/right opening and closing door.

5. The hinge apparatus for a door according to claim 3, wherein the cam diagram angle in the first ascending and descending section is established between 30° and 45° and the cam diagram angle in the second ascending and descending section is established between 10° and 45° when the door is an up/down opening and closing door.

6. The hinge apparatus for a door according to claim 3, wherein the first ascending and descending section is a low-speed return section during an automatic return of a door, in which a closing force loss is supplemented by setting the cam diagram angle of the first ascending and descending section to be relatively greater than that of the second ascending and descending section, to thus enhance an efficiency of ascending of the piston, the second ascending and descending section is a high-speed return section during an automatic return of a door, in which an opening force increment is supplemented by setting the cam diagram angle of the second ascending and descending section to be relatively smaller than that of the first ascending and descending section, to thereby increase a rotating efficiency of the cam shaft proportionally when the door is opened, the first stop section is a section where the cam diagram angle is set to be zero (0) to thus interrupt an automatic return of the door and to thereby maintain an angle at the state where the door is opened, and the second stop section is a door stopping force reinforcing section, in which the directions of the ascending and descending guide holes are established into those of the first and second ascending and descending sections.

7. The hinge apparatus for a door according to claim 1, further comprising an overspeed prevention unit which is incorporated in a recessed groove located in the lower end of the piston rod combined with the central throughhole of the piston, for closing the first oil path in the case that the piston ascends at excessive high speed.

8. The hinge apparatus for a door according to claim 1, further comprising:

a support bracket whose one end is fixed on the lower surface or upper surface of the main body of the hinge apparatus, and whose other end extended from the main body of the hinge apparatus supports the rotational axis of the door pivotally;

a flange which is fixed on the housing upper sealing packing and the lower surface or upper surface of the door so that the housing is supported at the state where the housing is buried into a recessed groove formed on the lower surface or upper surface of the door at a certain distance from the rotational axis of the door;

a driving link whose one end is fixedly combined with the shaft of the cam shaft; and a following link whose one end is pivotally combined with the other end of the driving link and whose other end is hingedly combined with the hinge axis located on the main body of the hinge apparatus of the support bracket.

9. The hinge apparatus for a door according to claim 1, wherein the shaft of the cam shaft is combined with a first hinge knuckle in a movable hinge plate and the housing is combined with a second hinge knuckle in a fixed hinge plate, so that the shaft is installed in a hinge fashion between the door and door frame.

10. The hinge apparatus for a door according to claim 1, wherein the housing in the hinge apparatus is buried and installed in the door, and the shaft in the cam shaft is fixedly combined with the door frame.

11. The hinge apparatus for a door according to claim 1, further comprising:

a pair of burial grooves which bury the housing the hinge apparatus in both ends of the door;

a pair of main body fixing units which protrude adjacent to both side ends of the door in which a spline boss groove is formed;

a pair of hinge pins whose inner and outer circumferential portions are formed of a polygonal shape so as to be mutually engaged with shafts of the cam shaft formed of a polygonal shape; and a pair of stop angle adjustment nuts having a polygonal inner circumferential portion so that the outer circumference of the polygonal hinge pin is combined with the throughhole in the inner circumferential portion and an outer circumferential portion which is formed of a spline shape and is fixedly inserted into a spline boss groove.

12. The hinge apparatus for a door according to claim 1, further comprising:

a control pipe whose upper end is combined with the central throughhole of the piston to thereby form the third oil path communicating with the first oil path and whose lower end is combined with a head sealing the lower end thereof, the control pipe having a first throughhole communicating with the upper side of the head and ascending and descending in association with movement of the piston;

an outer tube at the upper side of which second and third throughholes communicating with the lower chamber are formed, and at the lower side of which a fourth throughhole communicating with the lower chamber is formed;

a lower chamber sealing packing which is combined with the lower end of the housing in order to seal the lower chamber in which the lower end of the outer tube is fixed to the central throughhole;

an inner tube which has an inner diameter corresponding to the outer diameter of the control pipe so that the head is slidably combined with the inner tube, and an outer diameter corresponding to the inner diameter of the outer tube, so as to be combined with the inner portion of the outer tube, and which has fifth and sixth throughholes corresponding to the second and third throughholes in order to communicate the upper area partitioned by the head with the lower chamber, and a seventh throughhole corresponding to the fourth throughhole in order to communicate the lower area below the head with the lower chamber;

an outer tube sealing packing which is combined with the outer circumferential portion of the control pipe and the upper portion of the outer tube to thus separate the upper area of the inner tube from the lower chamber and simultaneously slidably support the control pipe; and an inner tube lower sealing packing into an upper groove of which the lower portion of the inner tube is fixed, to thereby seal the lower portion of the inner tube, wherein the second and fifth throughholes and the third and sixth throughholes form first and second speed adjustment oil paths, respectively, and the fourth and seventh throughholes form a fourth oil path.

13. The hinge apparatus for a door according to claim 1, further comprising:

a control pipe whose upper end is combined with the central throughhole of the piston to thereby form the third oil path communicating with the first oil path and whose lower end is combined with a head sealing the lower end thereof, the control pipe having a first throughhole communicating with the upper side of the head and ascending and descending in association with movement of the piston;

an outer tube in the inner circumferential portion of the upper end of which the head of the control pipe is accommodated;

a lower chamber sealing packing which is combined with the lower end of the housing in order to seal the lower chamber in which the lower end of the outer tube is fixed to the central throughhole;

an inner tube which has an inner diameter corresponding to the outer diameter of the control pipe so that the head is slidably combined with the inner tube, and whose inner portion is partitioned into an upper area and a lower area by the head and rotatably combined with the inner portion of the outer tube;

an outer tube sealing packing which is combined between the outer circumferential portion of the control pipe and the upper portion of the outer tube to thus separate the upper area of the inner tube from the lower chamber and simultaneously slidably support the control pipe;

an inner tube lower sealing packing into an upper groove of which the lower portion of the inner tube is fixed, to thereby seal the lower portion of the inner tube;

first and second speed adjustment oil paths which are formed at a certain interval and on the same level of the upper sides of the inner tube and the outer tube, and communicate the upper area of the inner tube with the lower chamber; and a fourth oil path communicating the lower area of the inner tube with the lower chamber, wherein the second speed adjustment oil path is closed by the head of the control pipe according to ascending of the control pipe in the case that the door is near the initial state.

14. The hinge apparatus for a door according to claim 13, further comprising a speed change unit which adjusts an amount of oil flowing through the first and second speed adjustment oil paths to the lower chamber, to thereby change an ascending speed of the piston during an automatic return of the door.

15. A hinge apparatus for a door comprising:

a tubular housing;

a housing upper sealing packing at the center of which a throughhole is formed and which is combined with the upper end of the housing in order to seal the upper portion of the housing;

a cam shaft through which first and second ascending and descending guide holes are penetratively formed in which the first and second ascending and descending guide holes are formed into a spiral shape of a mutually movable symmetrical structure along the outer circumferential surface of a cylindrical body, respectively, and which rotates by an external force relative to the housing when the shaft protrudes out of the housing through the throughhole of the upper packing from the upper end of the cylindrical body and thus a door rotates;

a cylindrical guide tube which is fixedly installed in the inner circumferential portion of the housing, in which first and second vertical guide holes are formed up and down at positions opposing each other, and the cylindrical body of the cam shaft is rotatably installed in the inner circumferential portion of the housing;

a guide pin both ends of which are combined with the first and second vertical guide holes through the first and second ascending and descending guide holes, respectively;

a piston rod on the upper end of which the central portion of the guide pin is penetratively combined and which ascends and descends via the first and second vertical guide holes according to rotation of the cam shaft, in which a recessed groove communicating with the outer circumferential portion is formed in the lower portion of the piston rod;

a piston which ascends and descends according to movement of the piston rod, and whose outer circumferential portion is slidably coupled with the inner circumferential portion of the housing to partition the inner space of the housing into an upper chamber and a lower chamber, in which the lower end of the piston rod is coupled with the central throughhole formed in the central portion thereof, and a first oil path communicating the upper chamber and the lower chamber with each other via the central throughhole of the piston rod is formed;

at least one check valve which is installed in the piston and is opened during the time when the piston descends, and is closed during the time when the piston ascends, to thereby selectively form a unidirectional communication between the upper chamber and the lower chamber;

an elastic member which is installed in the lower chamber to elastically support the piston, and provides an elastic force for making the elastic member compressed during the time when the piston descends, according to opening of the door, and making the piston ascend during return of the door; and a housing lower packing which is coupled with the lower portion of the housing to seal the lower chamber, wherein diameter of an exit of the central throughhole is formed relatively smaller than that of the check valve, the check valve is closed during the return of the door, oil flows from the upper chamber to the lower chamber via the first oil path, to thereby make the piston ascend at retarded speed, and wherein a number of horizontal throughholes of the piston rod form mechanism for adjusting an ascending speed of the piston.

16. A multipurpose hinge apparatus comprising:

a cylindrical housing whose inner circumferential portion is cylindrically formed;

a housing upper sealing packing at the center of which a throughhole is formed and which is combined with the upper end of the housing in order to seal the upper portion of the housing;

a cam shaft through which first and second ascending and descending guide holes are penetratively formed in which the first and second ascending and descending guide holes are formed into a spiral shape of a mutually movable symmetrical structure along the outer circumferential surface of a cylindrical body, respectively, and which rotates by an external force relative to the housing when the shaft protrudes out of the housing through the throughhole of the upper packing from the upper end of the cylindrical body and thus a door rotates;

a cylindrical guide tube which is fixedly installed in the inner circumferential portion of the housing, in which first and second vertical guide holes are formed up and down at positions opposing each other, and the cylindrical body of the cam shaft is rotatably installed in the inner circumferential portion of the housing;

a guide pin both ends of which are combined with the first and second vertical guide holes through the first and second ascending and descending guide holes, respectively;

a piston rod on the upper end of which the central portion of the guide pin is penetratively combined and which ascends and descends via the first and second vertical guide holes according to rotation of the cam shaft, in which a return oil path communicating with the outer circumferential portion thereof is formed on an oil path elongate groove which is opened downwards;

an oil path adjustment unit which is in the oil path elongate groove of the piston rod, having an inner diameter smaller than that of the oil path groove, in which a first speed adjustment oil path of an orifice shape whose diameter becomes gradually narrow is formed therein so that an amount of oil flowing inside is adjusted;

a piston which ascends and descends according to movement of the piston rod, and whose outer circumferential portion is slidably coupled with the inner circumferential portion of the housing to partition the inner space of the housing into an upper chamber and a lower chamber, in which the lower end of the piston rod is coupled with the central throughhole formed in the central portion thereof;

at least one check valve which is installed in the piston and is opened during the time when the piston descends, and is closed during the time when the piston ascends, to thereby selectively form a unidirectional communication between the upper chamber and the lower chamber;

an elastic member which is installed in the lower chamber to elastically support the piston, and provides an elastic force for making the elastic member compressed during the time when the piston descends, according to opening of the door, and making the piston ascend during return of the door;

a housing lower sealing packing which is coupled with the lower portion of the housing; and a hydraulic control rod whose one end is supported to the housing lower packing and other end is inserted into the first speed adjustment oil path, in which diameter of the other end of the hydraulic control rod is changed in multiple steps so that cross-sectional area of the first speed adjustment oil path through which oil flows according to movement of the piston rod up and down is changed in multiple steps, wherein the other end of the hydraulic control rod is formed of a first diameter portion having a first diameter, a second diameter portion having a diameter smaller than the first diameter, and a spherical portion having a diameter identical with the first diameter, and an automatic return speed of a door is changed into low speed, high speed and low speed, in sequence.

17. The multipurpose hinge apparatus according to claim 16, wherein the first and second ascending and descending guide holes each comprise an ascending and descending section which is formed with a certain width through which the guide pin can be inserted in a slope downwards on the outer circumferential surface of the cam shaft; a first stop section formed to have the same level in the lower end of the ascending and descending section so that the guide pin does not ascend and descend; and a second stop section which is bent and formed in a slope from the end of the first stop section toward the upper portion thereof so that the guide pin does not move to the ascending and descending section again.

18. A hinge apparatus for a door comprising:

a tubular housing;

a housing upper sealing packing at the center of which a throughhole is formed and which is combined with the upper end of the housing in order to seal the upper portion of the housing;

a cam shaft through which first and second ascending and descending guide holes are penetratively formed in which the first and second ascending and descending guide holes are formed into a spiral shape of a mutually movable symmetrical structure along the outer circumferential surface of a cylindrical body, respectively, and which rotates by an external force relative to the housing when the shaft protrudes out of the housing though the throughhole of the upper packing from the upper end of the cylindrical body and thus a door rotates;

a cylindrical guide tube which is fixedly installed in the inner circumferential portion of the housing, in which first and second vertical guide holes are formed up and down at positions opposing each other, and the cylindrical body of the cam shaft is rotatably installed in the inner circumferential portion of the housing; a guide pin both ends of which are combined with the first and second vertical guide holes through the first and second ascending and descending guide holes, respectively;

a piston rod on the upper end of which the central portion of the guide pin is penetratively combined and which ascends and descends according to the first and second vertical guide holes in accordance with rotation of the cam shaft, in which a recessed groove communicating with the outer circumferential portion is formed in the lower portion of the piston rod;

a piston which ascends and descends according to movement of the piston rod, and whose outer circumferential portion is slidably coupled with the inner circumferential portion of the housing to partition the inner space of the housing into an upper chamber and a lower chamber, in which the lower end of the piston rod is coupled with the central throughhole formed in the central portion thereof, and a first oil path communicating the upper chamber and the lower chamber with each other via the central throughhole of the piston rod is formed;

at least one check valve which is installed in the piston and is opened during the time when the piston descends, and is closed during the time when the piston ascends, to thereby selectively form a unidirectional communication between the upper chamber and the lower chamber;

an elastic member which is installed in the lower chamber to elastically support the piston, and provides an elastic force for making the elastic member compressed during the time when the piston descends, according to opening of the door, and making the piston ascend during return of the door;

a control pipe whose upper end is combined with the central throughhole of the piston to thereby form a second oil path communicating with the first oil path and whose lower end is combined with a head sealing the lower end thereof, the control pipe having a first throughhole communicating with the upper side of the head and ascending and descending in association with movement of the piston;

an outer tube in the inner circumferential portion of the upper end of which the head of the control pipe is accommodated;

a lower chamber sealing packing which is combined with the lower end of the housing in order to seal the lower chamber in which the lower end of the outer tube is fixed to the central throughhole;

an inner tube which has an inner diameter corresponding to the outer diameter of the control pipe so that the head is slidably combined with the inner tube, and whose inner portion is partitioned into an upper area and a lower area by the head and rotatably combined with the inner portion of the outer tube;

an outer tube upper sealing packing which is combined between the outer circumferential portion of the control pipe and the upper portion of the outer tube to thus separate the upper area of the inner tube from the lower chamber and simultaneously slidably support the control pipe;

an inner tube lower sealing packing into an upper groove of which the lower portion of the inner tube is fixed, to thereby seal the lower portion of the inner tube;

a housing lower packing which is coupled with the lower portion of the housing to seal the lower chamber;

first and second speed adjustment oil paths which are formed at a certain interval and on the same level of the upper sides of the inner tube and the outer tube, and communicate the upper area of the inner tube with the lower chamber; and a third oil path communicating the lower area of the inner tube with the lower chamber, wherein the second speed adjustment oil path is closed by the head of the control pipe according to ascending of the control pipe in the case that the door is near the initial state.

* * * * *